US009074273B2

(12) United States Patent
Branagan et al.

(10) Patent No.: US 9,074,273 B2
(45) **Date of Patent: *Jul. 7, 2015**

(54) METAL STEEL PRODUCTION BY SLAB CASTING

(71) Applicant: The NanoSteel Company, Inc., Providence, RI (US)

(72) Inventors: Daniel James Branagan, Idaho Falls, ID (US); Grant G. Justice, Idaho Falls, ID (US); Andrew T. Ball, Idaho Falls, ID (US); Jason K. Walleser, Idaho Falls, ID (US); Brian E. Meacham, Idaho Falls, ID (US); Kurtis Clark, Idaho Falls, ID (US); Longzhou Ma, Idaho Falls, ID (US); Igor Yakubtsov, Idaho Falls, ID (US); Scott Larish, Idaho Falls, ID (US); Sheng Cheng, Idaho Falls, ID (US); Taylor L. Giddens, Idaho Falls, ID (US); Andrew E. Frerichs, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/616,296

(22) Filed: Feb. 6, 2015

(65) Prior Publication Data

US 2015/0152534 A1 Jun. 4, 2015

Related U.S. Application Data

(63) Continuation of application No. 14/525,859, filed on Oct. 28, 2014.

(60) Provisional application No. 61/896,594, filed on Oct. 28, 2013.

(51) Int. Cl.
*C21D 9/46* (2006.01)
*C22C 38/58* (2006.01)
(Continued)

(52) U.S. Cl.
CPC ..... *C22C 38/58* (2013.01); *C21D 6/001* (2013.01); *C21D 6/002* (2013.01); *C21D 6/004* (2013.01); *C21D 6/005* (2013.01); *C21D 6/008* (2013.01); *C21D 1/18* (2013.01); *C22C 38/56* (2013.01); *C22C 38/54* (2013.01); *C22C 38/42* (2013.01); *C22C 38/40* (2013.01); *C22C 38/38* (2013.01);
(Continued)

(58) Field of Classification Search
CPC ..... C22C 38/34; C22C 38/54
USPC ..... 148/542
See application file for complete search history.

(56) References Cited

U.S. PATENT DOCUMENTS 5,647,922 A 7/1997 Kim et al.
6,464,807 B1 10/2002 Torizuka et al.
(Continued)

OTHER PUBLICATIONS

International Search Report dated Jan. 6, 2015 issued in related International Patent Application No. PCT/US2014/062647.

*Primary Examiner* — Jie Yang
(74) *Attorney, Agent, or Firm* — Grossman, Tucker, Perreault & Pfleger, PLLC

(57) ABSTRACT

The present disclosure is directed at metal alloys and methods of processing with application to slab casting methods and post-processing steps towards sheet production. The metals provide unique structure and exhibit advanced property combinations of high strength and/or high ductility.

8 Claims, 40 Drawing Sheets

Continuous slab casting process flow diagram.

(51) Int. Cl.

| | |
|---|---|
| ***C21D 6/00*** | (2006.01) |
| ***C21D 1/18*** | (2006.01) |
| ***C22C 38/56*** | (2006.01) |
| ***C22C 38/54*** | (2006.01) |
| ***C22C 38/42*** | (2006.01) |
| ***C22C 38/40*** | (2006.01) |
| ***C22C 38/38*** | (2006.01) |
| ***C22C 38/34*** | (2006.01) |
| ***C22C 38/32*** | (2006.01) |
| ***C22C 38/16*** | (2006.01) |
| ***C22C 38/08*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |

(52) U.S. Cl.

CPC ..... *C22C 38/34* (2013.01); *C22C 38/32* (2013.01); *C22C 38/16* (2013.01); *C22C 38/08* (2013.01); *C22C 38/04* (2013.01); *C22C 38/02* (2013.01); *C22C 38/004* (2013.01); *C21D 8/02* (2013.01)

(56) References Cited

U.S. PATENT DOCUMENTS

| | | | | |
|---|---|---|---|---|
| 8,133,333 | B2 * | 3/2012 | Branagan et al. | 148/561 |
| 8,257,512 | B1 | 9/2012 | Branagan et al. | |
| 8,419,869 | B1 * | 4/2013 | Branagan et al. | 148/579 |
| 8,641,840 | B2 * | 2/2014 | Branagan et al. | 148/561 |
| 2001/0004910 | A1 | 6/2001 | Yasuhara et al. | |
| 2008/0219879 | A1 | 9/2008 | Williams et al. | |
| 2009/0010793 | A1 | 1/2009 | Becker et al. | |
| 2012/0031528 | A1 | 2/2012 | Hayashi et al. | |
| 2013/0233452 | A1 | 9/2013 | Branagan et al. | |

* cited by examiner

FIG. 1 Continuous slab casting process flow diagram.

FIG. 2 Thin slab casting process flow diagram showing steel sheet production steps. Note that the process can be broken up into 3 process stages as shown.

FIG. 3 Schematic illustration of a hot (cold) rolling process where $h_o$ is an initial sheet thickness and $h$ is a final sheet thickness after rolling pass.

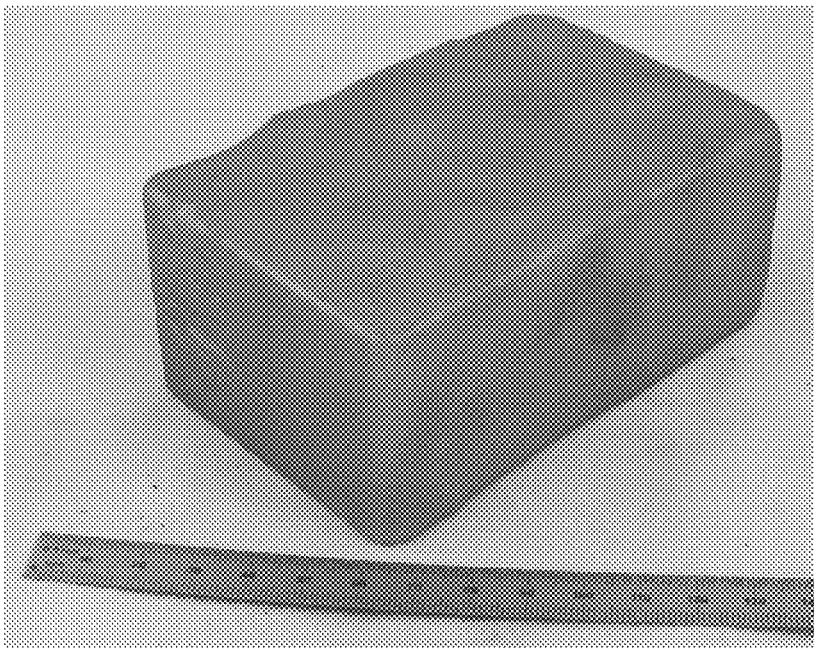
FIG. 9 Image of the as-cast plate of Alloy 2 with thickness of 50 mm.

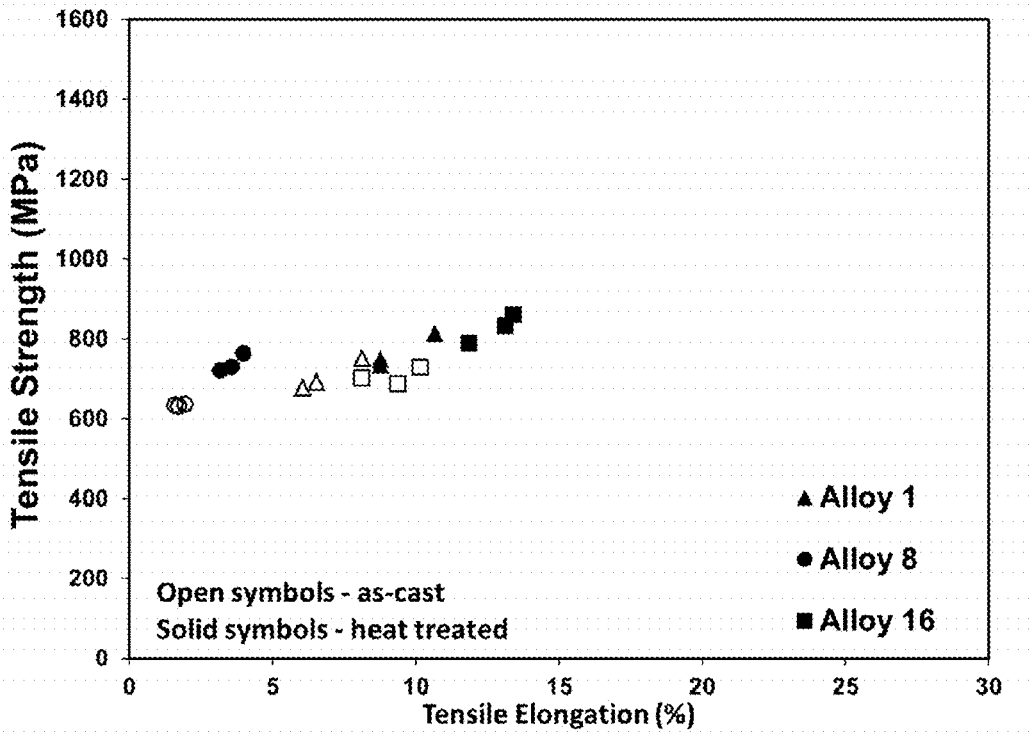
FIG. 10 Tensile properties of the plates from Alloy 1, Alloy 8 and Alloy 16 in as-cast and heat treated states.
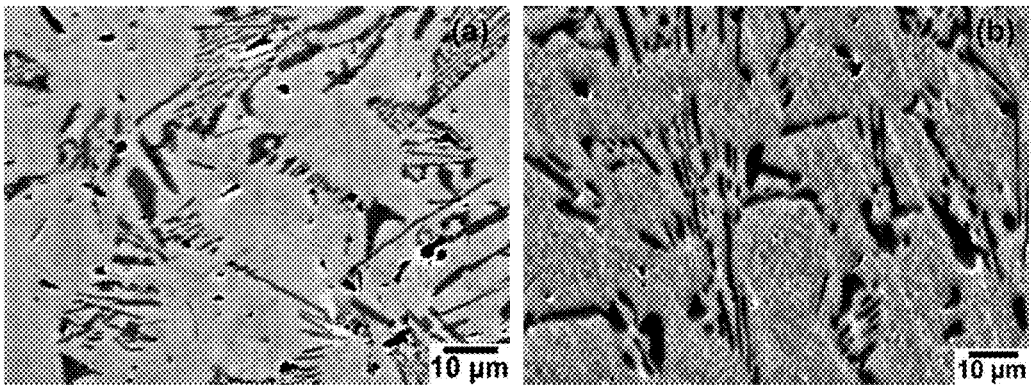
FIG. 11 SEM backscattered electron images of microstructure in the Alloy 1 plates cast at 50 mm thickness (a) before and (b) after heat treatment at 1150°C for 120 min.

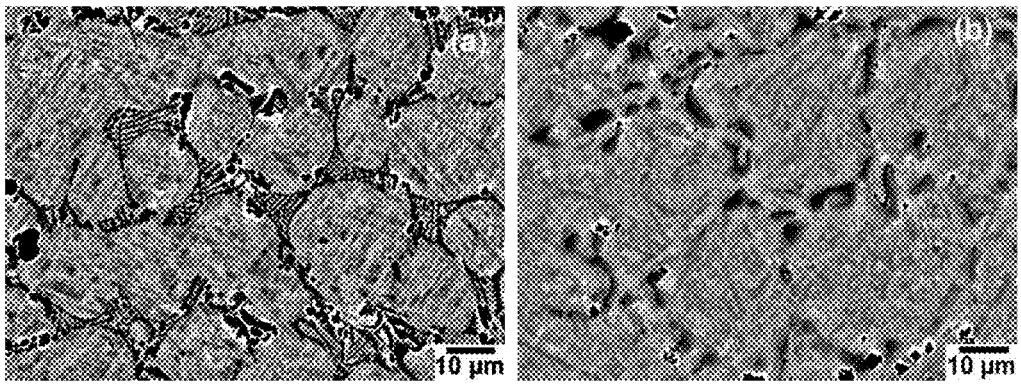
FIG. 12 SEM backscattered electron images of microstructure in the Alloy 8 plates cast at 50 mm thickness (a) before and (b) after heat treatment at 1100°C for 120 min.
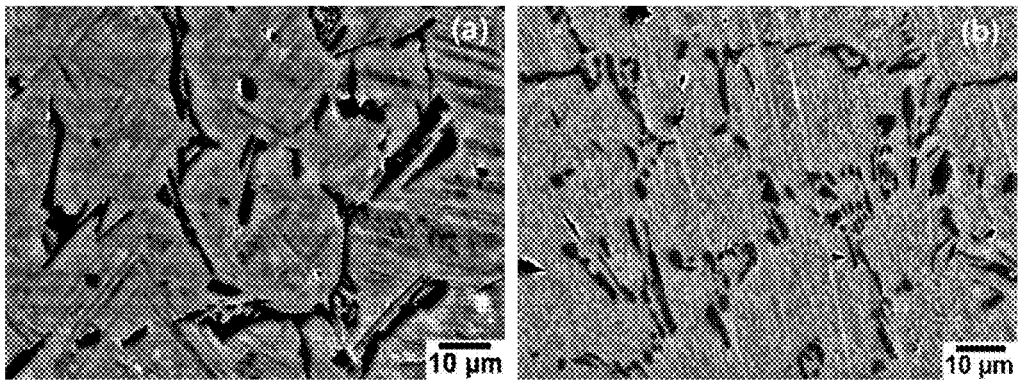
FIG. 13 SEM backscattered electron images of microstructure in the Alloy 16 plates cast at 50 mm thickness (a) before and (b) after heat treatment at 1150°C for 120 min.

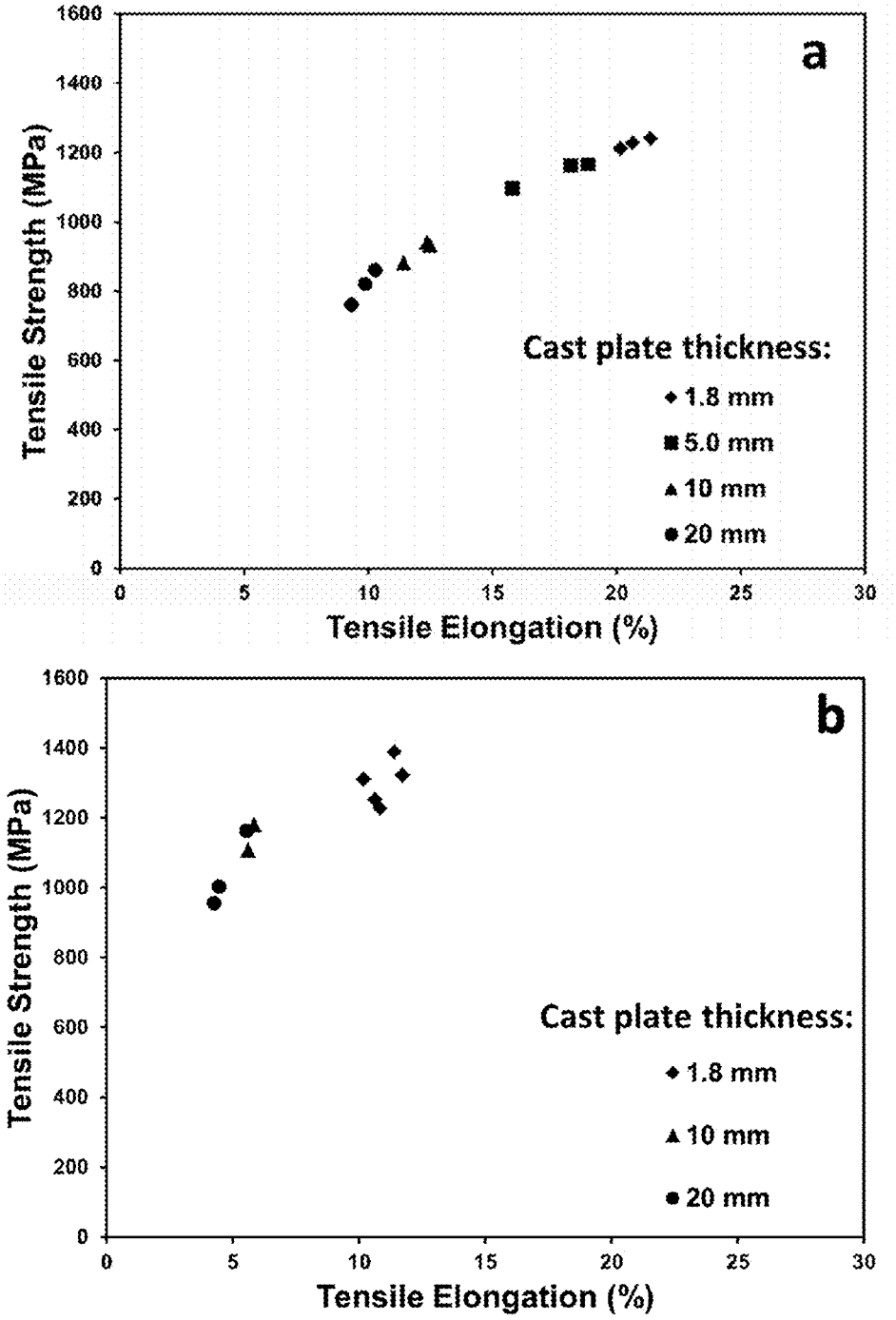
FIG. 14 Tensile properties of (a) Alloy 58 and (b) Alloy 59 in as-HIPed state as a function of cast plate thickness.

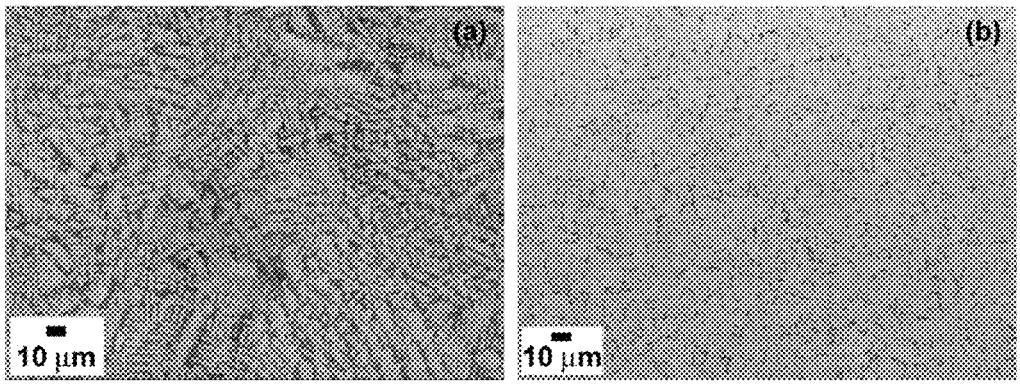

FIG. 15 SEM backscattered electron images of microstructure in the Alloy 59 plate cast at 1.8 mm thickness: (a) as-cast and (b) after HIP.

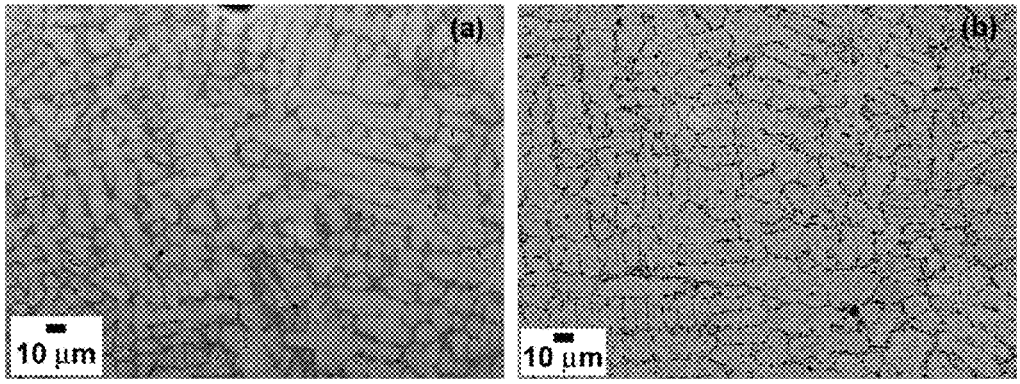

FIG. 16 SEM backscattered electron images of microstructure in the Alloy 59 plate cast at 10 mm thickness (a) as-cast and (b) after HIP.

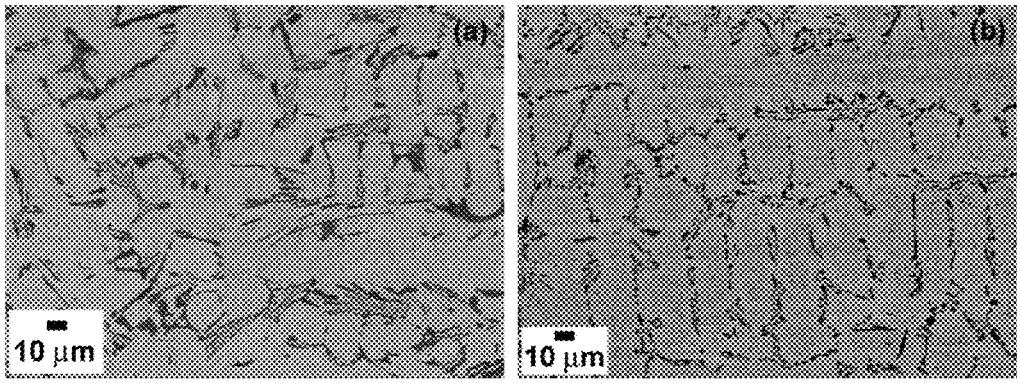

FIG. 17 SEM backscattered electron images of microstructure in the Alloy 59 plate cast at 20 mm thickness (a) as-cast and (b) after HIP.

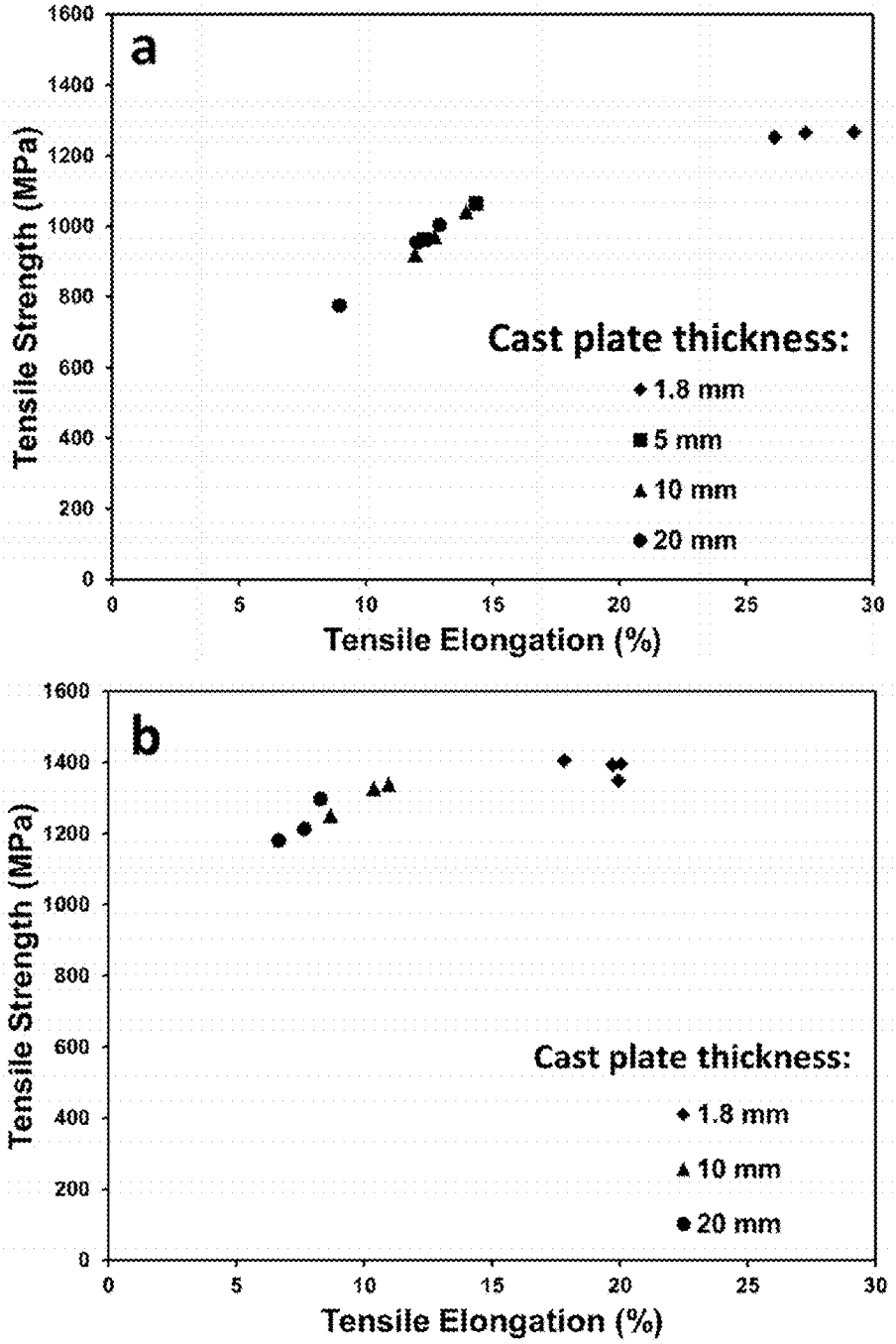
FIG. 18 Tensile properties of (a) Alloy 58 and (b) Alloy 59 after HIP cycle and heat treatment as a function of cast thickness.

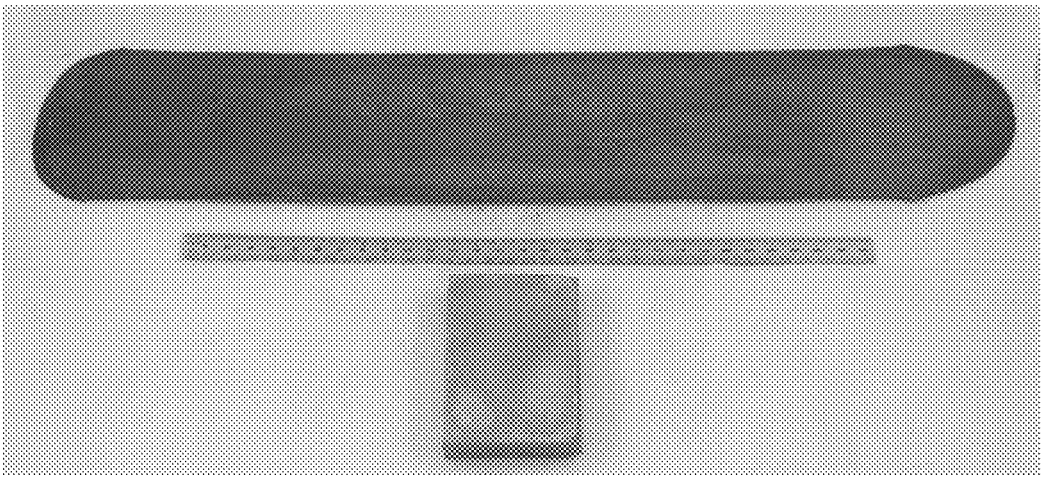
FIG. 19 A view of 20 mm thick plate from Alloy 1 before hot rolling (bottom) and after hot rolling (top).

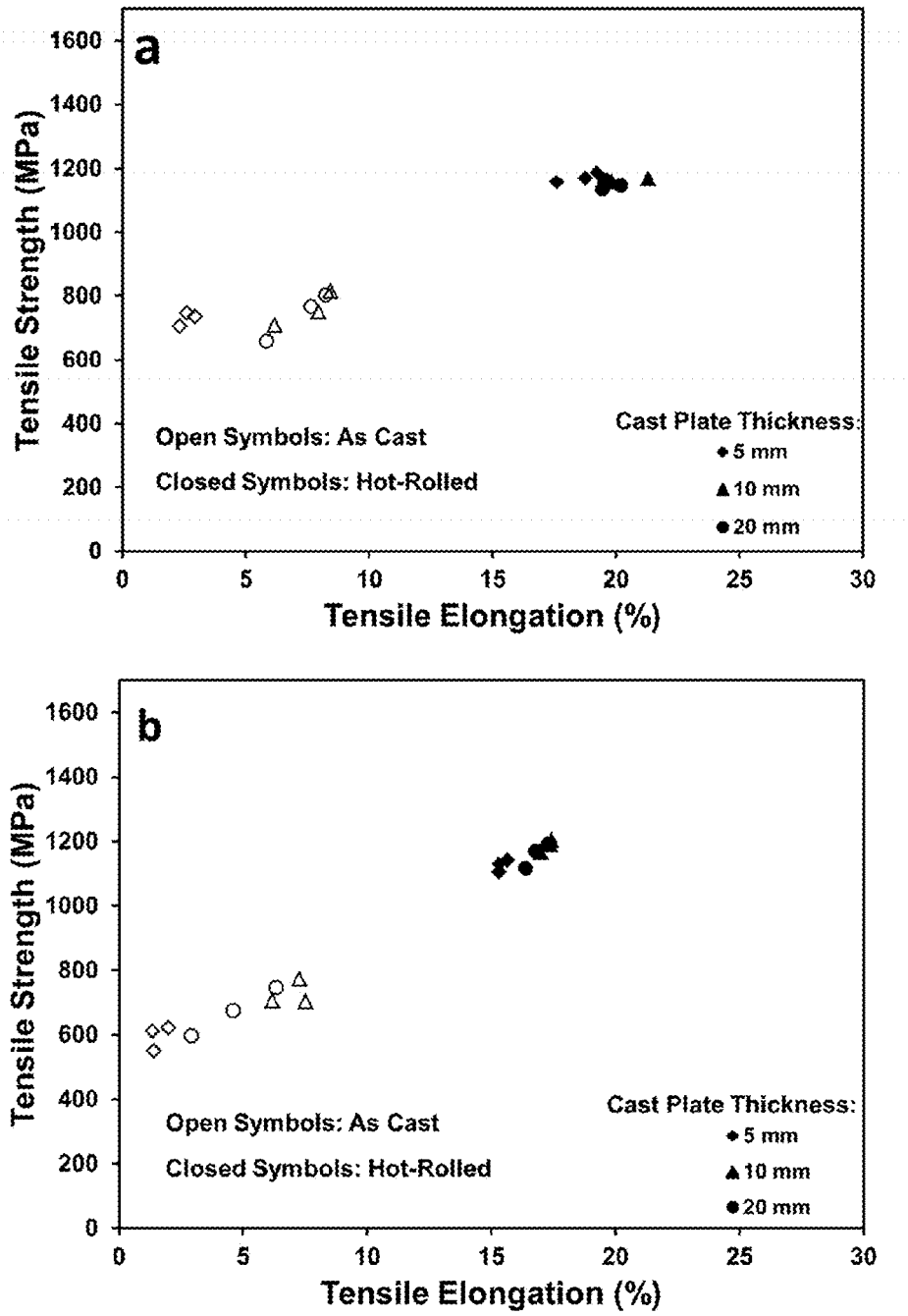
FIG. 20 Tensile properties of (a) Alloy 1 and (b) Alloy 2 before and after hot rolling as a function of cast thickness.

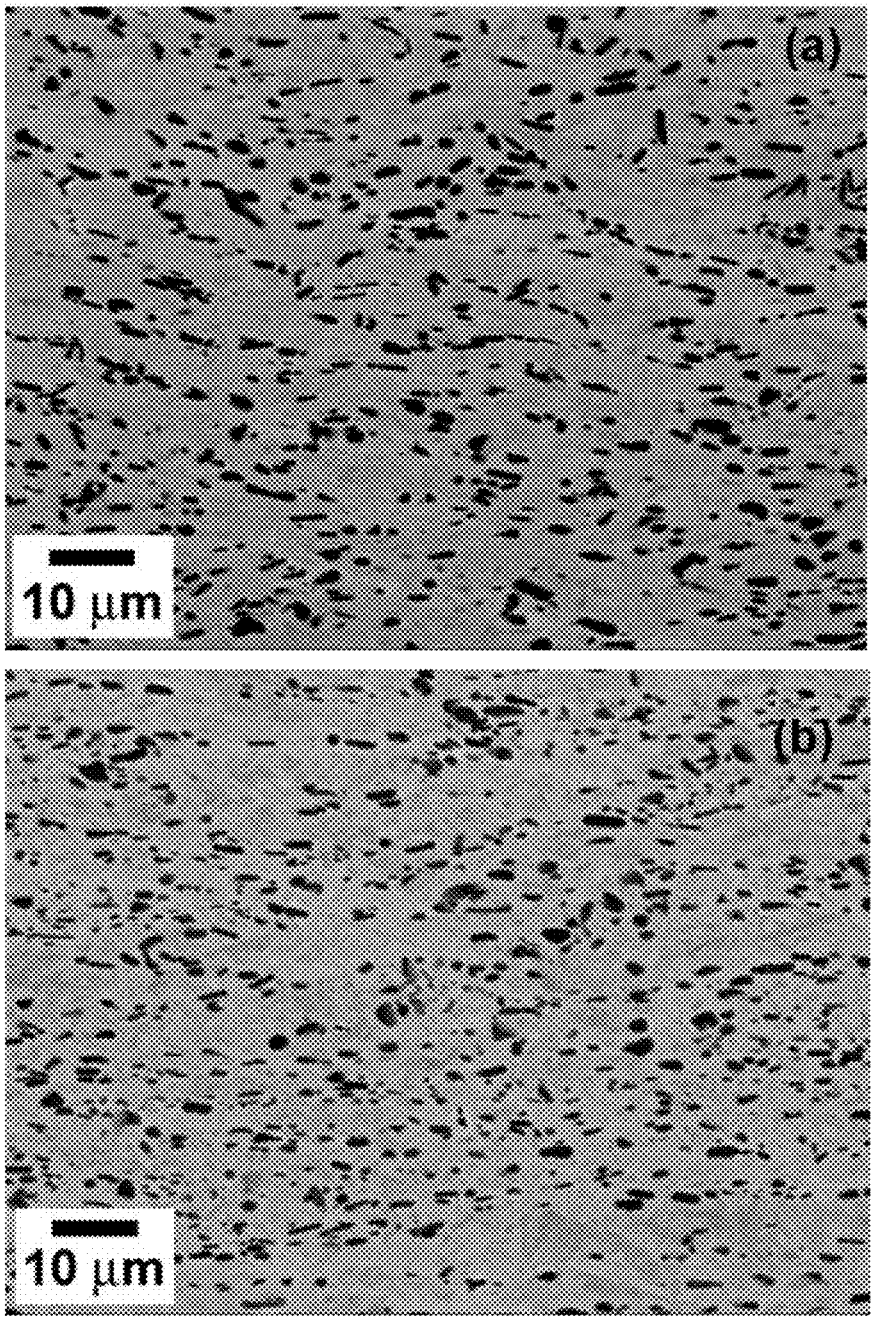
FIG. 21 Backscattered SEM images of microstructure in Alloy 1 plate with as-cast thickness of 5 mm after hot rolling with 75.7% reduction in (a) outer layer region and (b) central layer region.

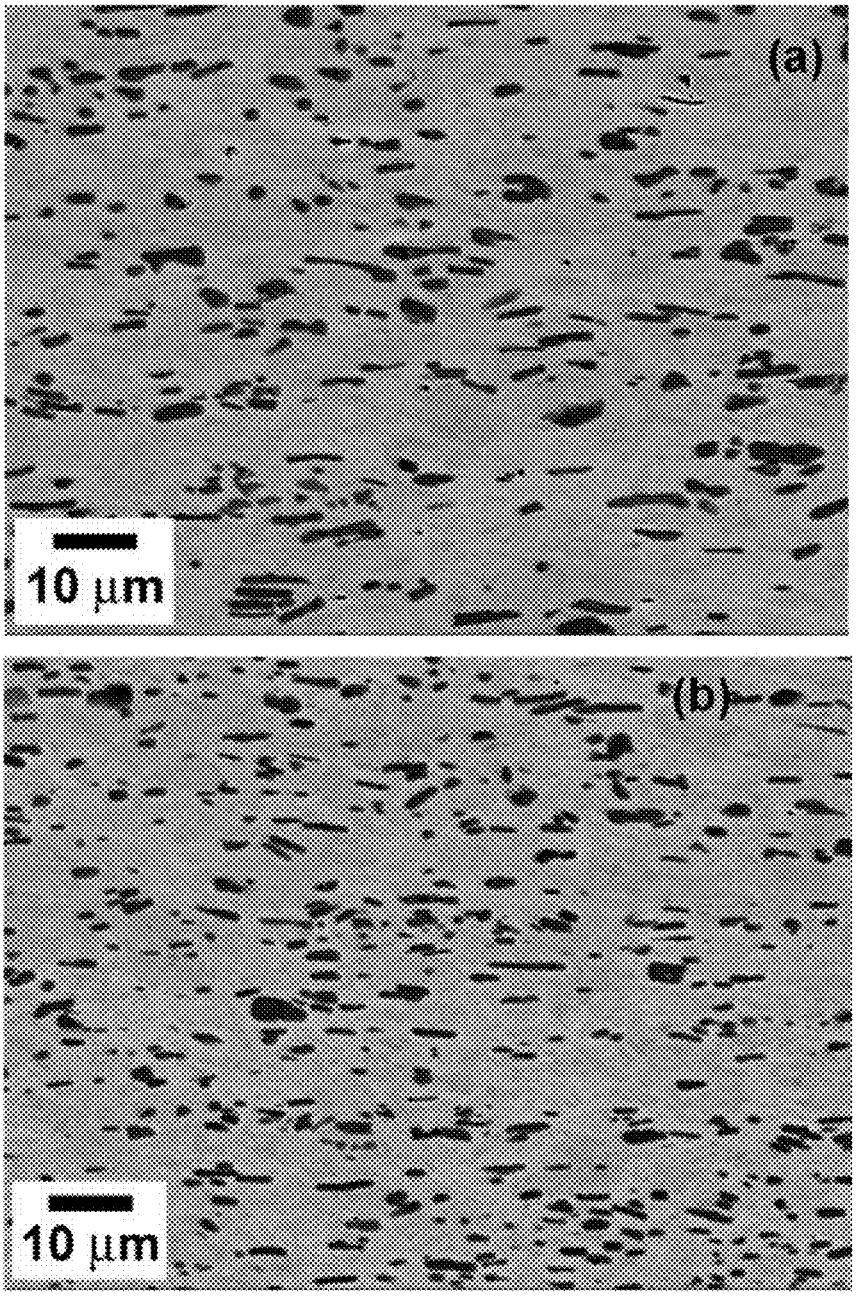
FIG. 22 Backscattered SEM images of microstructure in Alloy 1 plate with as-cast thickness of 10 mm after hot rolling with 88.5% reduction in (a) outer layer region and (b) central layer region.

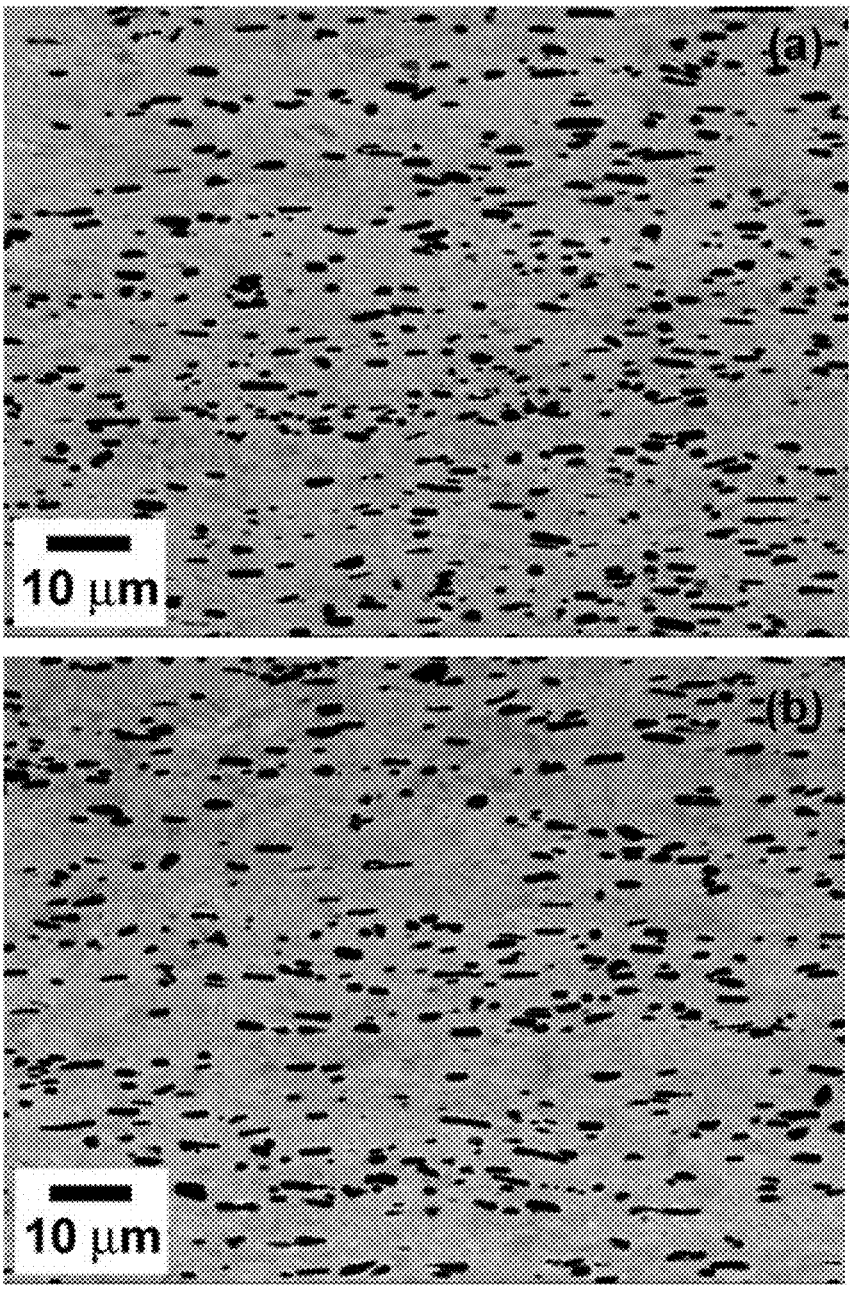
FIG. 23 Backscattered SEM images of microstructure in Alloy 1 plate with as-cast thickness of 20 mm after hot rolling with 83.3% reduction in (a) outer layer region and (b) central layer region.

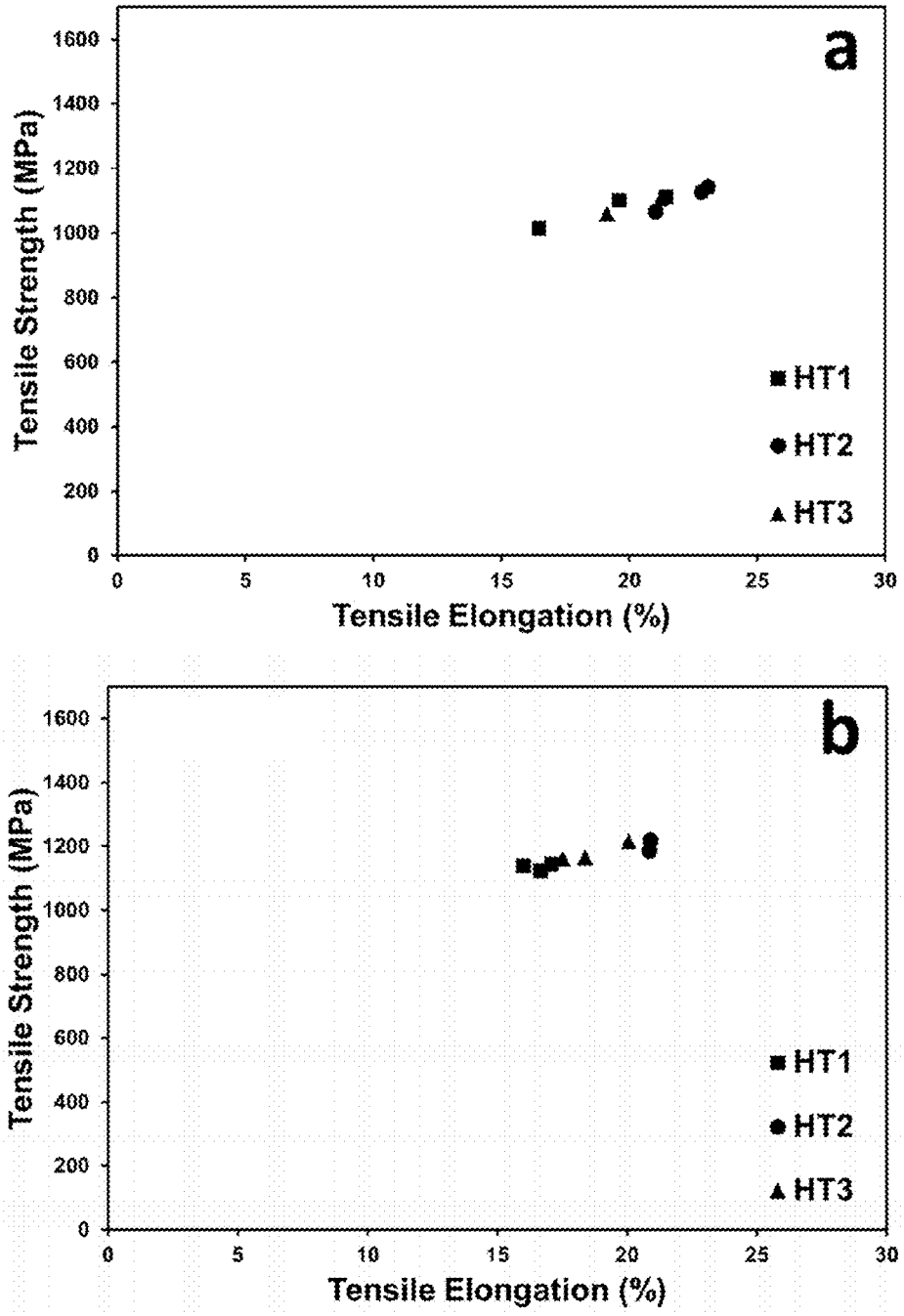
FIG. 24 Tensile properties of the sheet from (a) Alloy 1 and (b) Alloy 2 after hot rolling and heat treatment with different parameters.

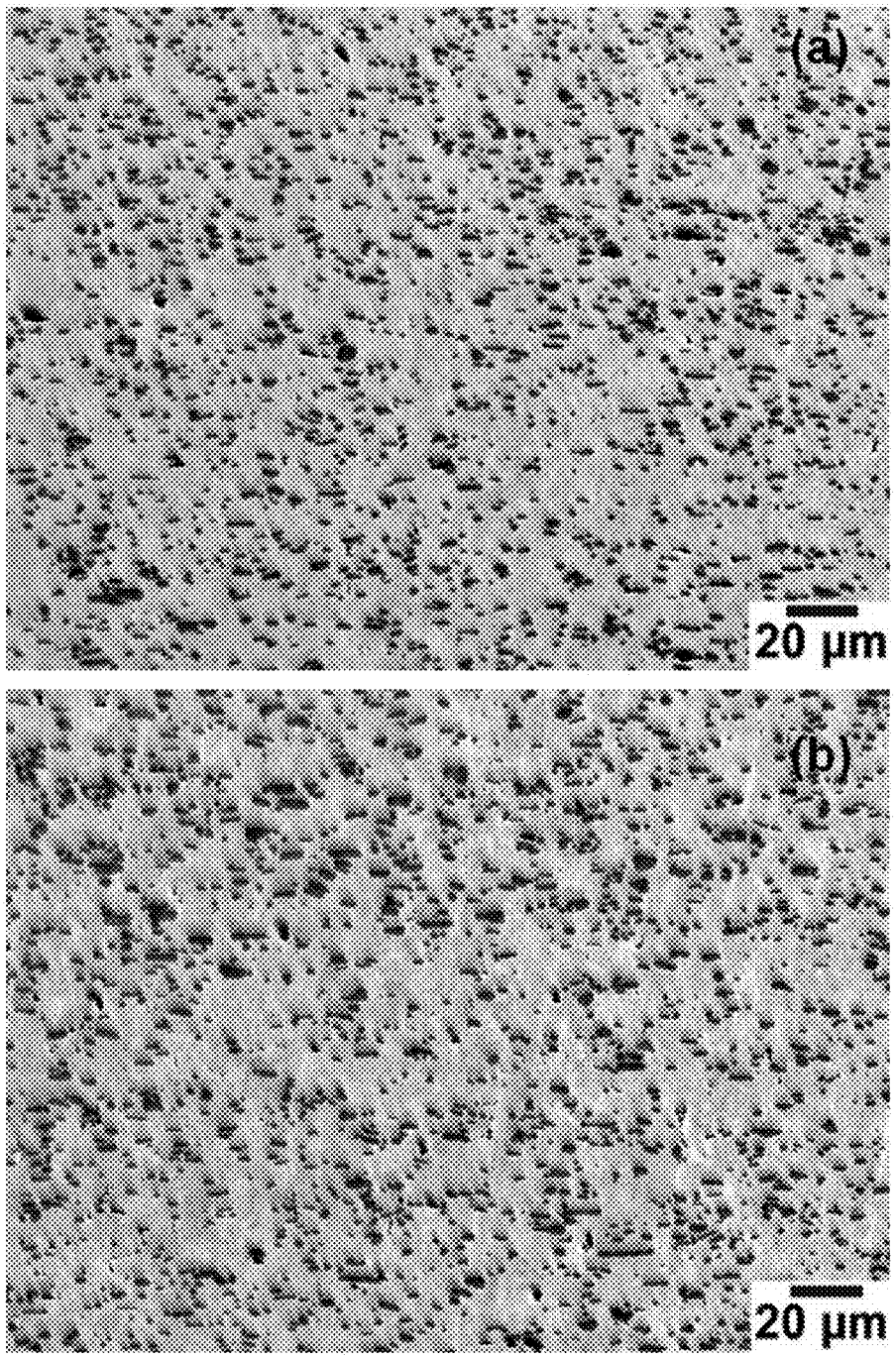
FIG. 25 Backscattered SEM images of microstructure in Alloy 1 plate with as-cast thickness of 50 mm after hot rolling with 96% reduction in (a) outer layer region and (b) central layer region.

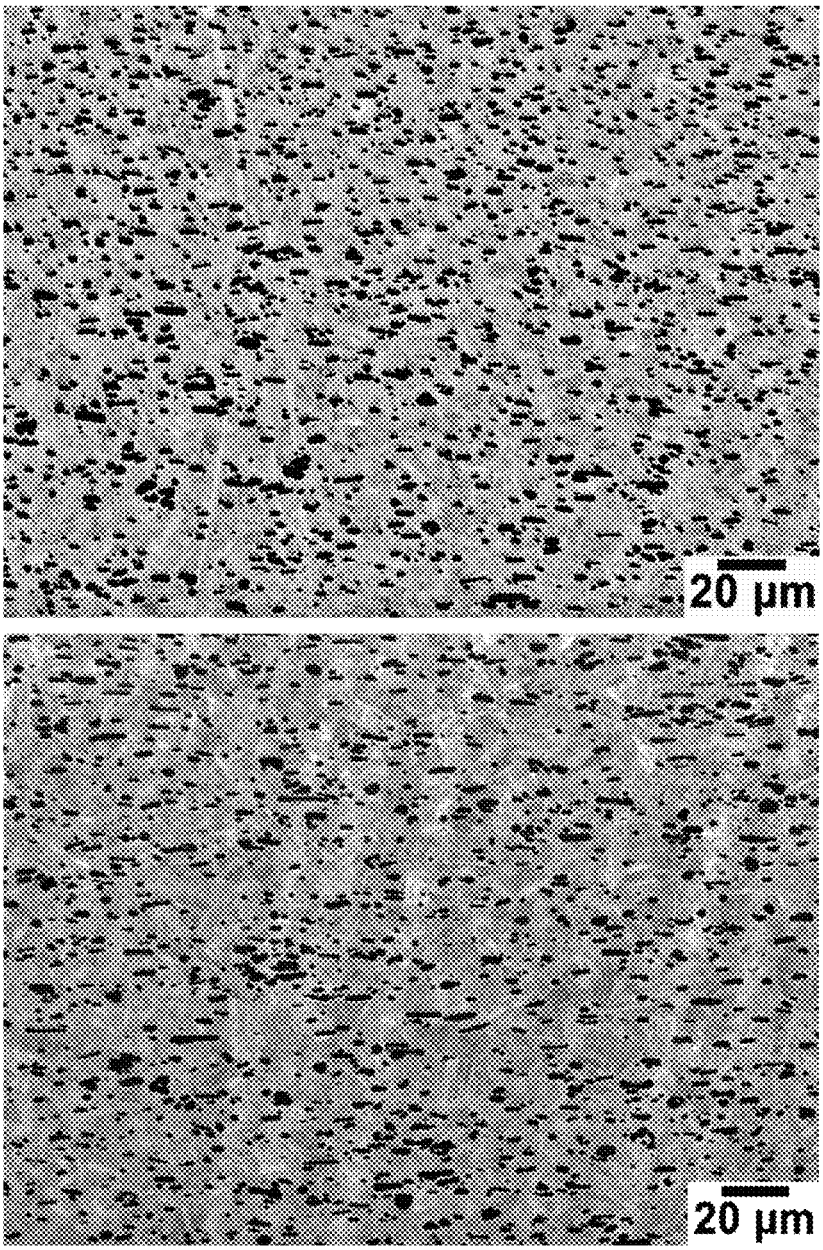
FIG. 26 Backscattered SEM images of microstructure in Alloy 2 plate with as-cast thickness of 50 mm after hot rolling with 96% reduction in (a) outer layer region and (b) central layer region.

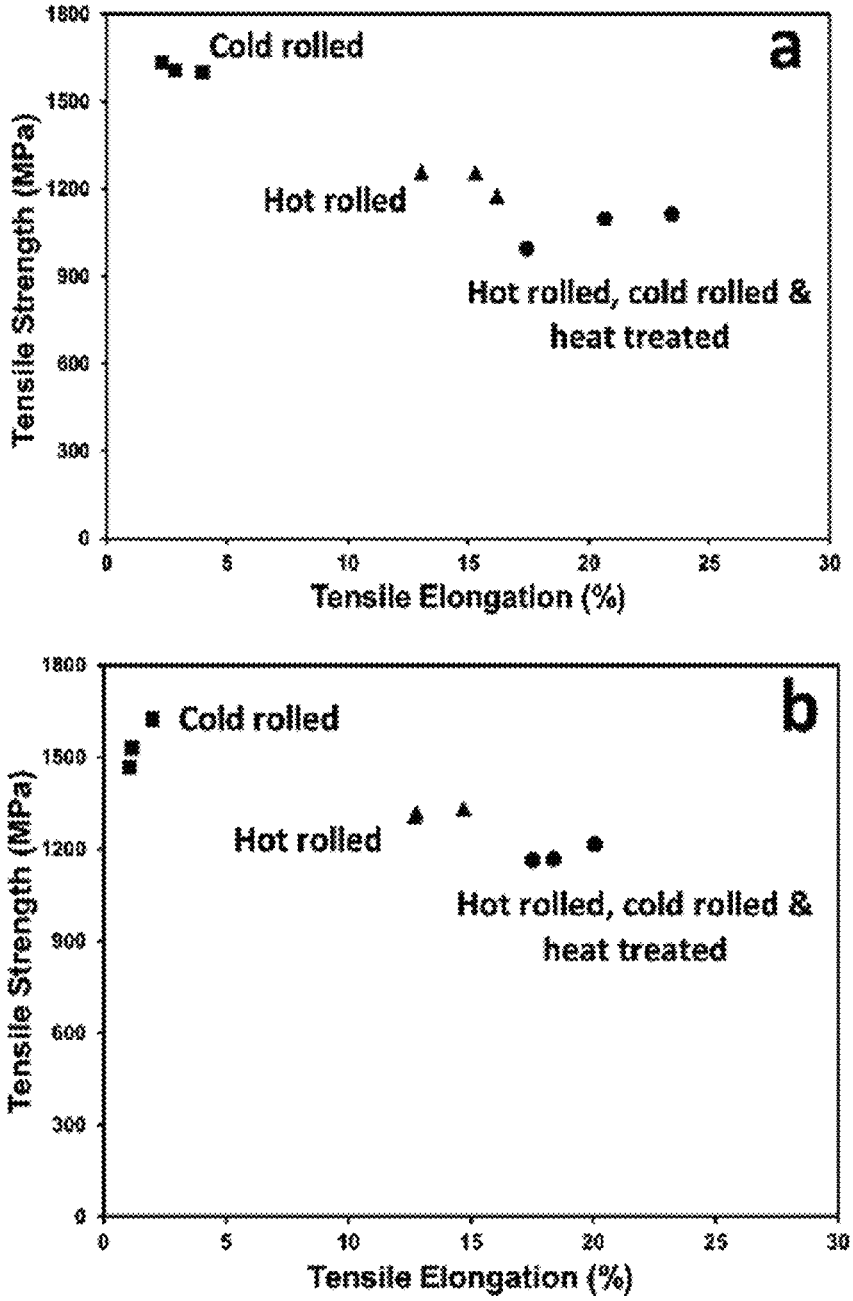
FIG. 27 Tensile properties of (a) Alloy 1 and (b) Alloy 2 after hot rolling, cold rolling, and heat treatment.

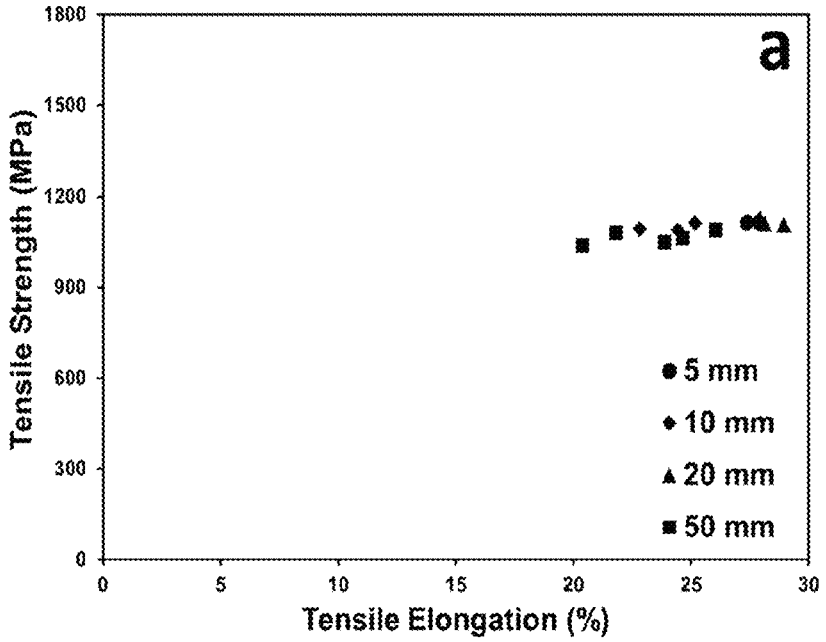
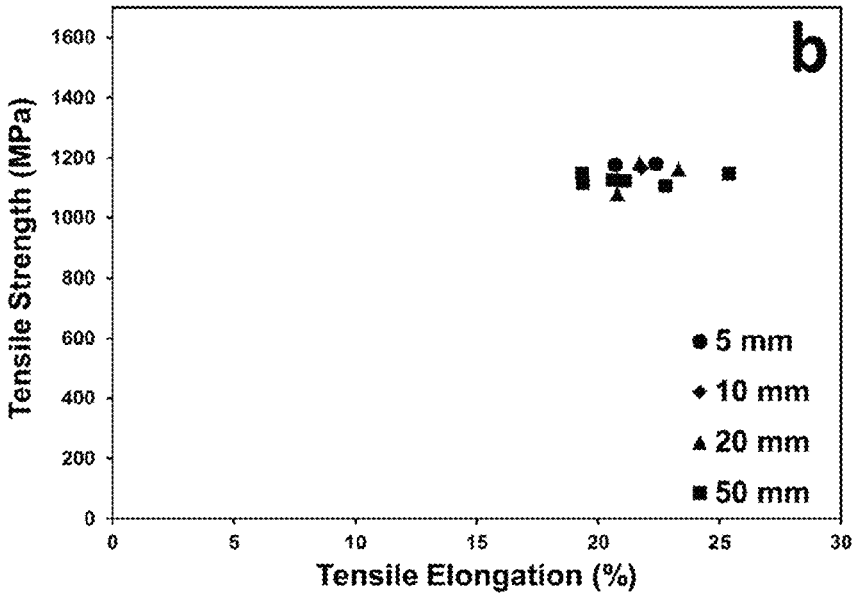
FIG. 28 Tensile properties of post-processed sheet from (a) Alloy 1 and (b) Alloy 2 initially cast at different thicknesses.

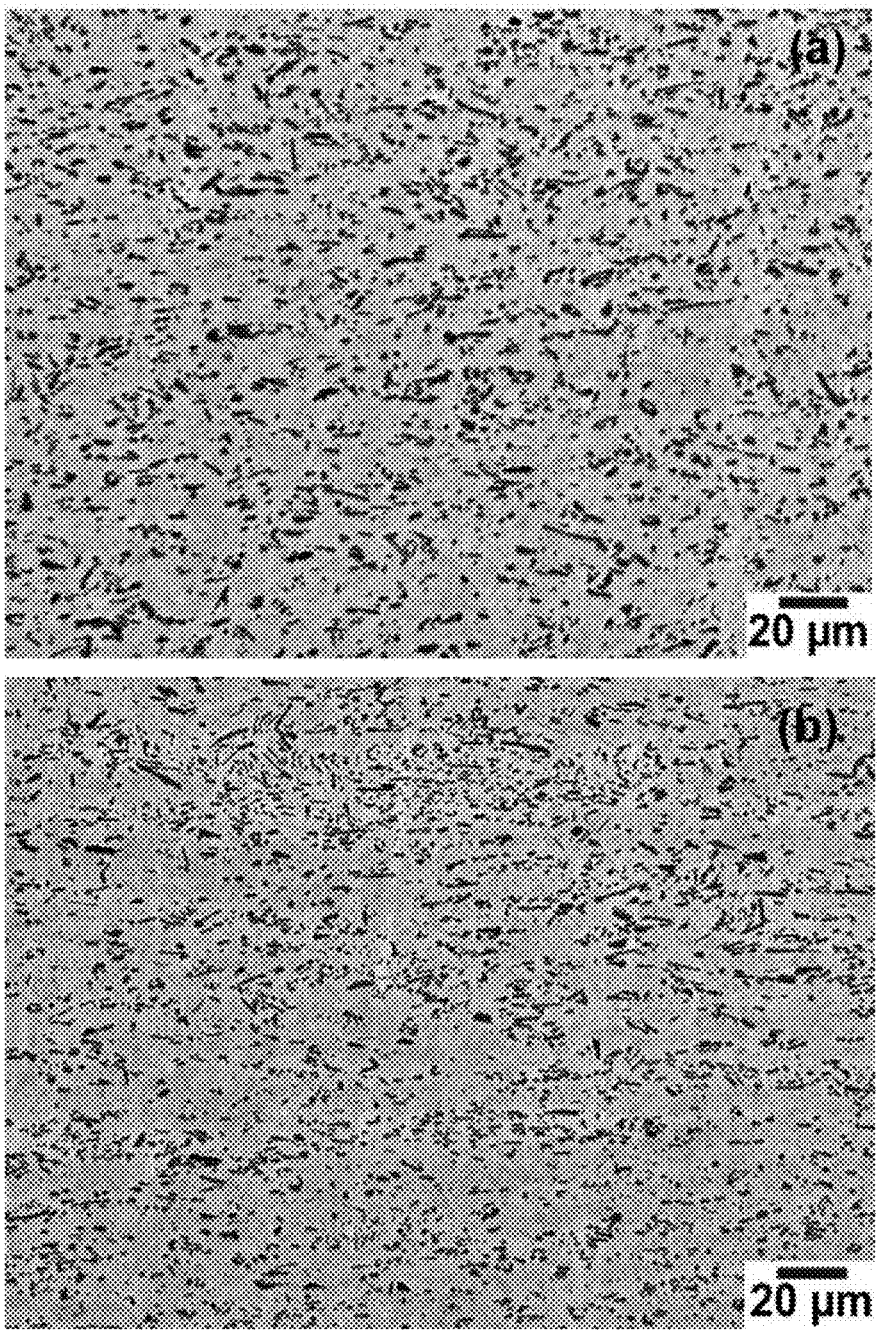
FIG. 29 Backscattered SEM images of Alloy 2 with as-cast thickness of 20 mm after hot rolling with 88% reduction: (a) outer layer region; (b) central layer region.

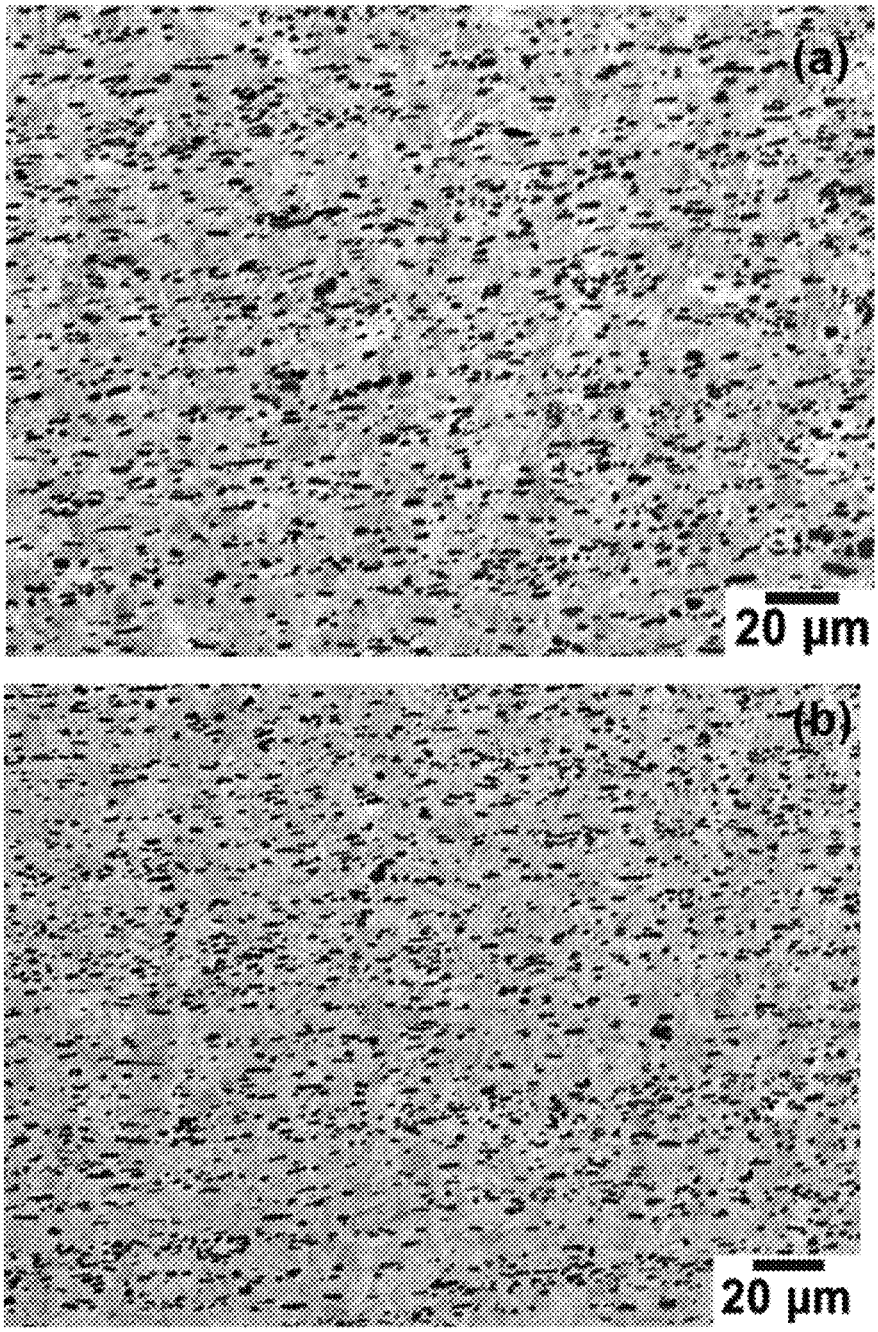
FIG. 30 Backscattered SEM images of Alloy 2 20 mm thick sample hot rolled and heat treated at 950°C for 6 hr: (a) outer layer region; (b) central layer region.

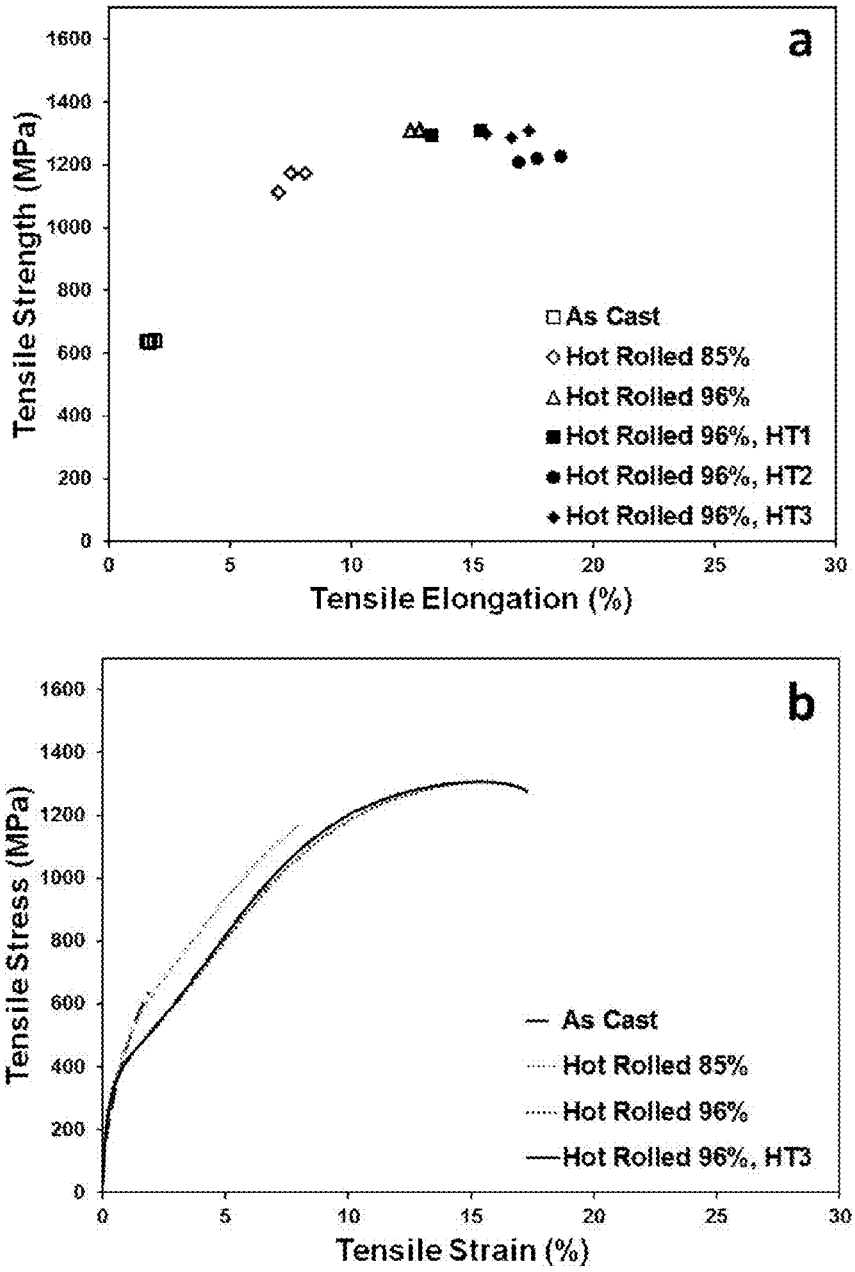
FIG. 31 (a) Tensile properties of Alloy 8 sheet produced from 50 mm thick plate by hot rolling that was heat treated at different conditions; (b) Representative stress-strain curves.

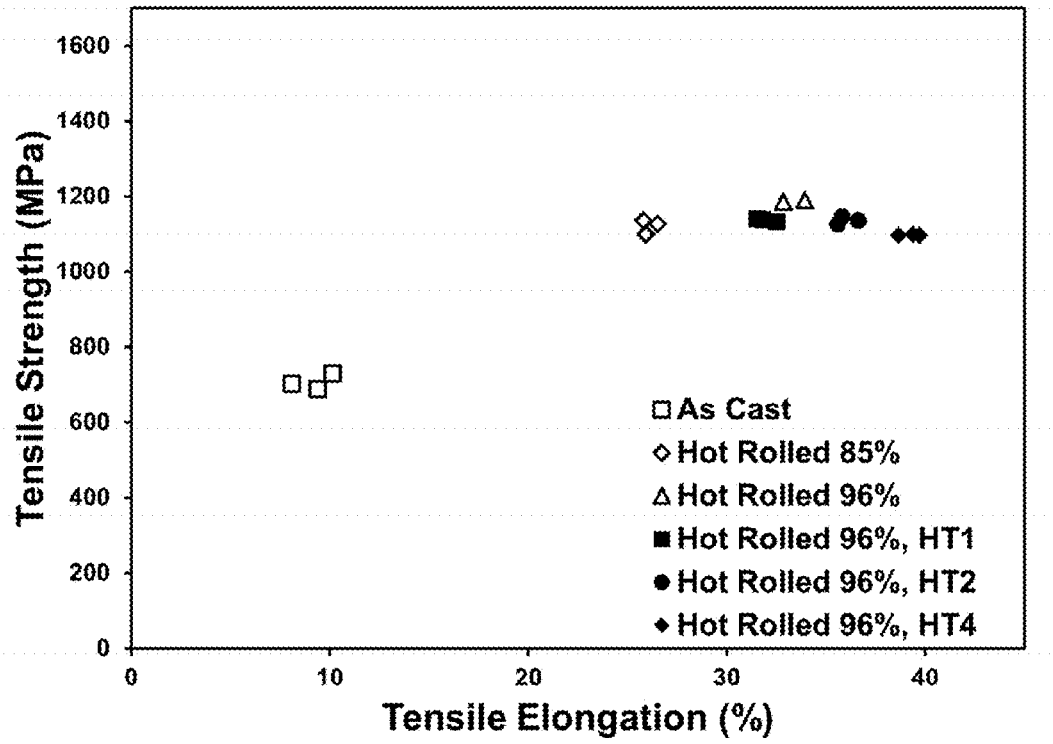
FIG. 32 Tensile properties of Alloy 16 sheet produced from 50 mm thick plate by hot rolling that was heat treated at different conditions.

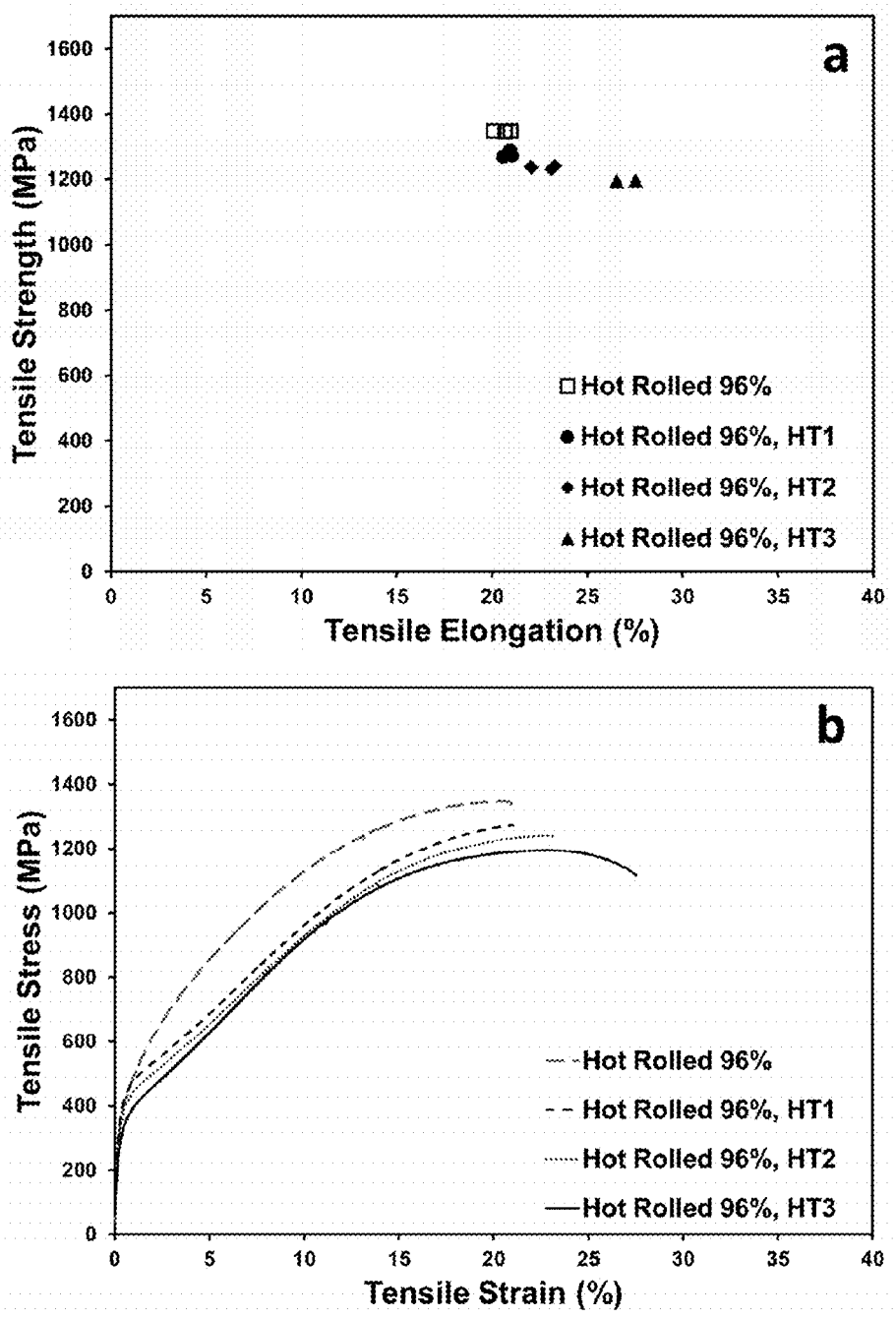
FIG. 33 (a) Tensile properties of Alloy 24 sheet produced from 50 mm thick plate by hot rolling that was heat treated at different conditions; (b) Representative stress-strain curves.

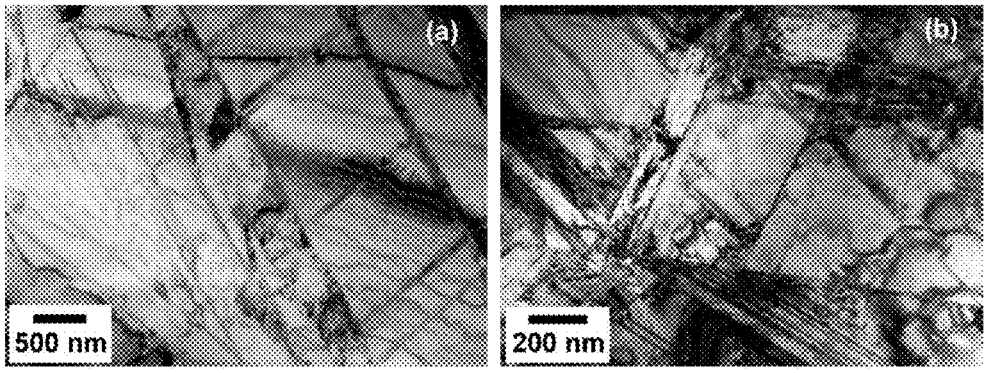
FIG. 34 Bright-field TEM micrographs of microstructure in the Alloy 1 plate after hot rolling and heat treatment initially cast 50 mm thickness.
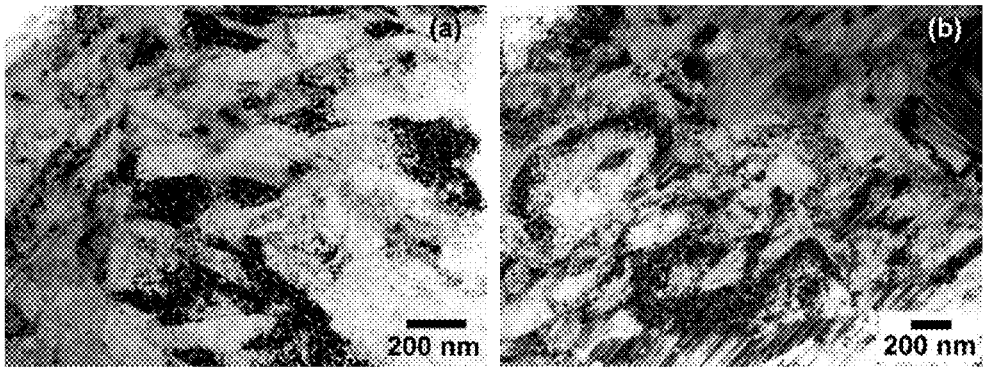
FIG. 35 Bright-field TEM micrographs of microstructure in the hot rolling and heat treated Alloy 1 plate after tensile deformation.

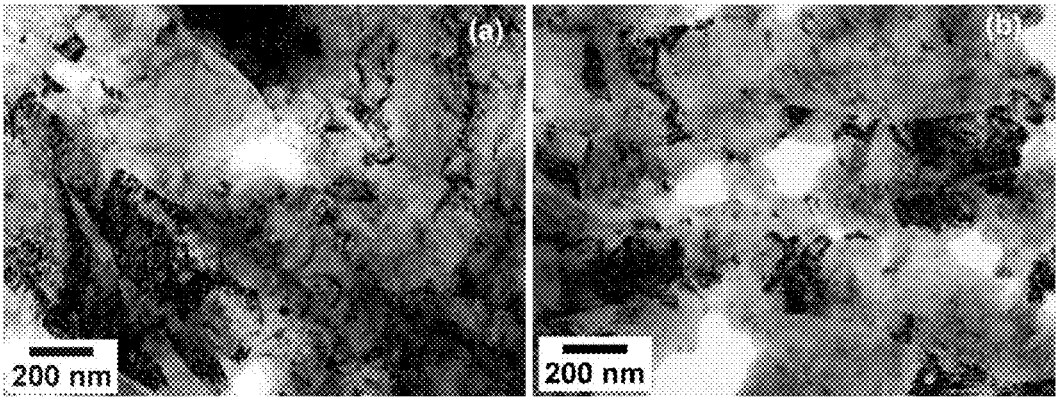
FIG. 36 Bright-field TEM micrographs of microstructure in the 50 mm thick Alloy 8 plate after hot rolling and heat treatment: (a) before and (b) after tensile deformation.
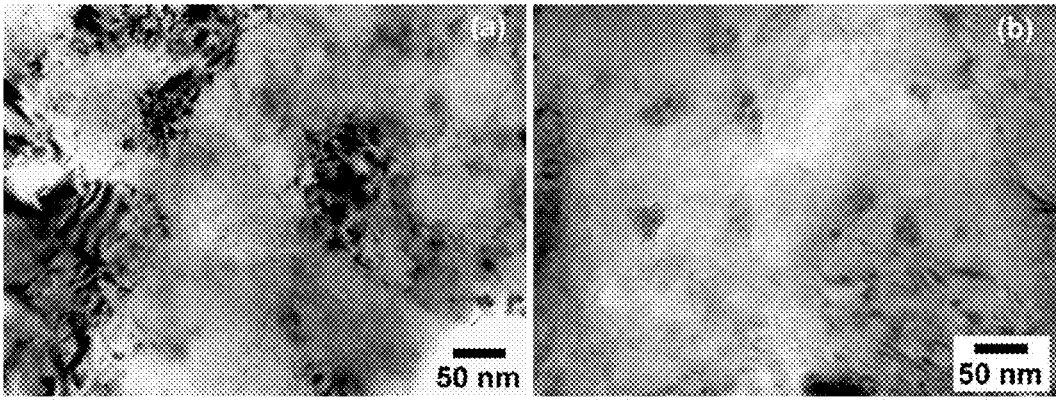
FIG. 37 Bright-field TEM micrographs at higher magnification of microstructure in the 50 mm thick Alloy 8 plate after hot rolling and heat treatment: (a) before and (b) after tensile deformation.

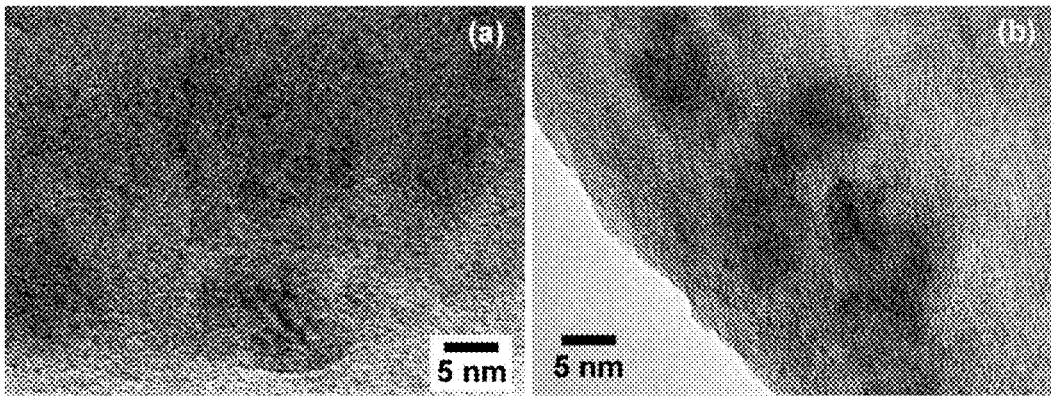
FIG. 38 High resolution TEM micrographs of microstructure in the 50 mm thick Alloy 8 plate after hot rolling and heat treatment: (a) before and (b) after tensile deformation.
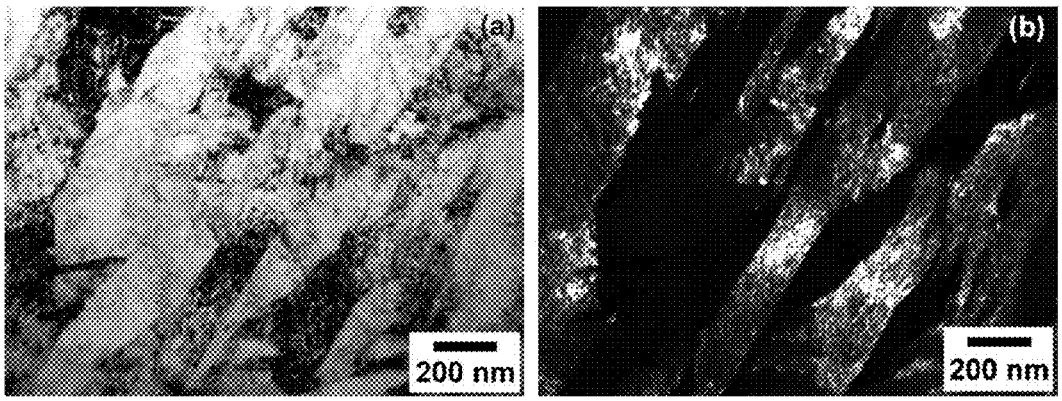
FIG. 39 TEM micrographs of microstructure in the 50 mm thick Alloy 16 plate after hot rolling and heat treatment: (a) bright field image, (b) dark field image.

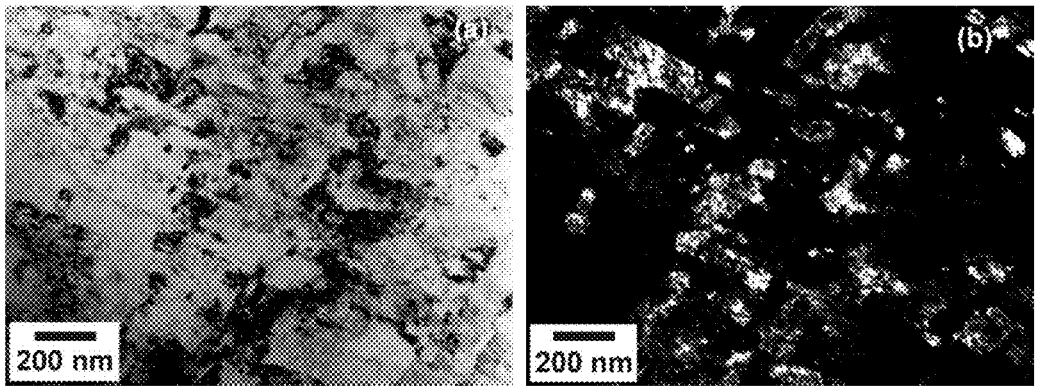
FIG. 40 TEM micrographs of microstructure in the hot rolled and heat treated Alloy 16 plate after tensile deformation: (a) bright field image, (b) dark field image.
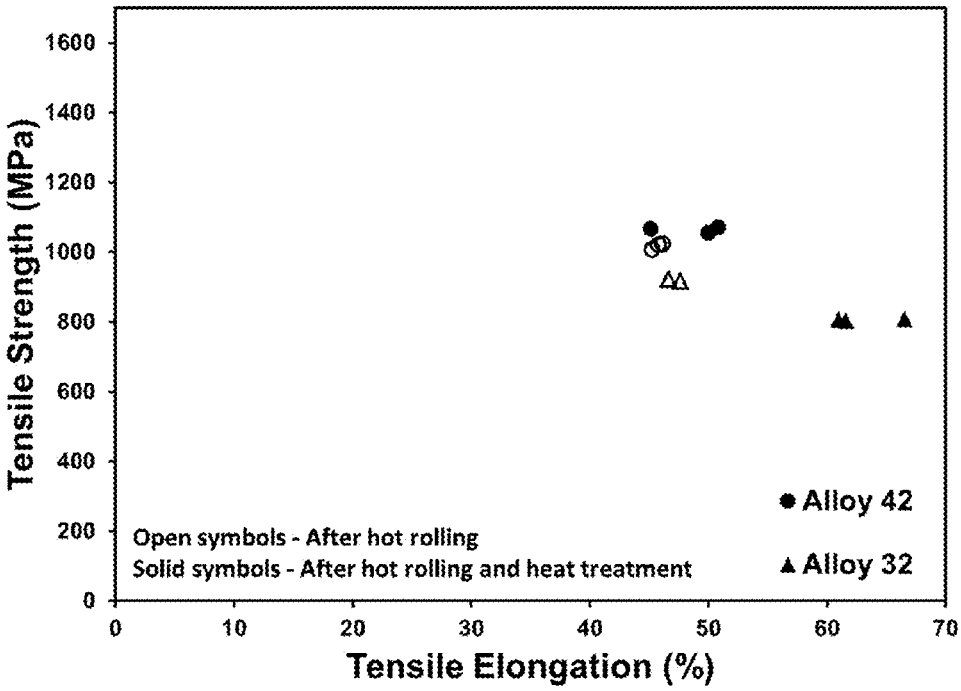
FIG. 41 Tensile properties of post-processed sheet from Alloy 32 and Alloy 42 initially cast into 50 mm thick plates.

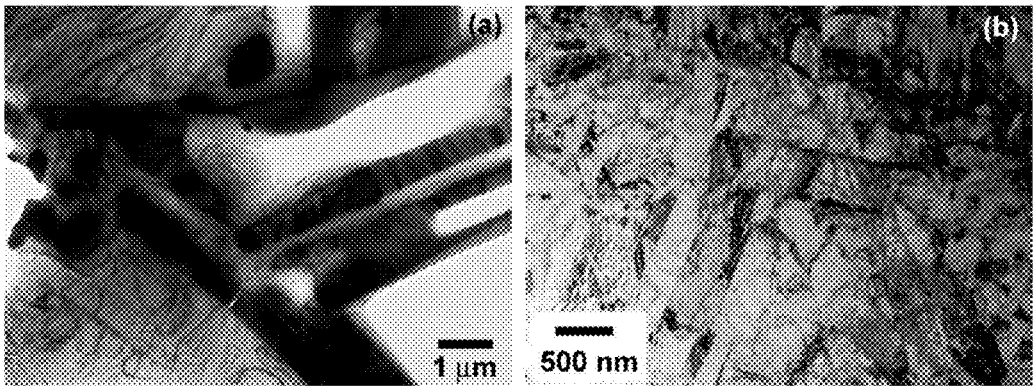
FIG. 42 Bright-field TEM micrographs of microstructure in the 50 mm thick as-cast plate from Alloy 24.
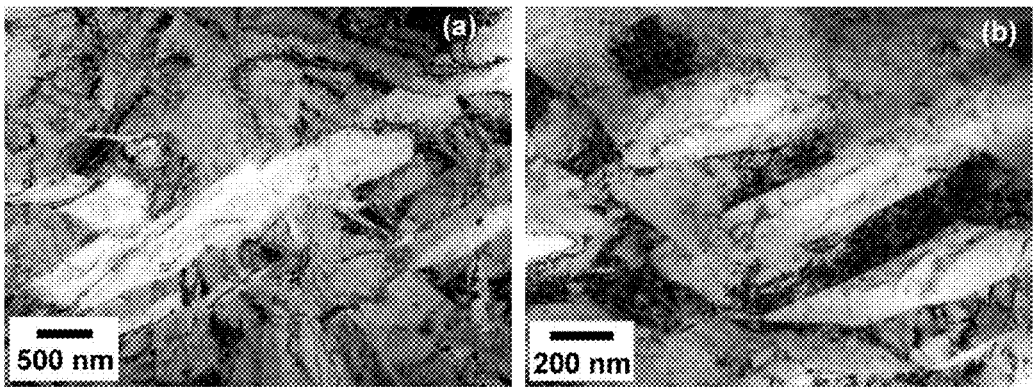
FIG. 43 Bright-field TEM micrographs of microstructure in the Alloy 24 plate after hot rolling from 50 to 2 mm thickness.

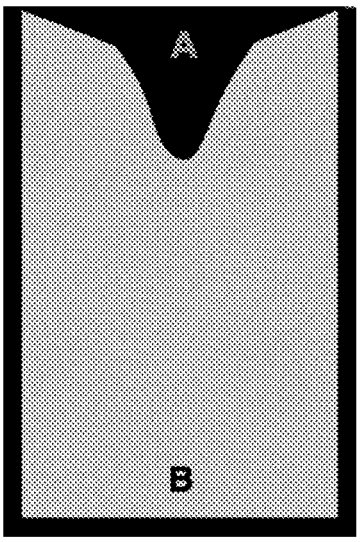
FIG. 44 Schematic of the cross section through the center of the cast plate showing the shrinkage funnel and the locations from which samples for chemical analysis were taken.
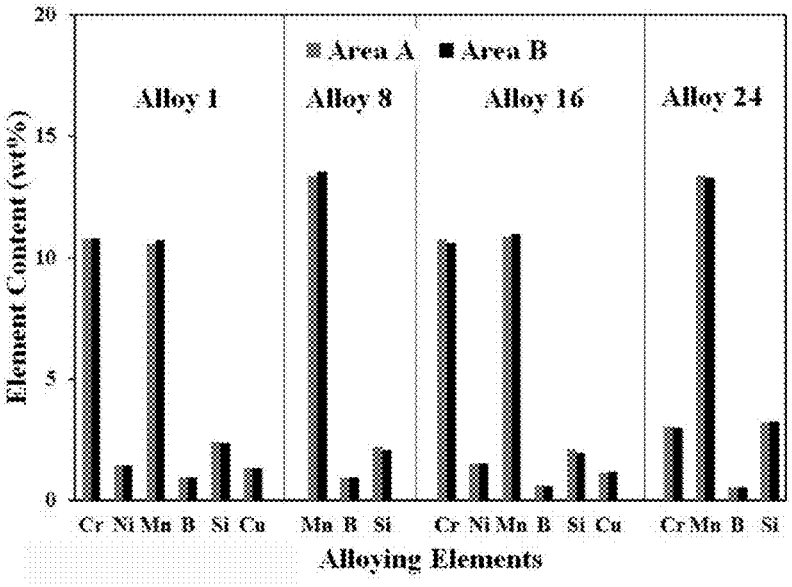
FIG. 45 Alloying element content in tested locations at the top (Area A) and bottom (Area B) of the cast plate for the four alloys identified.

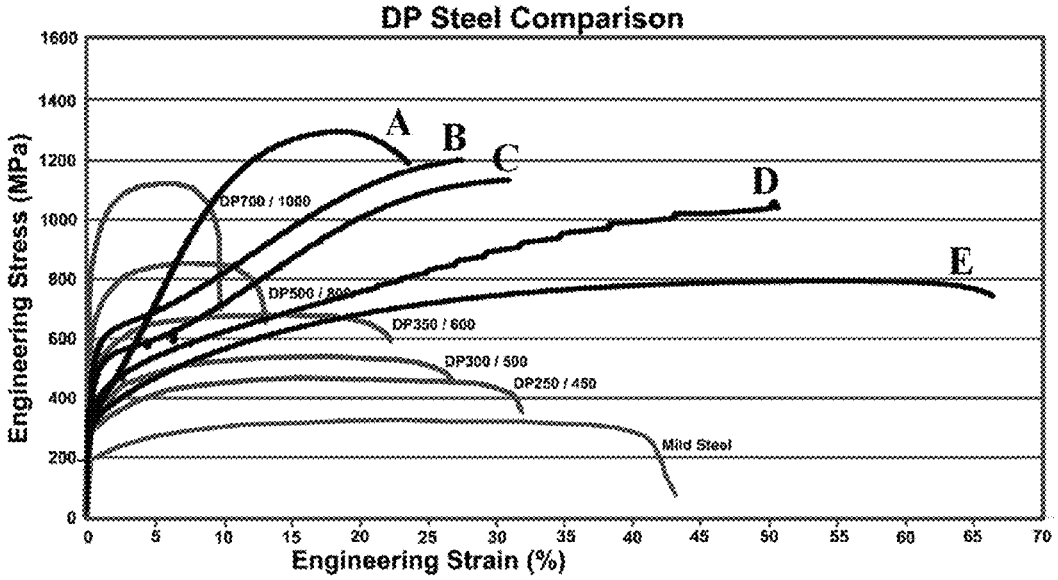
FIG. 46 Comparison of stress-strain curves of new steel sheet types with existing Dual Phase (DP) steels.
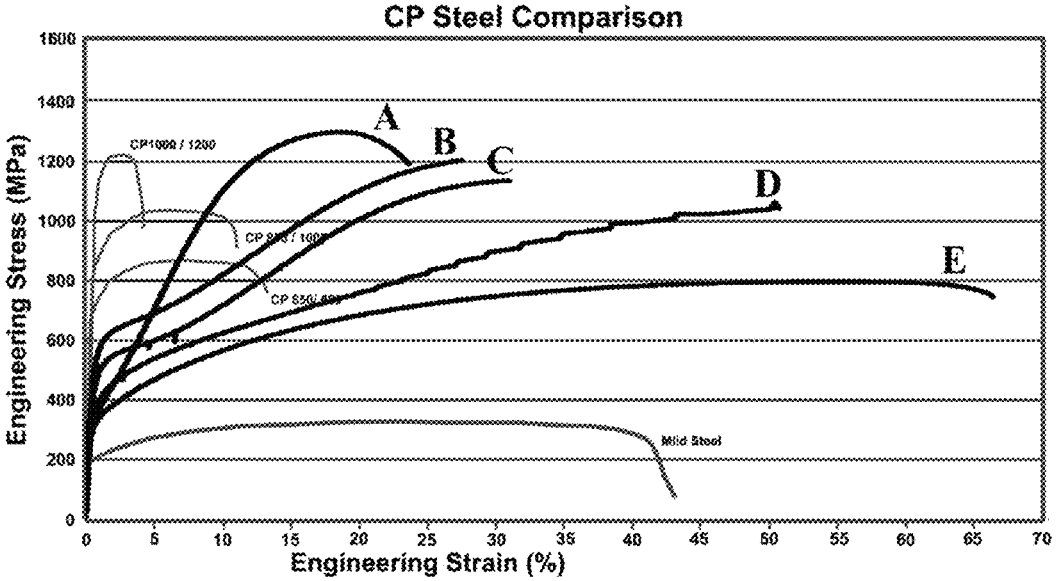
FIG. 47 Comparison of stress-strain curves of new steel sheet types with existing Complex Phase (CP) steels.

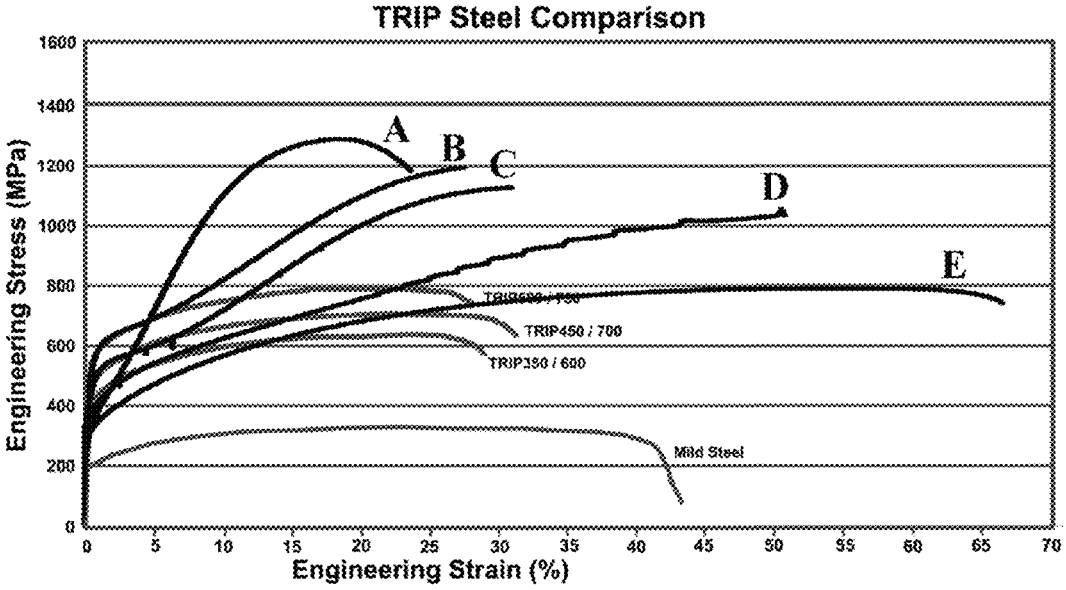
FIG. 48 Comparison of stress-strain curves of new steel sheet types with existing Transformation Induced Plasticity (TRIP) steels.
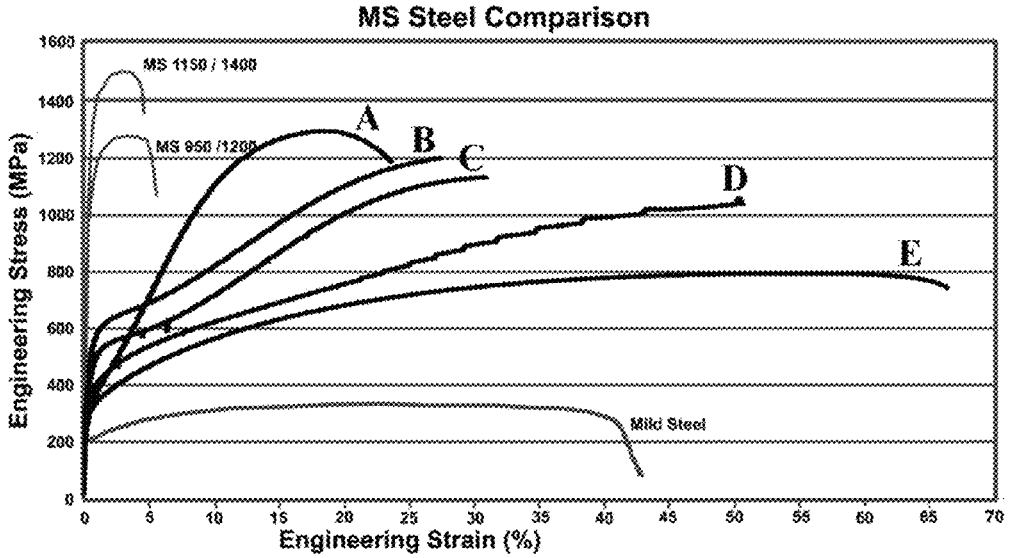
FIG. 49 Comparison of stress-strain curves of new steel sheet types with existing Martensitic (MS) steels.

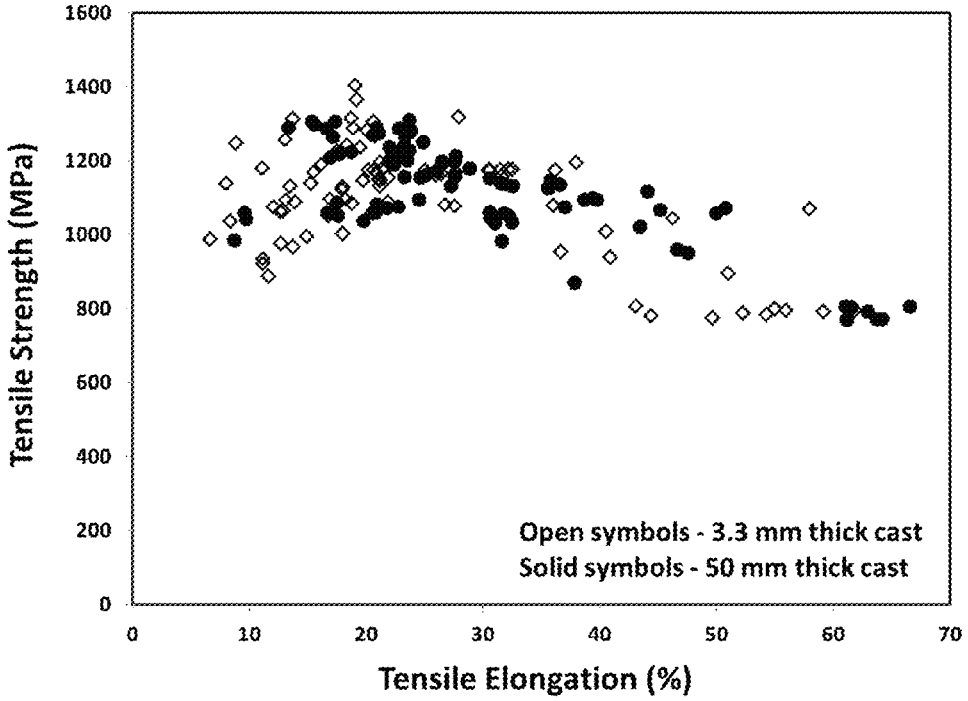
FIG. 51 Tensile properties of selected alloys cast at 50 mm thickness as compared to that for the same alloys cast at 3.3 mm thickness.

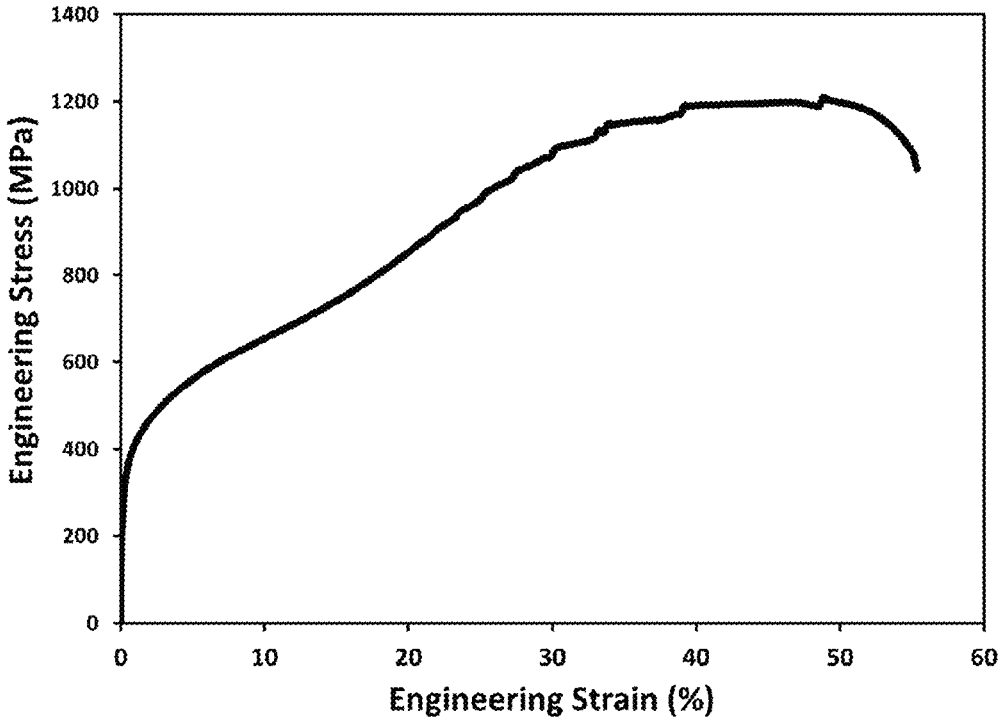
FIG. 52 An example stress strain curve of boron-free Alloy 63 in hot rolled state.

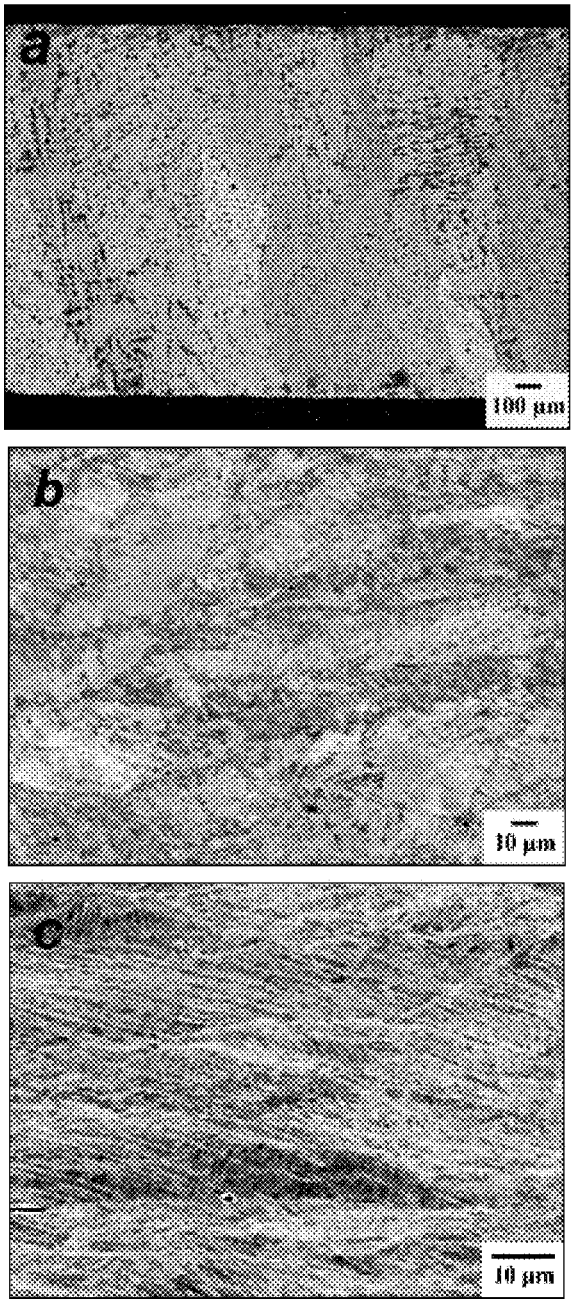
FIG. 53 Backscattered electron images of microstructure in the Alloy 65 cast at 50 mm thickness: (a) as-cast; (b) after hot rolling at 1250°C; (c) after cold rolling to 1.2 mm thickness.

METAL STEEL PRODUCTION BY SLAB CASTING

CROSS REFERENCE TO RELATED APPLICATIONS

This application is a continuation of U.S. application Ser. No. 14/525,859, filed Oct. 28, 2014, which claims the benefit of U.S. Provisional Application Ser. No. 61/896,594 filed Oct. 28, 2013.

FIELD OF INVENTION

This application deals with metal alloys and methods of processing with application to slab casting methods with post processing steps towards sheet production. These metals provide unique structures and exhibit advanced property combinations of high strength and/or high ductility.

BACKGROUND

Steels have been used by mankind for at least 3,000 years and are widely utilized in industry comprising over 80% by weight of all metallic alloys in industrial use. Existing steel technology is based on manipulating the eutectoid transformation. The first step is to heat up the alloy into the single phase region (austenite) and then cool or quench the steel at various cooling rates to form multiphase structures which are often combinations of ferrite, austenite, and cementite. Depending on how the steel is cooled, a wide variety of characteristic microstructures (i.e. pearlite, bainite, and martensite) can be obtained with a wide range of properties. This manipulation of the eutectoid transformation has resulted in the wide variety of steels available nowadays.

Currently, there are over 25,000 worldwide equivalents in 51 different ferrous alloy metal groups. For steel, which is produced in sheet form, broad classifications may be employed based on tensile strength characteristics. Low Strength Steels (LSS) may be understood herein as exhibiting tensile strengths less than 270 MPa and include types such as interstitial free and mild steels. High-Strength Steels (HSS) may be understood herein as exhibiting tensile strengths from 270 to 700 MPa and include types such as high strength low alloy, high strength interstitial free and bake hardenable steels. Advanced High-Strength Steels (AHSS) steels may be understood herein as having tensile strengths greater than 700 MPa and include types such as martensitic steels (MS), dual phase (DP) steels, transformation induced plasticity (TRIP) steels, and complex phase (CP) steels. As the strength level increases, the ductility of the steel generally decreases. For example, LSS, HSS and AHSS may indicate tensile elongations at levels of 25% to 55%, 10% to 45% and 4% to 30%, respectively.

Steel material production in the United States is currently about 100 million tons per year worth about $75 billion. According to the American Iron and Steel Institute, 24% of the US steel production is utilized in the auto industry. Total steel in the average 2010 vehicle was about 60%. New advanced high-strength steels (AHSS) account for 17% of the vehicle and this is expected to grow up to 300% by the year 2020. [American Iron and Steel Institute. (2013). Profile 2013. Washington, D.C.]

Continuous casting, also called strand casting, is the process whereby molten metal is solidified into a "semifinished" billet, bloom, or slab for subsequent rolling in the finishing mills. Prior to the introduction of continuous casting in the 1950s, steel was poured into stationary molds to form ingots.

Since then, "continuous casting" has evolved to achieve improved yield, quality, productivity and cost efficiency. It allows lower-cost production of metal sections with better quality, due to the inherently lower costs of continuous, standardized production of a product, as well as providing increased control over the process through automation. This process is used most frequently to cast steel (in terms of tonnage cast). Continuous casting of slabs with either in-line hot rolling mill or subsequent separate hot rolling is important post processing steps to produce coils of sheet. Thick slabs are typically cast from 150 to 500 mm thick and then allowed to cool to room temperature. Subsequent hot rolling of the slabs after preheating in tunnel furnaces is done is several stages through both roughing and hot rolling mills to get down to thicknesses typically from 2 to 10 mm in thickness. Thin slab castings starts with an as-cast thickness of 20 to 150 mm and then is usually followed through in-line hot rolling in a number of steps in sequence to get down to thicknesses typically from 2 to 10 mm. There are many variations of this technique such as casting at thicknesses of 100 to 300 mm to produce intermediate thickness slabs which are subsequently hot rolled. Additionally, other casting processes are known including single and double belt casting processes which produce as-cast thickness in the range of 5 to 100 mm in thickness and which are usually in-line hot rolled to reduce the gauge thickness to targeted levels for coil production. In the automotive industry, forming of parts from sheet materials from coils is accomplished through many processes including bending, hot and cold press forming, drawing, or further shape rolling.

SUMMARY

The present disclosure is directed at alloys and their associated methods of production. The method comprises:

a. supplying a metal alloy comprising Fe at a level of 61.0 to 88.0 atomic percent, Si at a level of 0.5 to 9.0 atomic percent; Mn at a level of 0.9 to 19.0 atomic percent and optionally B and optionally B at a level of up to 8.0 atomic percent;
b. melting said alloy and cooling, and solidifying, and forming an alloy having a thickness according to one of the following:
   i. cooling at a rate of ≤250 K/s; or
   ii. solidifying to a thickness of ≥2.0 mm
c. wherein said alloy has a melting point (Tm) and heating said alloy to a temperature of 700° C. to below said alloy Tm and reducing said thickness of said alloy.

Optionally, the alloy in step (c) may undergo one of the following additional steps: (1) stressing above the alloy's yield strength of 200 MPa to 1000 MPa and providing a resulting alloy that indicates a yield strength of 200 MPa to 1650 MPa, tensile strength of 400 MPa to 1825 MPa, and an elongation of 2.4% to 78.1%; or (2) heat treating the alloy to a temperature of 700° C. to 1200° C. to form an alloy having one of the following: matrix grains of 50 nm to 50000 nm; boride grains of 20 nm to 10000 nm (optional—not required); or precipitation grains with size of 1 nm to 200 nm. Such alloy with such morphology after heat treatment may then be stressed above its yield strength to form an alloy having yield strength of 200 MPa to 1650 MPa, tensile strength of 400 MPa to 1825 MPa and an elongation of 2.4% to 78.1%.

Accordingly, the alloys of present disclosure have application to continuous casting processes including belt casting, thin strip/twin roll casting, thin slab casting and thick slab casting. The alloys find particular application in vehicles, such as vehicle frames, drill collars, drill pipe, pipe casing, tool joint, wellhead, compressed gas storage tanks or liquefied natural gas canisters.

BRIEF DESCRIPTION OF THE DRAWINGS

The detailed description below may be better understood with reference to the accompanying FIGs which are provided for illustrative purposes and are not to be considered as limiting any aspect of this invention.

FIG. 9 illustrates the as-cast plate of Alloy 2 with thickness of 50 mm.

FIG. 10 illustrates tensile properties of the plates from Alloy 1, Alloy 8 and Alloy 16 in as-cast and heat treated states.

FIG. 11 illustrates SEM backscattered electron images of microstructure in the Alloy 1 plates cast at 50 mm thickness (a) before and (b) after heat treatment at 1150° C. for 120 min.

FIG. 12 illustrates SEM backscattered electron images of microstructure in the Alloy 8 plates cast at 50 mm thickness (a) before and (b) after heat treatment at 1100° C. for 120 min.

FIG. 13 illustrates SEM backscattered electron images of microstructure in the Alloy 16 plates cast at 50 mm thickness (a) before and (b) after heat treatment at 1150° C. for 120 min.

FIG. 14 illustrates tensile properties of (a) Alloy 58 and (b) Alloy 59 in as-HIPed state as a function of cast plate thickness.

FIG. 15 illustrates SEM backscattered electron images of microstructure in the Alloy 59 plate cast at 1.8 mm thickness: (a) as-cast and (b) after HIP.

FIG. 16 illustrates SEM backscattered electron images of microstructure in the Alloy 59 plate cast at 10 mm thickness (a) as-cast and (b) after HIP.

FIG. 17 illustrates SEM backscattered electron images of microstructure in the Alloy 59 plate cast at 20 mm thickness (a) as-cast and (b) after HIP.

FIG. 18 illustrates tensile properties of (a) Alloy 58 and (b) Alloy 59 after HIP cycle and heat treatment as a function of cast thickness.

FIG. 19 illustrates a 20 mm thick plate from Alloy 1 before hot rolling (Bottom) and after hot rolling (Top).

FIG. 20 illustrates tensile properties of (a) Alloy 1 and (b) Alloy 2 before and after hot rolling as a function of cast thickness.

FIG. 21 illustrates backscattered SEM images of microstructure in Alloy 1 plate with as-cast thickness of 5 mm after hot rolling with 75.7% reduction in (a) outer layer region and (b) central layer region.

FIG. 22 illustrates backscattered SEM images of microstructure in Alloy 1 plate with as-cast thickness of 10 mm after hot rolling with 88.5% reduction in (a) outer layer region and (b) central layer region.

FIG. 23 illustrates backscattered SEM images of microstructure in Alloy 1 plate with as-cast thickness of 20 mm after hot rolling with 83.3% reduction in (a) outer layer region and (b) central layer region.

FIG. 24 illustrates tensile properties of the sheet from (a) Alloy 1 and (b) Alloy 2 after hot rolling, cold rolling and heat treatment with different parameters.

FIG. 25 illustrates backscattered SEM images of microstructure in Alloy 1 plate with as-cast thickness of 50 mm after hot rolling with 96% reduction in (a) outer layer region and (b) central layer region.

FIG. 26 illustrates backscattered SEM images of microstructure in Alloy 2 plate with as-cast thickness of 50 mm after hot rolling with 96% reduction in (a) outer layer region and (b) central layer region.

FIG. 27 illustrates tensile properties of post-processed sheet from (a) Alloy 1 and (b) Alloy 2 at different steps of post-processing.

FIG. 28 illustrates tensile properties of post-processed sheet from (a) Alloy 1 and (b) Alloy 2 initially cast at different thicknesses.

FIG. 29 illustrates backscattered SEM images of Alloy 2 with as-cast thickness of 20 mm after hot rolling with 88% reduction: (a) outer layer region; (b) central layer region.

FIG. 30 illustrates backscattered SEM images of Alloy 2 20 mm thick plate sample hot rolled and heat treated at 950° C. for 6 hr: (a) outer layer region; (b) central layer region.

FIG. 31 illustrates tensile properties of Alloy 8 sheet produced from 50 mm thick plate by hot rolling that was heat treated at different conditions with representative stress-strain curves.

FIG. 32 illustrates tensile properties of Alloy 16 sheet produced from 50 mm thick plate by hot rolling that was heat treated at different conditions.

FIG. 33 illustrates tensile properties of Alloy 24 sheet produced from 50 mm thick plate by hot rolling that was heat treated at different conditions with representative stress-strain curves.

FIG. 34 illustrates bright-field TEM micrographs of microstructure in the Alloy 1 plate after hot rolling and heat treatment initially cast 50 mm thickness.

FIG. 35 illustrates bright-field TEM micrographs of microstructure in the hot rolling and heat treated Alloy 1 plate after tensile deformation.

FIG. 36 illustrates bright-field TEM micrographs of microstructure in the 50 mm thick Alloy 8 plate after hot rolling and heat treatment: (a) before and (b) after tensile deformation.

FIG. 37 illustrates bright-field TEM micrographs at higher magnification of microstructure in the 50 mm thick Alloy 8 plate after hot rolling and heat treatment: (a) before and (b) after tensile deformation.

FIG. 38 illustrates high resolution TEM micrographs of microstructure in the 50 mm thick Alloy 8 plate after hot rolling and heat treatment: (a) before and (b) after tensile deformation.

FIG. 39 illustrates bright-field and dark-field TEM micrographs of microstructure in the 50 mm thick Alloy 16 plate after hot rolling and heat treatment.

FIG. 40 illustrates bright-field and dark-field TEM micrographs of microstructure in the hot rolled and heat treated Alloy 16 plate after tensile deformation.

FIG. 41 illustrates tensile properties of post-processed sheet from Alloy 32 and Alloy 42 initially cast into 50 mm thick plates.

FIG. 42 illustrates bright-field TEM micrographs of microstructure in the 50 mm thick as-cast plate from Alloy 24.

FIG. 43 illustrates bright-field TEM micrographs of microstructure in the Alloy 24 plate after hot rolling from 50 to 2 mm thickness.

FIG. 44 illustrates schematic of the cross section through the center of the cast plate showing the shrinkage funnel and the locations from which samples for chemical analysis were taken.

FIG. 45 illustrates alloying element content in tested locations at the top (Area A) and bottom (Area B) of the cast plate for the four alloys identified.

FIG. 46 illustrates comparison of stress-strain curves of new steel sheet types with existing Dual Phase (DP) steels.

FIG. 47 illustrates comparison of stress-strain curves of new steel sheet types with existing Complex Phase (CP) steels.

FIG. 48 illustrates comparison of stress-strain curves of new steel sheet types with existing Transformation Induced Plasticity (TRIP) steels.

FIG. 49 illustrates comparison of stress-strain curves of new steel sheet types with existing Martensitic (MS) steels.

FIG. 51 illustrates tensile properties of selected alloys cast at 50 mm thickness as compared to that for the same alloys cast at 3.3 mm thickness.

FIG. 52 illustrates an example stress strain curve of boron-free Alloy 63 in hot rolled state.

FIG. 53 Backscattered electron images of microstructure in the Alloy 65 cast at 50 mm thickness: (a) as-cast; (b) after hot rolling at 1250° C.; (c) after cold rolling to 1.2 mm thickness.

DETAILED DESCRIPTION

Continuous Slab Casting

A slab is a length of metal that is rectangular in cross-section. Slabs can be produced directly by continuous casting and are usually further processed via different processes (hot/cold rolling, skin rolling, batch heat treatment, continuous heat treatment, etc.). Common final products include sheet metal, plates, strip metal, pipes, and tubes.

Thick Slab Casting Description

Thick slab casting is the process whereby molten metal is solidified into a "semifinished" slab for subsequent rolling in the finishing mills. In the continuous casting process pictured in FIG. 1, molten steel flows from a ladle, through a tundish into the mold. Once in the mold, the molten steel freezes against the water-cooled copper mold walls to form a solid shell. Drive rolls lower in the machine continuously withdraw the shell from the mold at a rate or "casting speed" that matches the flow of incoming metal, so the process ideally runs in steady state. Below mold exit, the solidifying steel shell acts as a container to support the remaining liquid. Rolls support the steel to minimize bulging due to the ferrostatic pressure. Water and air mist sprays cool the surface of the strand between rolls to maintain its surface temperature until the molten core is solid. After the center is completely solid (at the "metallurgical length") the strand can be torch cut into slabs with typical thickness of 150 to 500 mm. In order to produce thin sheet from the slabs, they must be subjected to hot rolling with substantial reduction that is a part of post-processing. The hot rolling may be done in both roughing mills which are often reversible allowing multiple passes and with finishing fills with typically 5 to 7 stands in series. After hot rolling, the resulting sheet thickness is typically in the range of 2 to 5 mm. Further gauge reduction would occur normally through subsequent cold rolling.

Thin Slab Casting Description

Figure 2:
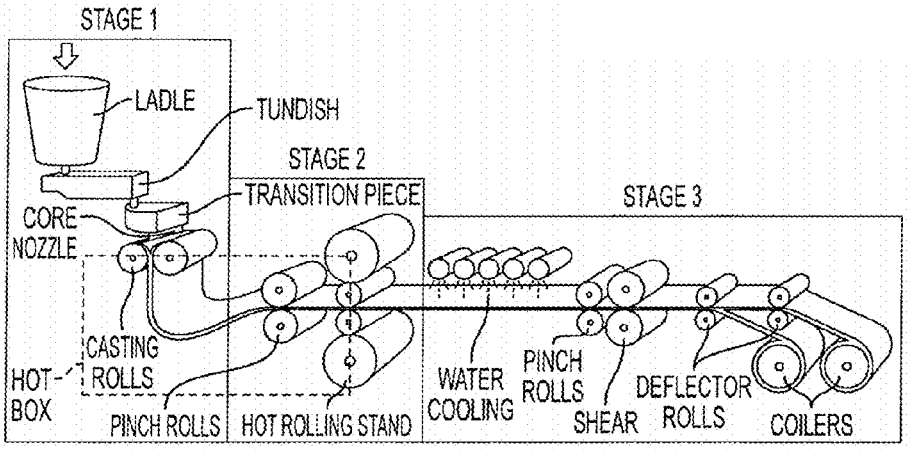
FIG. 2 illustrates an example thin slab casting process flow diagram showing steel sheet production steps.

A schematic of the thin slab casting process is shown in FIG. 2. The thin slab casting process can be separated into three stages. In Stage 1, the liquid steel is both cast and rolled in an almost simultaneous fashion. The solidification process begins by forcing the liquid melt through a copper or copper alloy mold to produce initial thickness typically from 50 to 110 mm in thickness but this can be varied (i.e. 20 to 150 mm) based on liquid metal processability and production speed. Almost immediately after leaving the mold and while the inner core of the steel sheet is still liquid, the sheet undergoes reduction using a multistep rolling stand which reduces the thickness significantly down to 10 mm depending on final sheet thickness targets. In Stage 2, the steel sheet is heated by going through one or two induction furnaces and during this stage the temperature profile and the metallurgical structure is homogenized. In Stage 3, the sheet is further rolled to the final gage thickness target which may be in the 0.5 to 15 mm thickness range. Typically, during the hot rolling process, the gauge reduction will be done in 5 to 7 steps as the sheet is reduced through 5 to 7 mills in series. Immediately after rolling, the strip is cooled on a run-out table to control the development of the final microstructure of the sheet prior to coiling into a steel roll.

While the three stage process of forming sheet in thin slab casting is part of the process, the response of the alloys herein to these stages is unique based on the mechanisms and structure types described herein and the resulting novel combinations of properties.

Post-Processing Methods

Hot Rolling

Figure 3:
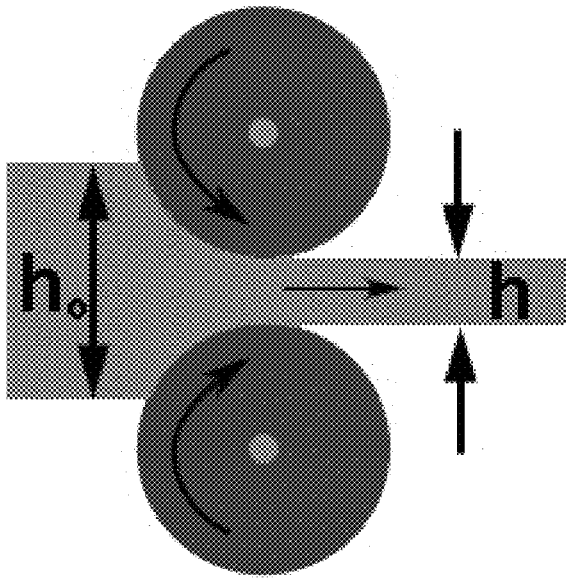
FIG. 3 illustrates a hot (cold) rolling process.

Hot rolled steel is formed to shape while it is red-hot then allowed to cool. Flat rolling is the most basic form of rolling with the starting and ending material having a rectangular cross-section. The schematic illustration of a rolling process for metal sheets is presented in FIG. 3. Hot rolling is a part of sheet production in order to reduce sheet thickness towards targeted values by utilizing the enhanced ductility of sheet metal at elevated temperature when high level of rolling reduction can be achieved. Hot rolling can be a part of casting process when one (Thin Strip casting) or multiple (Thin Slab Casting) stands are built-in in-line. In a case of Thick (Traditional) Slab Casting, the slab is first reheated in a tunnel furnace and then moves through a series of mill stands (FIG. 3). To produce sheet with targeted thickness, hot rolling is a part of post-processing on separate Hot Rolling Mill Production Lines is also applied. Since red-hot steel contracts as it cools, the surface of the metal is slightly rough and the thickness may vary a few thousandths of an inch. Commonly, cold rolling is a following step to improve quality in the final sheet product.

Cold Rolling

Cold rolled steel is made by passing cold steel material through heavy rollers which compress the metal to its final shape and dimension. It is a common step of post-processing during sheet production when different cold rolling mills can be utilized depending on material properties, cold rolling objective and targeted parameters. When sheet material undergoes cold rolling, its strength, hardness as well as the elastic limit increase. However, the ductility of the metal sheet decreases due to strain hardening thus making the metal more brittle. As such, the metal must be annealed/heated from time to time between passes during the rolling operation to remove the undesirable effects of cold deformation and to increase the formability of the metal. Thus obtaining large thickness reduction can be time and cost consuming. In many cases, multi-stand cold rolling mills with in-line annealing are utilized wherein the sheet is affected by elevated temperature for a short period of time (usually 2 to 5 min) by induction heating while it moves along the rolling line. Cold rolling allows a much more precise dimensional accuracy and final sheet products have a smoother surface (better surface finish) than those from hot rolling.

Heat Treatment

To get the targeted mechanical properties, post-processing annealing of the sheet materials is usually implemented. Typically, annealing of steel sheet products is performed in two ways at a commercial scale: batch annealing or continuous annealing. During a batch annealing process, massive coils of the sheet slowly heat and cool in furnaces with a controlled atmosphere. The annealing time can be from several hours to several days. Due to the large mass of the coils which may be typically 5 to 25 ton in size, the inside and outside parts of the coils will experience different thermal histories in a batch annealing furnace which can lead to differences in resulting properties. In the case of a continuous annealing process, uncoiled steel sheets pass through heating and cooling equipment for several minutes. The heating equipment is usually a two-stage furnace. The first stage is high temperature heat treatment which provides recrystallization of microstructure. The second stage is low temperature heat treatment and it offers artificial ageing of microstructure. A proper combination of the two stages of overall heat treatment during continuous annealing provides the target mechanical properties. The advantages of continuous annealing over conventional batch annealing are the following: improved product uniformity; surface cleanliness and shape; ability to produce a wide range of steel grades.

Structures And Mechanisms

The steel alloys herein are such that they are initially capable of formation of what is described herein as Class 1 or Class 2 Steel which are preferably crystalline (non-glassy) with identifiable crystalline grain size and morphology. The present disclosure focuses upon improvements to the Class 2 Steel and the discussion below regarding Class 1 is intended to provide initial context.

Class 1 Steel

Figure 4:
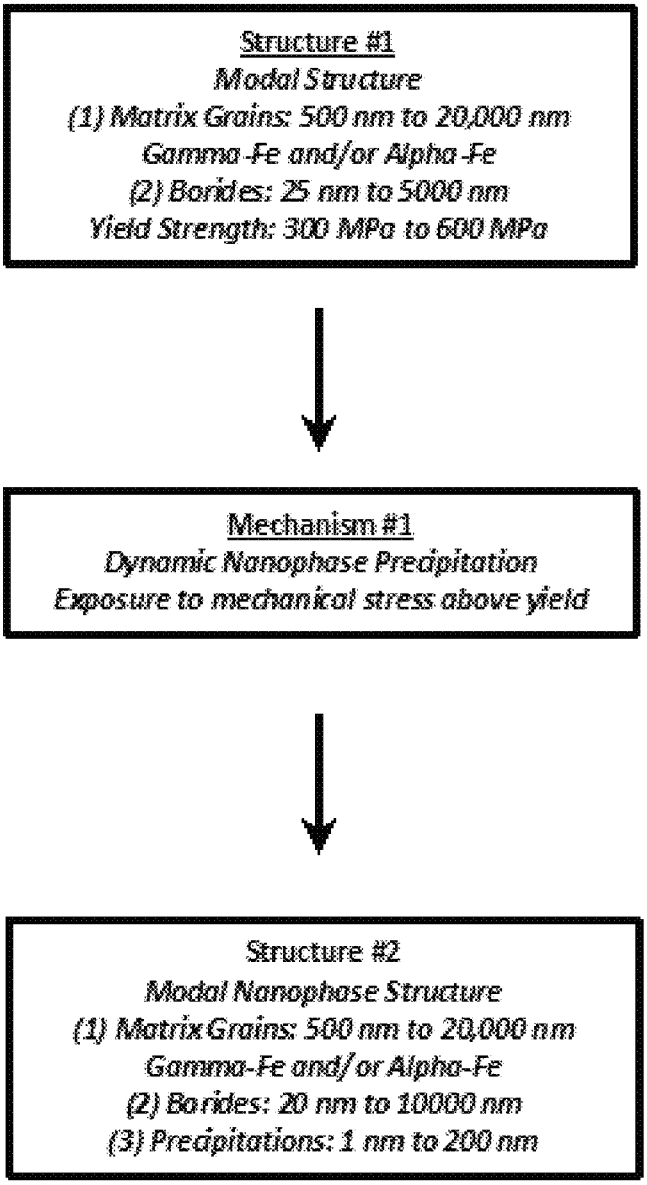
FIG. 4 illustrates the formation of Class 1 steel alloys.

The formation of Class 1 Steel herein is illustrated in FIG. 4. As shown therein, a modal structure is initially formed which modal structure is the result of starting with a liquid melt of the alloy and solidifying by cooling, which provides nucleation and growth of particular phases having particular grain sizes. Reference herein to modal may therefore be understood as a structure having at least two grain size distributions. Grain size herein may be understood as the size of a single crystal of a specific particular phase preferably identifiable by methods such as scanning electron microscopy or transmission electron microscopy. Accordingly, Structure #1 of the Class 1 Steel may be preferably achieved by processing through either laboratory scale procedures as shown and/or through industrial scale methods involving chill surface processing methodology such as twin roll processing, thin slab casting or thick slab casting.

The modal structure of Class 1 Steel will therefore initially indicate, when cooled from the melt, the following grain sizes: (1) matrix grain size of 500 nm to 20,000 nm containing austenite and/or ferrite; (2) boride grain size of 25 nm to 5000 nm (i.e. non-metallic grains such as $M_2B$ where M is the metal and is covalently bonded to B). The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometry is possible and may provide pinning including $M_3B$, MB ($M_1B_1$), $M_{23}B_6$, and $M_7B_3$.

The Modal Structure of Class 1 Steel may be deformed by thermo-mechanical processes and undergo various heat treatments, resulting in some variation in properties, but the Modal Structure may be maintained.

Figure 5:
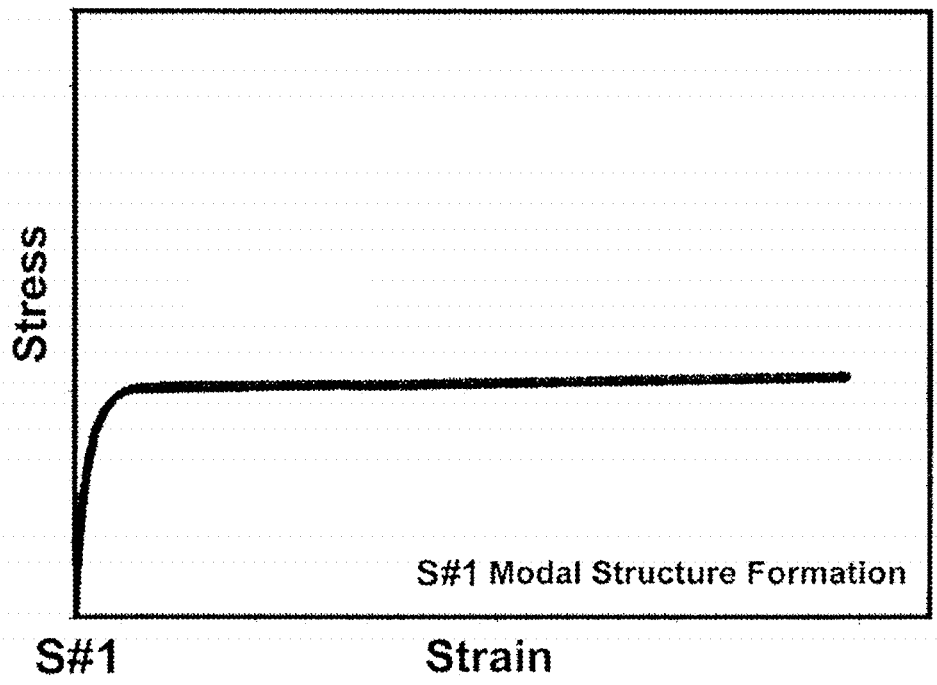
FIG. 5 illustrates a model stress—strain curve corresponding to Class 1 alloy behavior.

When the Class 1 Steel noted above is exposed to a tensile stress, the observed stress versus strain diagram is illustrated in FIG. 5. It is therefore observed that the modal structure undergoes what is identified as the Dynamic Nanophase Precipitation leading to a second type structure for the Class 1 Steel. Such Dynamic Nanophase Precipitation is therefore triggered when the alloy experiences a yield under stress, and it has been found that the yield strength of Class 1 Steels which undergo Dynamic Nanophase Precipitation may preferably occur at 300 MPa to 840 MPa. Accordingly, it may be appreciated that the Dynamic Nanophase Precipitation occurs due to the application of mechanical stress that exceeds such indicated yield strength. The Dynamic Nanophase Precipitation itself may be understood as the formation of a further identifiable phase in the Class 1 Steel which is termed a precipitation phase with an associated grain size. That is, the result of such Dynamic Nanophase Precipitation is to form an alloy which still indicates identifiable matrix grain size of 500 nm to 20,000 nm, boride pinning grain size of 20 nm to 10000 nm, along with the formation of precipitation grains of hexagonal phases with 1.0 nm to 200 nm in size. As noted above, the grain sizes therefore do not coarsen when the alloy is stressed, but does lead to the development of the precipitation grains as noted.

Reference to the hexagonal phases may be understood as a dihexagonal pyramidal class hexagonal phase with a $P6_3mc$ space group (#186) and/or a ditrigonal dipyramidal class with a hexagonal P6bar2C space group (#190). In addition, the mechanical properties of such second type structure of the Class 1 Steel are such that the tensile strength is observed to fall in the range of 630 MPa to 1150 MPa, with an elongation of 10 to 40%. Furthermore, the second type structure of the Class 1 Steel is such that it exhibits a strain hardening coefficient between 0.1 to 0.4 that is nearly flat after undergoing the indicated yield. The strain hardening coefficient is reference to the value of n In the formula $\sigma=K\epsilon^n$, where $\sigma$ represents the applied stress on the material, $\epsilon$ is the strain and K is the strength coefficient. The value of the strain hardening exponent n lies between 0 and 1. A value of 0 means that the alloy is a perfectly plastic solid (i.e. the material undergoes non-reversible changes to applied force), while a value of 1 represents a 100% elastic solid (i.e. the material undergoes reversible changes to an applied force). Table 1 below provides a comparison and performance summary for Class 1 Steel herein.

TABLE 1

Comparison of Structure and Performance for Class 1 Steel

| Property/ Mechanism | Class 1 Steel: Structure #1 Modal Structure | Class 1 Steel: Structure #2 Modal Nanophase Structure |
|---|---|---|
| Structure Formation | Starting with a liquid melt, solidifying this liquid melt and forming directly | Dynamic Nanophase Precipitation occurring through the application of mechanical stress |
| Transformations | Liquid solidification followed by nucleation and growth | Stress induced transformation involving phase formation and precipitation |
| Enabling Phases | Austenite and/or ferrite with boride pinning (if present) | Austenite, optionally ferrite, boride pinning phases (if present), and hexagonal phase(s) precipitation |
| Matrix Grain Size | 500 to 20,000 nm Austenite and/or ferrite | 500 to 20,000 nm Austenite optionally ferrite |
| Boride Size (if present) | 25 to 5000 nm Non metallic (e.g. metal boride) | 20 to 10000 nm Non-metallic (e.g. metal boride) |
| Precipitation Grain Size | — | 1 nm to 200 nm Hexagonal phase(s) |
| Tensile Response | Intermediate structure; transforms into Structure #2 when undergoing yield | Actual with properties achieved based on structure type #2 |
| Yield Strength | 300 to 600 MPa | 300 to 840 MPa |
| Tensile Strength | — | 630 to 1150 MPa |
| Total Elongation | — | 10 to 40% |
| Strain Hardening Response | — | Exhibits a strain hardening coefficient between 0.1 to 0.4 and a strain hardening coefficient as a function of strain which is nearly flat or experiencing a slow increase until failure |

Class 2 Steel

Figure 6:
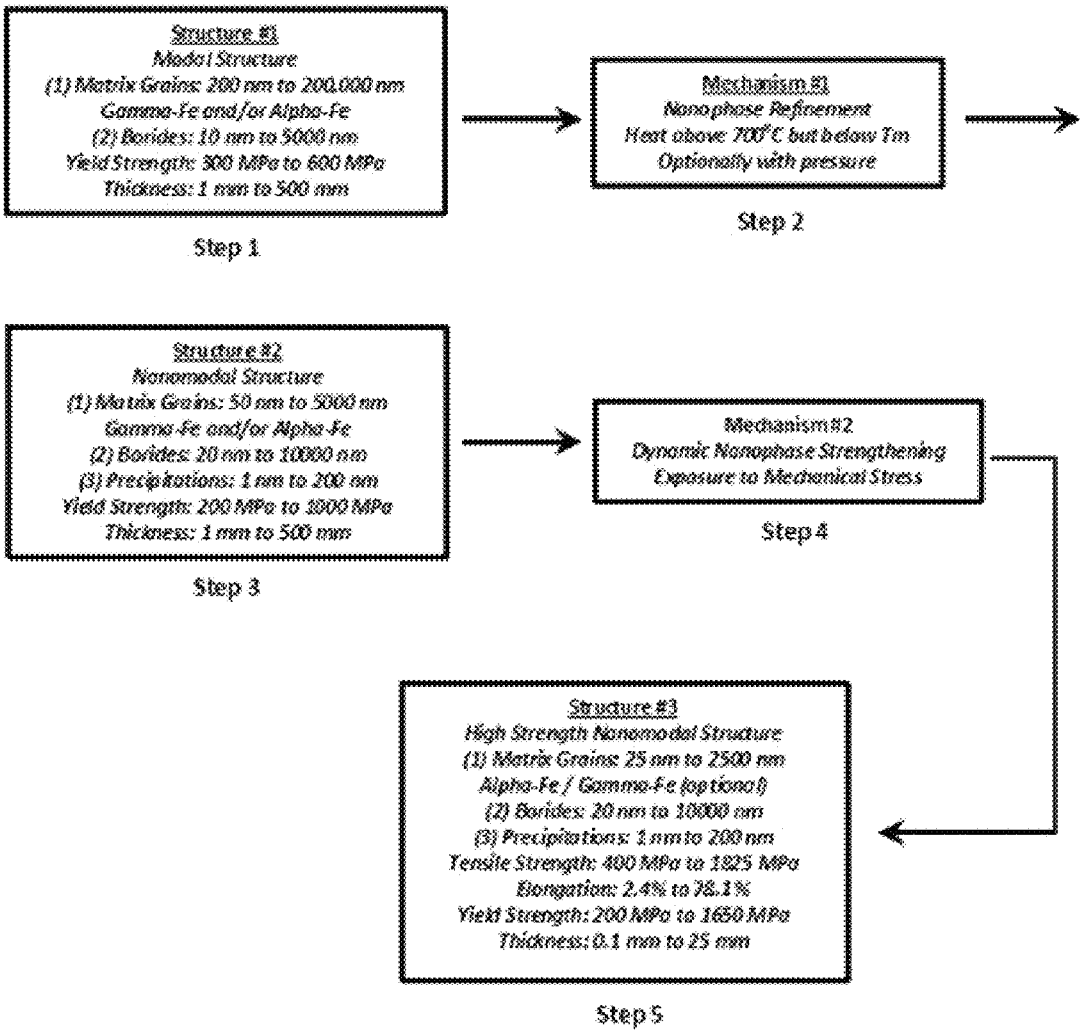
FIG. 6 illustrates the formation of Class 2 steel alloys.

The formation of Class 2 Steel herein is illustrated in FIG. 6. Class 2 steel may also be formed herein from the identified alloys, which involves two new structure types after starting with Structure #1, Modal Structure, followed by two new mechanisms identified herein as Static Nanophase Refinement and Dynamic Nanophase Strengthening. The structure types for Class 2 Steel are described herein as Nanomodal Structure and High Strength Nanomodal Structure. Accordingly, Class 2 Steel herein may be characterized as follows: Structure #1—Modal Structure (Step #1), Mechanism #1—Static Nanophase Refinement (Step #2), Structure #2—Nanomodal Structure (Step #3), Mechanism #2—Dynamic Nanophase Strengthening (Step #4), and Structure #3—High Strength Nanomodal Structure (Step #5).

As shown therein, Structure #1 is initially formed in which Modal Structure is the result of starting with a liquid melt of the alloy and solidifying by cooling, which provides nucleation and growth of particular phases having particular grain sizes. Grain size herein may again be understood as the size of a single crystal of a specific particular phase preferably identifiable by methods such as scanning electron microscopy or transmission electron microscopy. Accordingly, Structure #1 of the Class 2 Steel may be preferably achieved by processing through either laboratory scale procedures as shown and/or through industrial scale methods involving chill surface processing methodology such as twin roll processing or thin slab casting.

The Modal Structure of Class 2 Steel will therefore initially indicate, when cooled from the melt, the following grain sizes: (1) matrix grain size of 200 nm to 200,000 nm containing austenite and/or ferrite; (2) boride grain sizes, if present, of 10 nm to 5000 nm (i.e. non-metallic grains such as $M_2B$ where M is the metal and is covalently bonded to B). The boride grains may also preferably be "pinning" type phases which are referenced to the feature that the matrix grains will effectively be stabilized by the pinning phases which resist coarsening at elevated temperature. Note that the metal boride grains have been identified as exhibiting the $M_2B$ stoichiometry but other stoichiometry is possible and may provide pinning including $M_3B$, MB ($M_1B_1$), $M_{23}B_6$, and $M_7B_3$ and which are unaffected by Mechanisms #1 or #2 noted above. Reference to grain size is again to be understood as the size of a single crystal of a specific particular phase preferably identifiable by methods such as scanning electron microscopy or transmission electron microscopy. Furthermore, Structure #1 of Class 2 steel herein includes austenite and/or ferrite along with such boride phases.

Figure 7:
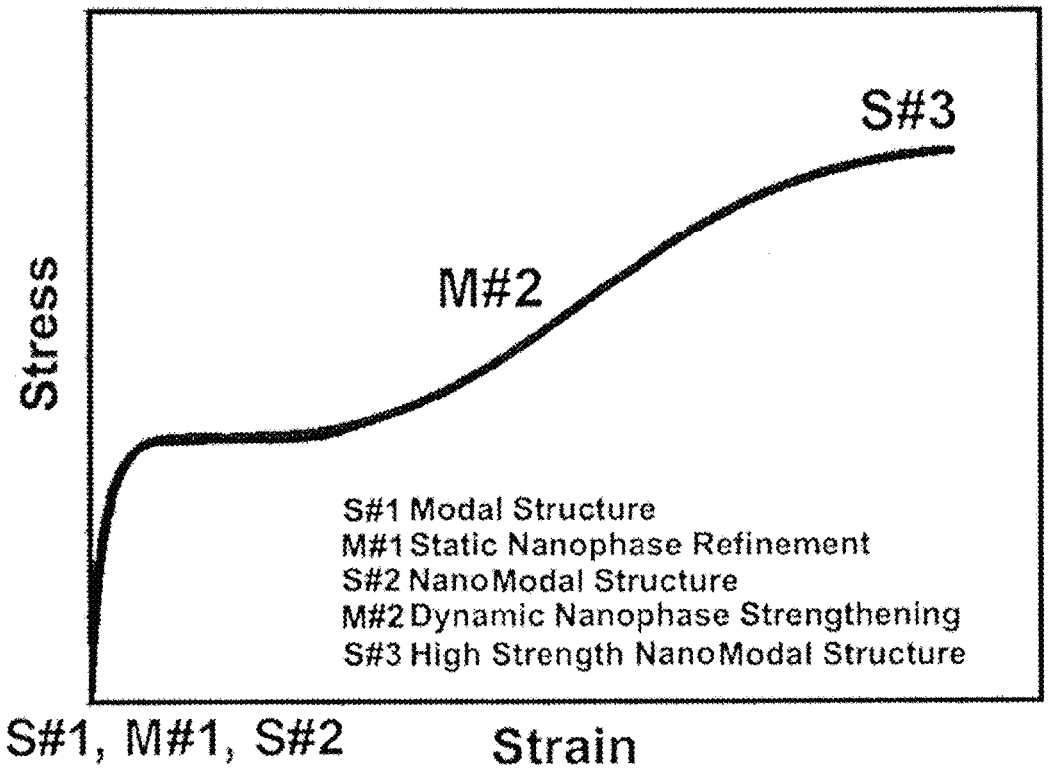
FIG. 7 illustrates a model stress—strain curve corresponding to Class 2 alloy behavior.

In FIG. 7, a stress strain curve is shown that represents the steel alloys herein which undergo a deformation behavior of Class 2 steel. The Modal Structure is preferably first created (Structure #1) and then after the creation, the Modal Structure may now be uniquely refined through Mechanism #1, which is a Static Nanophase Refinement mechanism, leading to Structure #2. Static Nanophase Refinement is reference to the feature that the matrix grain sizes of Structure #1 which initially fall in the range of 200 nm to 200,000 nm are reduced in size to provide Structure 2 which has matrix grain sizes that typically fall in the range of 50 nm to 5000 nm. Note that the boride pinning phase, if present, can change size significantly in some alloys, while it is designed to resist matrix grain coarsening during the heat treatments. Due to the presence of these boride pinning sites, the motion of a grain boundaries leading to coarsening would be expected to be retarded by a process called Zener pinning or Zener drag. Thus, while grain growth of the matrix may be energetically favorable due to the reduction of total interfacial area, the presence of the boride pinning phase will counteract this driving force of coarsening due to the high interfacial energies of these phases.

Characteristic of the Static Nanophase Refinement (Mechanism #1) in Class 2 steel, if borides are present, is such that the micron scale austenite phase (gamma-Fe) which was noted as falling in the range of 200 nm to 200,000 nm is partially or completely transformed into new phases (e.g. ferrite or alpha-Fe) at elevated temperature. The volume fraction of ferrite (alpha-iron) initially present in the modal structure (Structure 1) of Class 2 steel is 0 to 45%. The volume fraction of ferrite (alpha-iron) in Structure #2 as a result of Static Nanophase Refinement (Mechanism #2) is typically from 20 to 80% at elevated temperature and then reverts back to austenite (gamma-iron) upon cooling to produce typically from 20 to 80% austenite at room temperature. The static transformation preferably occurs during elevated temperature heat treatment and thus involves a unique refinement mechanism since grain coarsening rather than grain refinement is the conventional material response at elevated temperature.

Accordingly, if borides are present, grain coarsening does not occur with the alloys of Class 2 Steel herein during the Static Nanophase Refinement mechanism. Structure #2 is uniquely able to transform to Structure #3 during Dynamic Nanophase Strengthening and as a result Structure #3 is formed and indicates tensile strength values in the range from 400 to 1825 MPa with 2.4 to 78.1% total elongation.

Depending on alloy chemistries, nanoscale precipitates can form during Static Nanophase Refinement and the subsequent thermal process in some of the non-stainless high-strength steels. The nano-precipitates are in the range of 1 nm to 200 nm, with the majority (>50%) of these phases 10~20 nm in size, which are much smaller than matrix grains or the boride pinning phase formed in Structure #1 for retarding matrix grain coarsening when present. Also, during Static Nanophase Refinement, the boride grains, if present, are found to be in a range from 20 to 10000 nm in size.

Expanding upon the above, in the case of the alloys herein that provide Class 2 Steel, when such alloys exceed their yield point, plastic deformation at constant stress occurs followed by a dynamic phase transformation leading toward the creation of Structure #3. More specifically, after enough strain is induced, an inflection point occurs where the slope of the stress versus strain curve changes and increases (FIG. 7) and the strength increases with strain indicating an activation of Mechanism #2 (Dynamic Nanophase Strengthening).

With further straining during Dynamic Nanophase Strengthening, the strength continues to increase but with a gradual decrease in strain hardening coefficient value up to nearly failure. Some strain softening occurs but only near the breaking point which may be due to reductions in localized cross sectional area at necking. Note that the strengthening transformation that occurs in the material straining under the stress generally defines Mechanism #2 as a dynamic process, leading to Structure #3. By dynamic, it is meant that the process may occur through the application of a stress which exceeds the yield point of the material. The tensile properties that can be achieved for alloys that achieve Structure 3 include tensile strength values in the range from 400 to 1825 MPa and 2.4% to 78.1% total elongation. The level of tensile properties achieved is also dependent on the amount of transformation occurring as the strain increases corresponding to the characteristic stress strain curve for a Class 2 steel.

Thus, depending on the level of transformation, tunable yield strength may also now be developed in Class 2 Steel herein depending on the level of deformation and in Structure #3 the yield strength can ultimately vary from 200 MPa to 1650 MPa. That is, conventional steels outside the scope of the alloys here exhibit only relatively low levels of strain hardening, thus their yield strengths can be varied only over small ranges (e.g., 100 to 200 MPa) depending on the prior deformation history. In Class 2 steels herein, the yield strength can be varied over a wide range (e.g. 200 to 1650 MPa) as applied to the Structure #2 transformation into Structure #3, allowing tunable variations to enable both the designer and end users in a variety of applications, and utilize Structure #3 in various applications such as crash management in automobile body structures.

With regards to this dynamic mechanism shown in FIG. 6, new and/or additional precipitation phase or phases are observed that indicates identifiable grain sizes of 1 nm to 200 nm. In addition, there is the further identification in said precipitation phase a dihexagonal pyramidal class hexagonal phase with a $P6_3mc$ space group (#186), a ditrigonal dipyramidal class with a hexagonal P6bar2C space group (#190), and/or a $M_3Si$ cubic phase with a Fm3m space group (#225). Accordingly, the dynamic transformation can occur partially or completely and results in the formation of a microstructure with novel nanoscale/near nanoscale phases providing relatively high strength in the material. Structure #3 may be understood as a microstructure having matrix grains sized generally from 25 nm to 2500 nm which are pinned by boride phases, which are in the range of 20 nm to 10000 nm and with precipitate phases which are in the range of 1 nm to 200 nm. Note that in the absence of boride pinning phases, the refinement may be somewhat less and/or some matrix coarsening may occur resulting in matrix grains which are sized from 25 nm to 25000 nm. The initial formation of the above referenced precipitation phase with grain sizes of 1 nm to 200 nm starts at Static Nanophase Refinement and continues during Dynamic Nanophase Strengthening leading to Structure #3 formation. The volume fraction of the precipitation grains with 1 nm to 200 nm in size increases in Structure #3 as compared to Structure #2 and assists with the identified strengthening mechanism. It should also be noted that in Structure #3, the level of gamma-iron is optional and may be eliminated depending on the specific alloy chemistry and austenite stability. Table 2 below provides a comparison of the structure and performance of Class 2 Steel herein:

TABLE 2

Comparison Of Structure and Performance of Class 2 Steel

| | Class 2 Steel | | |
|---|---|---|---|
| Property/ Mechanism | Structure #1 Modal Structure | Structure #2 Nanomodal Structure | Structure #3 High Strength Nanomodal Structure |
| Structure Formation | Starting with a liquid melt, solidifying this liquid melt and forming directly | Static Nanophase Refinement mechanism occurring during heat treatment | Dynamic Nanophase Strengthening mechanism occurring through application of mechanical stress |

TABLE 2-continued

| Comparison Of Structure and Performance of Class 2 Steel | | | |
|---|---|---|---|
| | Class 2 Steel | | |
| Property/ Mechanism | Structure #1 Modal Structure | Structure #2 Nanomodal Structure | Structure #3 High Strength Nanomodal Structure |
| Transformations | Liquid solidification followed by nucleation and growth | Solid state phase transformation of supersaturated gamma iron | Stress induced transformation involving phase formation and precipitation |
| Enabling Phases | Austenite and/or ferrite with boride pinning phases (if present) | Ferrite, austenite, boride pinning phases (if present), and hexagonal phase precipitation | Ferrite, optionally austenite, boride pinning phases (if present), hexagonal and additional phases precipitation |
| Matrix Grain Size | 200 nm to 200,000 nm austenite | Grain refinement if borides are present 50 nm to 5000 nm | Grain size- further refinement to 25 nm to 2500 nm (if boride phases not present refinement and/or coarsening to 25 nm to 25000 nm) |
| Boride Grain Size (if present) | 10 nm to 5000 nm borides (e.g. metal boride) | 20 nm to 10000 nm borides (e.g. metal boride) | 20 to 10000 nm borides (e.g. metal boride) |
| Precipitation Grain Size | — | 1 nm to 200 nm | 1 nm to 200 nm |
| Tensile Response | Actual with properties achieved based on structure type #1 | Intermediate structure; transforms into Structure #3 when undergoing yield | Actual with properties achieved based on formation of structure type #3 and fraction of transformation. |
| Yield Strength | 300 to 600 MPa | 200 to 1000 MPa | 200 to 1650 MPa |
| Tensile Strength | — | — | 400 to 1825 MPa |
| Total Elongation | — | — | 2.4 % to 78.1% |
| Strain Hardening Response | — | After yield point, exhibit a strain softening at initial straining as a result of phase transformation, followed by a significant strain hardening effect leading to a distinct maxima | Strain hardening coefficient may vary from 0.2 to 1.0 depending on amount of deformation and transformation |

New Pathways For Modal Structure

Figure 8:
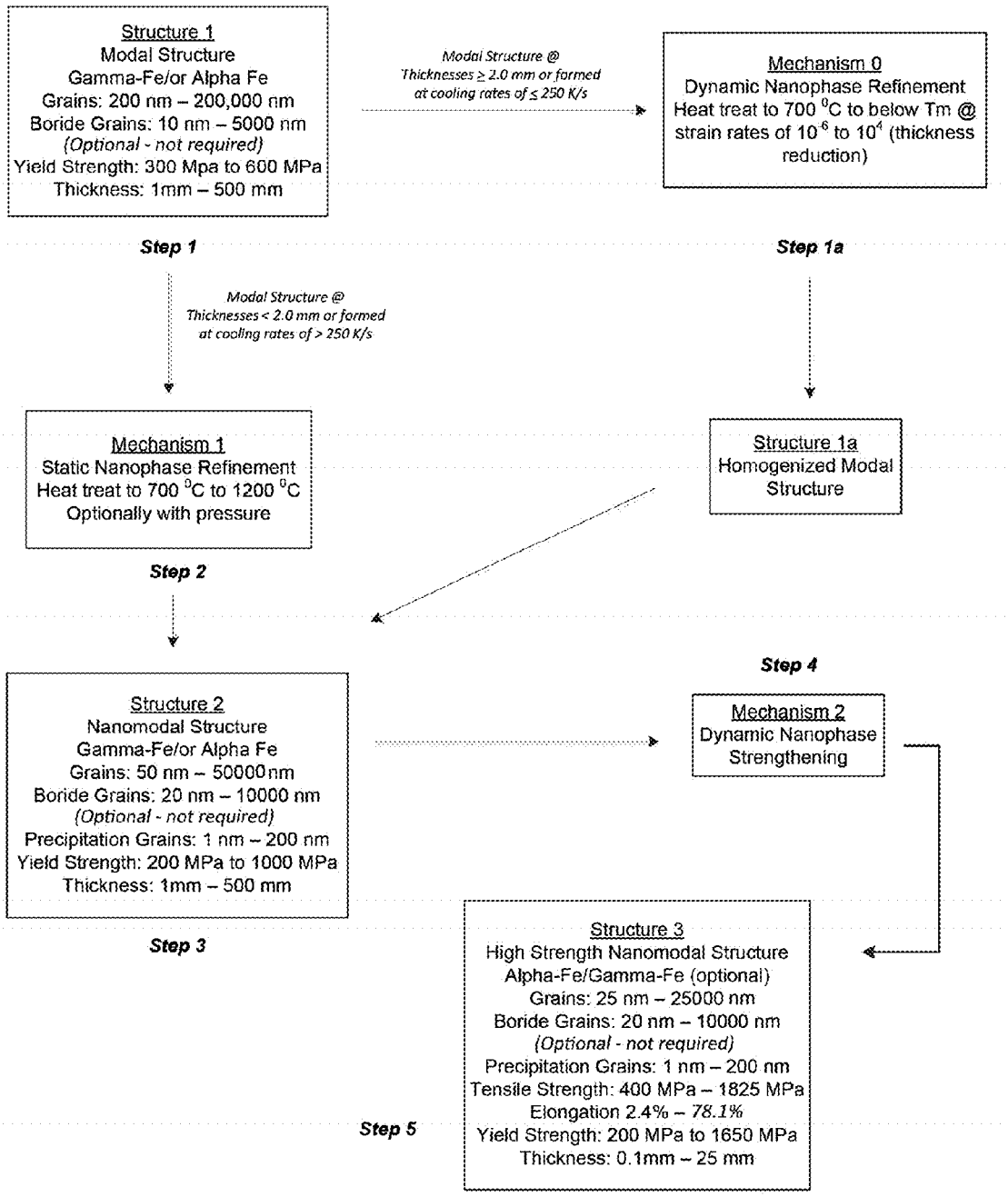
FIG. 8 illustrates structures and mechanisms in the alloys herein applicable to sheet production with the identification of the Mechanism #0 (Dynamic Nanophase Refinement) which is preferably applicable to the Modal Structure (Structure #1) that is formed at thicknesses greater than or equal to 2.0 mm or at cooling rates of less than or equal to 250 K/s.

Pathways for the development of High Strength Nanomodal Structure formation are as noted described in FIG. 6. A new pathway is disclosed herein as shown in FIG. 8. This figure relates to the alloys in which boride pinning phase may or may not be present. It starts with Structure #1, Modal Structure but includes additional Mechanism #0—Dynamic Nanophase Refinement leading to formation of Structure #1a—Homogenized Modal Structure (FIG. 8). More specifically, Dynamic Nanophase Refinement is the application of elevated temperature (700° C. to a temperature just below the melting point) with stress (as provided by strain rates of $10^{-6}$ to $10^{4}$ $s^{-1}$) sufficient to cause a thickness reduction in the metal, which can occur with various processes including hot rolling, hot forging, hot pressing, hot piercing, and hot extrusion. It also leads to, as discussed more fully below, a refinement to the morphology of the metal alloy.

The Dynamic Nanophase Refinement leading to the Homogenized Modal Structure is observed to occur in as little as 1 cycle (heating with thickness reduction) or after multiple reduction cycles of thickness (e.g. up to 25). The Homogenized Modal Structure (Structure 1a in FIG. 8) represents an intermediate structure between the starting Modal Structure with the associated properties and characteristics defined as Structure 1 of FIG. 8. and the fully transformed Nanomodal Structure defined as Structure 2 in FIG. 8. Depending on the specific chemistry, the starting thickness, and the level of heating and the amount of thickness reduction (related to the total amount of force applied), the transformation can be complete in as little as 1 cycle or it may take many cycles ((e.g. up to 25) to completely transform. A partially transformed, intermediate structure is Structure 1a or Homogenized Modal Structure and after full transformation of the Modal Structure into NanoModal Structure, the Nanomodal structure (i.e. Structure 2) is formed. Progressive cycles lead to the creation of Structure #2 (Nanomodal Structure). Depending on the level of refinement and homogenization achieved for a particular alloy chemistry with a particular Modal Structure, Structure #1a (Homogenized Modal Structure) may therefore become directly Structure #2 (Nanomodal Structure) or may be heat treated and further refined through Mechanism #1 (Static Nanophase Refinement) to similarly produce Structure #2 (Nanomodal Structure). As shown, Structure #2, Nanomodal Structure, may then undergo Mechanism #2 (Dynamic Nanophase Strengthening) leading to the formation of Structure #3 (High Strength Nanomodal Structure).

It is worth noting that Dynamic Nanophase Refinement (Mechanism #0) is a mechanism providing Homogenized Modal Structure (Structure #1a) in cast alloys preferably through the entire volume/thickness that makes the alloys effectively cooling rate insensitive (as well as thickness insensitive) during the initial solidification from the liquid state that enables utilization of such production methods as thin slab or thick slab casting for sheet production. In other words, it has been observed that if one forms Modal Structure at a thickness of greater than or equal to 2.0 mm or applies a cooling rate during formation of Modal Structure that is less than or equal to 250K/s, the ensuing step of Static Nanophase Refinement may not readily occur. Therefore the ability to produce Nanomodal Structure (Structure #2) and accordingly, the ability to undergo Dynamic Nanophase Strengthening (Mechanism #2) and form High Strength Nanomodal Structure (Structure #3) will be compromised. That is the refinement of the structure will either not occur leading to properties which are either equivalent to those obtained from the Modal Structure or will be ineffective leading to properties which are between that of the Modal and NanoModal Structures.

However, one may now preferably ensure the ability to form Nanomodal Structure (Structure #2) and the ensuing development of High Strength Nanomodal Structure. More specifically, when starting with Modal Structure that is solidified from the melt with a thickness of greater than or equal to 2.0 mm or Modal Structure cooled at a rate of less than or equal to 250 K/s), one may now preferably proceed with Dynamic Nanophase Refinement (Mechanism #0) into Homogenized Modal Structure and then proceed with the steps illustrated in FIG. 8 to form High Strength Nanomodal Structure. In addition, should one prepare Modal Structure at thicknesses of less than 2 mm or at cooling rates of greater than 250 K/s, one may preferably proceed directly with Static Nanophase Refinement (Mechanism #1) as shown in FIG. 8.

As therefore identified, Dynamic Nanophase Refinement occurs after the alloys are subjected to deformation at elevated temperature and preferably occurs at a range from 700° C. to a temperature just below the melting point and over a range of strain rates from $10^{-6}$ to $10^{4}$ $s^{-1}$. One example of such deformation may occur by hot rolling after thick slab or thin slab casting which may occur in single or multiple roughing hot rolling steps or single and/or single or multiple finishing hot rolling steps. Alternatively it can occur at post processing with a wide variety of hot processing steps including but not limited to hot stamping, forging, hot pressing, hot extrusion, etc.

Mechanisms During Sheet Production

The formation of Modal Structure (Structure #1) in steel alloys herein can occur during alloy solidification at Thick Slab (FIG. 1) or Thin Slab Casting (Stage 1, FIG. 2). The Modal Structure may be preferably formed by heating the alloys herein at temperatures in the range of above their melting point and in a range of 1100° C. to 2000° C. and cooling below the melting temperature of the alloy, which corresponds to preferably cooling in the range of $1\times10^{3}$ to $1\times10^{-3}$ K/s.

Integrated hot rolling of Thick Slab (FIG. 1) or Thin Slab Casting (Stage 2, FIG. 2) of the alloys will lead to formation of Homogenized Modal Structure (Structure #1a, FIG. 8) through the Dynamic Nanophase Refinement (Mechanism #0) in the cast slab with thickness of typically 150 to 500 mm in a case of Thick Slab Casting and 20 to 150 mm in a case of Thin Slab Casting. The Type of the Homogenized Modal Structure (Table 1) will depend on alloy chemistry and hot rolling parameters.

Mechanism #1 which is the Static Nanophase Refinement with Nanomodal Structure formation (Structure #2) occurs when produced slabs with Homogenized Modal Structure (Structure #1a, FIG. 8) are subjected to elevated temperature exposure (from 700° C. up to the melting temperature of the alloy) during post-processing. Possible methods for realization of Static Nanophase Refinement (Mechanism #1) include but not limited to in-line annealing, batch annealing, hot rolling followed by annealing towards targeted thickness, etc. Hot rolling is a typical method utilized to reduce slab thickness to the ranges of few millimeters in order to produce sheet steel for various applications. Typical thickness reduction can vary widely depending on the production method of the initial sheet. Starting thickness may vary from 3 to 500 mm and final thickness would vary from 1 mm to 20 mm.

Cold rolling is a widely used method for sheet production that is utilized to achieve targeted thickness for particular applications. For example, most sheet steel used for automotive industry has thickness in a range from 0.4 to 4 mm. To achieve targeted thickness, cold rolling is applied through multiple passes with intermediate annealing between passes. Typical reduction per pass is 5 to 70% depending on the material properties. The number of passes before the intermediate annealing also depends on materials properties and its level of strain hardening at cold deformation. Cold rolling is also used as a final step for surface quality known as a skin pass. For the steel alloys herein and through methods to form Nanomodal Structure as provided in FIG. 8, the cold rolling will trigger Dynamic Nanophase Strengthening and the formation of the High Strength Nanomodal Structure.

Preferred Alloy Chemistries and Sample Preparation

The chemical composition of the alloys studied is shown in Table 4 which provides the preferred atomic ratios utilized. Initial studies were done by plate casting in copper die.

Alloy 1 through Alloy 59 were cast into plates with thickness of 3.3 mm. Using commercial purity feedstock, 35 g alloy feedstocks of the targeted alloys were weighed out according to the atomic ratios provided in Table 4. The feedstock material was then placed into the copper hearth of an arc-melting system. The feedstock was arc-melted into an ingot using high purity argon as a shielding gas. The ingots were flipped several times and re-melted to ensure homogeneity. Individually, the ingots were disc-shaped, with a diameter of approximately 30 mm and a thickness of approximately 9.5 mm at the thickest point. The resulting ingots were then placed in a pressure vacuum caster (PVC) chamber, melted using RF induction and then ejected onto a copper die designed for casting 3 by 4 inches sheets with thickness of 3.3 mm.

Alloy 60 through Alloy 62 were cast into plates with thickness of 50 mm. These chemistries have been used for material processing through slab casting in an Indutherm VTC800V vacuum tilt casting machine. Alloys of designated compositions were weighed out in 3 kilogram charges using designated quantities of commercially-available ferroadditive powders of known composition and impurity content, and additional alloying elements as needed, according to the atomic ratios provided in Table 4 for each alloy. Alloy charges were placed in zirconia coated silica-based crucibles and loaded into the casting machine. Melting took place under vacuum using a 14 kHz RF induction coil. Charges were heated until fully molten, with a period of time between 45 seconds and 60 seconds after the last point at which solid constituents were observed, in order to provide superheat and ensure melt homogeneity. Melts were then poured into a water-cooled copper die to form laboratory cast slabs of approximately 50 mm thick that is in the thickness range for Thin Slab Casting process (FIG. 2) and 75 mm×100 mm in size.

TABLE 4

Chemical Composition of the Alloys

| Alloy | Fe | Cr | Ni | Mn | B | Si | Cu | C |
|---|---|---|---|---|---|---|---|---|
| Alloy 1 | 67.36 | 10.70 | 1.25 | 10.56 | 5.00 | 4.13 | 1.00 | — |
| Alloy 2 | 67.90 | 10.80 | 0.80 | 10.12 | 5.00 | 4.13 | 1.25 | — |
| Alloy 3 | 78.06 | — | 1.25 | 10.56 | 5.00 | 4.13 | 1.00 | — |
| Alloy 4 | 78.31 | — | 1.00 | 10.56 | 5.00 | 4.13 | 1.00 | — |
| Alloy 5 | 78.56 | — | 0.75 | 10.56 | 5.00 | 4.13 | 1.00 | — |
| Alloy 6 | 78.81 | — | 0.50 | 10.56 | 5.00 | 4.13 | 1.00 | — |
| Alloy 7 | 77.69 | — | — | 13.18 | 5.00 | 4.13 | — | — |
| Alloy 8 | 78.07 | — | — | 12.80 | 5.00 | 4.13 | — | — |
| Alloy 9 | 78.43 | — | — | 12.44 | 5.00 | 4.13 | — | — |
| Alloy 10 | 78.81 | — | — | 12.06 | 5.00 | 4.13 | — | — |
| Alloy 11 | 74.69 | 3.00 | — | 13.18 | 5.00 | 4.13 | — | — |
| Alloy 12 | 75.07 | 3.00 | — | 12.80 | 5.00 | 4.13 | — | — |
| Alloy 13 | 75.43 | 3.00 | — | 12.44 | 5.00 | 4.13 | — | — |
| Alloy 14 | 75.81 | 3.00 | — | 12.06 | 5.00 | 4.13 | — | — |
| Alloy 15 | 68.36 | 10.70 | 1.25 | 10.56 | 4.00 | 4.13 | 1.00 | — |
| Alloy 16 | 69.36 | 10.70 | 1.25 | 10.56 | 3.00 | 4.13 | 1.00 | — |
| Alloy 17 | 67.36 | 10.70 | 1.25 | 10.56 | 4.00 | 5.13 | 1.00 | — |
| Alloy 18 | 67.36 | 10.70 | 1.25 | 10.56 | 3.00 | 6.13 | 1.00 | — |
| Alloy 19 | 76.06 | — | 1.25 | 12.56 | 5.00 | 4.13 | 1.00 | — |
| Alloy 20 | 75.69 | — | — | 15.18 | 5.00 | 4.13 | — | — |
| Alloy 21 | 73.69 | 3.00 | — | 13.18 | 5.00 | 5.13 | — | — |
| Alloy 22 | 74.69 | 3.00 | — | 13.18 | 4.00 | 5.13 | — | — |
| Alloy 23 | 73.69 | 3.00 | — | 13.18 | 4.00 | 6.13 | — | — |
| Alloy 24 | 74.69 | 3.00 | — | 13.18 | 3.00 | 6.13 | — | — |
| Alloy 25 | 80.07 | — | — | 12.80 | 3.00 | 4.13 | — | — |
| Alloy 26 | 78.07 | — | — | 12.80 | 3.00 | 6.13 | — | — |
| Alloy 27 | 73.06 | 7.00 | 1.25 | 10.56 | 3.00 | 4.13 | 1.00 | — |
| Alloy 28 | 76.56 | 3.50 | 1.25 | 10.56 | 3.00 | 4.13 | 1.00 | — |
| Alloy 29 | 80.06 | — | 1.25 | 10.56 | 3.00 | 4.13 | 1.00 | — |
| Alloy 30 | 83.02 | — | 1.22 | 9.33 | 1.55 | 4.13 | 0.75 | — |
| Alloy 31 | 73.25 | — | 2.27 | 10.24 | 3.67 | 8.55 | 1.30 | 0.72 |
| Alloy 32 | 74.99 | 2.13 | 4.38 | 11.84 | 1.94 | 2.13 | 1.55 | 1.04 |
| Alloy 33 | 67.63 | 6.22 | 8.55 | 6.49 | 2.52 | 4.13 | 0.90 | 3.56 |
| Alloy 34 | 66.90 | 7.88 | 5.52 | 4.76 | 5.65 | 4.13 | 2.56 | 2.60 |
| Alloy 35 | 66.00 | 11.30 | 0.77 | 9.30 | 7.88 | 1.20 | 3.55 | — |
| Alloy 36 | 87.05 | — | 4.58 | 1.74 | 3.05 | 3.07 | 0.25 | 0.26 |
| Alloy 37 | 76.19 | 3.00 | — | 13.68 | 3.00 | 4.13 | — | — |
| Alloy 38 | 75.69 | 3.00 | — | 14.18 | 3.00 | 4.13 | — | — |
| Alloy 39 | 75.19 | 3.00 | — | 14.68 | 3.00 | 4.13 | — | — |
| Alloy 40 | 76.03 | 2.13 | 4.38 | 11.84 | 1.94 | 2.13 | 1.55 | — |
| Alloy 41 | 73.95 | 2.13 | 4.38 | 11.84 | 1.94 | 2.13 | 1.55 | 2.08 |
| Alloy 42 | 76.99 | 2.13 | 2.38 | 11.84 | 1.94 | 2.13 | 1.55 | 1.04 |
| Alloy 43 | 79.37 | 2.13 | 0.00 | 11.84 | 1.94 | 2.13 | 1.55 | 1.04 |
| Alloy 44 | 72.99 | 2.13 | 4.38 | 11.84 | 1.94 | 4.13 | 1.55 | 1.04 |
| Alloy 45 | 70.99 | 2.13 | 4.38 | 11.84 | 1.94 | 6.13 | 1.55 | 1.04 |
| Alloy 46 | 77.12 | — | 4.38 | 11.84 | 1.94 | 2.13 | 1.55 | 1.04 |
| Alloy 47 | 74.96 | — | — | 18.38 | 1.94 | 2.13 | 1.55 | 1.04 |
| Alloy 48 | 80.69 | 3.00 | — | 11.18 | 2.00 | 2.13 | — | 1.00 |
| Alloy 49 | 77.39 | 2.13 | 2.38 | 11.84 | 1.54 | 2.13 | 1.55 | 1.04 |
| Alloy 50 | 69.36 | 10.70 | 5.31 | 4.50 | 5.00 | 4.13 | 1.00 | — |
| Alloy 51 | 70.10 | 10.70 | 6.82 | 2.25 | 5.00 | 4.13 | 1.00 | — |
| Alloy 52 | 70.47 | 10.70 | 7.58 | 1.12 | 5.00 | 4.13 | 1.00 | — |
| Alloy 53 | 69.10 | 10.70 | 6.82 | 2.25 | 5.00 | 4.13 | 2.00 | — |
| Alloy 54 | 71.36 | 10.70 | 5.31 | 4.50 | 3.00 | 4.13 | 1.00 | — |
| Alloy 55 | 72.10 | 10.70 | 6.82 | 2.25 | 3.00 | 4.13 | 1.00 | — |
| Alloy 56 | 72.47 | 10.70 | 7.58 | 1.12 | 3.00 | 4.13 | 1.00 | — |
| Alloy 57 | 69.10 | 10.70 | 6.82 | 2.25 | 5.00 | 4.13 | 2.00 | — |
| Alloy 58 | 61.30 | 18.90 | 6.80 | 0.90 | 5.50 | 6.60 | — | — |
| Alloy 59 | 71.62 | 4.95 | 4.10 | 6.55 | 3.76 | 7.02 | 2.00 | — |
| Alloy 60 | 75.88 | 1.06 | 1.09 | 13.77 | 5.23 | 0.65 | 0.36 | 1.96 |
| Alloy 61 | 80.19 | — | 0.95 | 13.28 | 2.25 | 0.88 | 1.66 | 0.79 |
| Alloy 62 | 67.67 | 6.22 | 1.15 | 11.52 | 0.65 | 8.55 | 1.09 | — |
| Alloy 63 | 75.53 | 2.63 | 1.19 | 13.18 | — | 5.13 | 1.55 | 0.79 |
| Alloy 64 | 73.99 | 2.63 | 1.19 | 13.18 | — | 6.67 | 1.55 | 0.79 |
| Alloy 65 | 72.49 | 2.63 | 1.19 | 13.18 | — | 8.17 | 1.55 | 0.79 |

TABLE 4-continued

Chemical Composition of the Alloys

| Alloy | Fe | Cr | Ni | Mn | B | Si | Cu | C |
|---|---|---|---|---|---|---|---|---|
| Alloy 66 | 74.74 | 2.63 | 1.19 | 13.18 | — | 5.13 | 1.55 | 1.58 |
| Alloy 67 | 73.20 | 2.63 | 1.19 | 13.18 | — | 6.67 | 1.55 | 1.58 |
| Alloy 68 | 71.70 | 2.63 | 1.19 | 13.18 | — | 8.17 | 1.55 | 1.58 |
| Alloy 69 | 76.43 | 2.63 | 1.19 | 13.18 | — | 5.13 | 0.65 | 0.79 |
| Alloy 70 | 75.75 | 2.63 | 1.19 | 13.86 | — | 5.13 | 0.65 | 0.79 |
| Alloy 71 | 77.08 | 2.63 | 1.19 | 13.18 | — | 5.13 | — | 0.79 |
| Alloy 72 | 76.30 | 2.63 | 1.97 | 13.18 | — | 5.13 | — | 0.79 |
| Alloy 73 | 76.69 | 2.63 | 1.58 | 13.18 | — | 5.13 | — | 0.79 |
| Alloy 74 | 76.11 | 2.63 | 1.58 | 13.76 | — | 5.13 | — | 0.79 |

From the above it can be seen that the alloys herein that are susceptible to the transformations illustrated in FIG. 8 fall into the following groupings: (1) Fe/Cr/Ni/Mn/B/Si/Cu (alloys 1, 2, 15 to 18, 27 to 28, 35, 40, 50 to 57, 59, 62); (2) Fe/Ni/Mn/B/Si/Cu (alloys 3 to 6, 19, 29 to 30); (3) Fe/Mn/B/Si (alloys 7 to 10, 20, 25 to 26); (4) Fe/Cr/Mn/B/Si (alloys 11 to 14, 21 to 24, 37 to 39); Fe/Ni/Mn/B/Si/Cu/C (alloys 31, 36, 46 to 47, 61); (5) Fe/Cr/Ni/Mn/B/Si/Cu/C (alloys 32 to 34, 41 to 45, 49, 60); (6) Fe/Cr/Mn/B/Si/C (alloy 48); (7) Fe/Cr/Ni/Mn/B/Si (alloy 58); (8) Fe/Cr/Ni/Mn/Si/Cu/C (alloys 63 to 70); (9) Fe/Cr/Ni/Mn/Si/C (alloys 71 to 74).

From the above, one of skill in the art would understand the alloy composition herein to include the following four elements at the following indicated atomic percent: Fe (61.0 to 88.0 at. %); Si (0.5 to 9.0 at. %); Mn (0.9 to 19.0 at. %) and optionally B (0.0 at. % to 8.0 at. %). In addition, it can be appreciated that the following elements are optional and may be present at the indicated atomic percent: Ni (0.1 to 9.0 at. %); Cr (0.1 to 19.0 at. %); Cu (0.1 to 4.0 at. %); C (0.1 to 4.0 at. %). Impurities may be present include Al, Mo, Nb, S, 0, N, P, W, Co, Sn, Zr, Ti, Pd and V, which may be present up to 10 atomic percent.

Accordingly, the alloys may herein also be more broadly described as Fe based alloys (greater than 60.0 atomic percent) and further including B, Si and Mn. The alloys are capable of being solidified from the melt to form Modal Structure (Structure #1, FIG. 8), when at a thickness of greater than or equal to 2.0 mm, or which Modal Structure when formed at a cooling rate of less than or equal to 250 K/s, can preferably undergo Dynamic Nanophase Refinement which may then provide Homogenized Modal Structure (Structure #1a, FIG. 8). As indicated in FIG. 8, one may then, from such Homogenized Modal Structure, ultimately form High Strength Nanomodal Structure (Structure #3) with the indicted morphology and mechanical properties.

Alloy Properties

Thermal analysis was done on the as-solidified cast sheet samples on a NETZSCH DSC 404F3 PEGASUS V5 system. Differential thermal analysis (DTA) and differential scanning calorimetry (DSC) was performed in a range of the temperatures from room temperature to 1425° C. at a heating rate of 10° C./minute with samples protected from oxidation through the use of flowing ultrahigh purity argon. In Table 5, elevated temperature DTA results are shown indicating the melting behavior for the alloys. Note that there were no lower temperature crystallization peaks so metallic glass was not found to be present in the initial castings. As can be seen from the tabulated results in Table 5, the melting occurs in 1 to 4 stages with initial melting observed from ~1100° C. depending on alloy chemistry. Final melting temperature is >1425° C. in selected alloys. Liquidus temperature for these alloys is out of measurable range and not available (marked as "NA" in the Table 5). Variations in melting behavior may reflect a complex phase formation during chill surface processing of the alloys depending on their chemistry.

TABLE 5

Differential Thermal Analysis Data for Melting Behavior

| Alloy | Solidus Temperature [° C.] | Liquidus Temperature [° C.] | Melting Peak #1 [° C.] | Melting Peak #2 [° C.] | Melting Peak #3 [° C.] | Melting Peak #4 [° C.] |
|---|---|---|---|---|---|---|
| Alloy 1 | 1208 | 1343 | 1234 | 1283 | 1332 | — |
| Alloy 2 | 1206 | 1346 | 1236 | 1275 | 1335 | — |
| Alloy 3 | 1142 | 1370 | 1162 | 1354 | — | — |
| Alloy 4 | 1144 | 1370 | 1162 | 1353 | — | — |
| Alloy 5 | 1146 | 1371 | 1164 | 1356 | — | — |
| Alloy 6 | 1144 | 1369 | 1165 | 1354 | — | — |
| Alloy 7 | 1141 | 1365 | 1161 | 1350 | — | — |
| Alloy 8 | 1142 | 1364 | 1162 | 1349 | — | — |
| Alloy 9 | 1144 | 1371 | 1162 | 1357 | — | — |
| Alloy 10 | 1143 | 1370 | 1163 | 1354 | — | — |
| Alloy 11 | 1158 | 1358 | 1179 | 1342 | — | — |
| Alloy 12 | 1160 | 1364 | 1184 | 1344 | — | — |
| Alloy 13 | 1162 | 1363 | 1182 | 1349 | — | — |
| Alloy 14 | 1159 | 1365 | 1185 | 1350 | — | — |
| Alloy 15 | 1204 | 1371 | 1231 | 1294 | 1355 | — |
| Alloy 16 | 1208 | 1392 | 1230 | 1290 | 1377 | — |
| Alloy 17 | 1206 | 1360 | 1232 | 1273 | 1346 | — |
| Alloy 18 | 1209 | 1376 | 1229 | 1358 | 1372 | — |
| Alloy 19 | 1143 | 1360 | 1159 | 1344 | — | — |
| Alloy 20 | 1143 | 1356 | 1160 | 1342 | — | — |
| Alloy 21 | 1161 | 1356 | 1183 | 1338 | 1351 | — |
| Alloy 22 | 1161 | 1380 | 1182 | 1342 | 1361 | 1375 |
| Alloy 23 | 1158 | 1364 | 1178 | 1334 | 1351 | |
| Alloy 24 | 1161 | 1391 | 1184 | 1334 | 1375 | 1386 |
| Alloy 25 | 1144 | NA | 1159 | 1392 | — | — |
| Alloy 26 | 1137 | 1383 | 1156 | 1371 | — | — |
| Alloy 27 | 1186 | 1392 | 1210 | 1335 | 1377 | — |
| Alloy 28 | 1161 | NA | 1185 | 1384 | — | — |
| Alloy 29 | 1141 | NA | 1158 | 1392 | — | — |
| Alloy 30 | 1147 | NA | 1158 | — | — | — |
| Alloy 31 | 1102 | 1337 | 1136 | 1319 | — | — |
| Alloy 32 | 1131 | 1398 | 1151 | 1389 | — | — |
| Alloy 33 | 1100 | 1339 | 1133 | 1328 | — | — |
| Alloy 34 | 1116 | 1281 | 1137 | 1175 | 1269 | — |
| Alloy 35 | 1206 | 1286 | 1241 | 1273 | — | — |
| Alloy 36 | 1147 | NA | 1160 | — | — | — |
| Alloy 37 | 1157 | 1386 | 1175 | 1374 | — | — |
| Alloy 38 | 1158 | 1382 | 1176 | 1372 | — | — |
| Alloy 39 | 1156 | 1382 | 1174 | 1370 | — | — |
| Alloy 40 | 1145 | 1410 | 1166 | 1402 | — | — |
| Alloy 41 | 1125 | 1402 | 1147 | 1392 | — | — |
| Alloy 42 | 1136 | 1402 | 1155 | 1394 | — | — |
| Alloy 43 | 1159 | NA | 1174 | 1420 | — | — |
| Alloy 44 | 1141 | 1405 | 1163 | 1392 | — | — |
| Alloy 45 | 1131 | 1383 | 1155 | 1370 | — | — |
| Alloy 46 | 1117 | 1402 | 1134 | 1395 | — | — |
| Alloy 47 | 1141 | 1411 | 1149 | 1400 | 1407 | — |
| Alloy 48 | 1168 | N/A | 1184 | N/A | — | — |
| Alloy 49 | 1156 | N/A | 1173 | N/A | — | — |
| Alloy 50 | 1185 | 1342 | 1225 | 1331 | — | — |
| Alloy 51 | 1185 | 1350 | 1226 | 1333 | — | — |
| Alloy 52 | 1191 | 1354 | 1228 | 1343 | — | — |
| Alloy 53 | 1195 | 1350 | 1232 | 1331 | — | — |
| Alloy 54 | 1200 | 1392 | 1228 | 1380 | — | — |
| Alloy 55 | 1209 | NA | 1237 | 1392 | — | — |
| Alloy 56 | 1207 | NA | 1239 | 1296 | — | — |
| Alloy 57 | 1197 | 1352 | 1237 | 1338 | — | — |
| Alloy 58 | 1231 | 1351 | 1275 | 1334 | — | — |
| Alloy 59 | 1169 | 1363 | 1197 | 1348 | 1358 | — |

TABLE 5-continued

Differential Thermal Analysis Data for Melting Behavior

| Alloy | Solidus Temperature [° C.] | Liquidus Temperature [° C.] | Melting Peak #1 [° C.] | Melting Peak #2 [° C.] | Melting Peak #3 [° C.] | Melting Peak #4 [° C.] |
|---|---|---|---|---|---|---|
| Alloy 60 | 1131 | 1376 | 1154 | — | — | 1359 |
| Alloy 61 | 1131 | 1376 | 1154 | 1359 | — | — |
| Alloy 62 | 1146 | 1439 | 1158 | 1430 | 1436 | — |

The density of the alloys was measured on arc-melt ingots using the Archimedes method in a specially constructed balance allowing weighing in both air and distilled water. The density of each alloy is tabulated in Table 6 and was found to vary from 7.55 g/cm$^3$ to 7.89 g/cm$^3$. The accuracy of this technique is ±0.01 g/cm$^3$.

TABLE 6

Density of Alloys (g/cm$^3$)

| Density Alloy | Density [g/cm$^3$] |
|---|---|
| Alloy 1 | 7.66 |
| Alloy 2 | 7.66 |
| Alloy 3 | 7.70 |
| Alloy 4 | 7.69 |
| Alloy 5 | 7.66 |
| Alloy 6 | 7.67 |
| Alloy 7 | 7.73 |
| Alloy 8 | 7.74 |
| Alloy 9 | 7.73 |
| Alloy 10 | 7.72 |
| Alloy 11 | 7.74 |
| Alloy 12 | 7.74 |
| Alloy 13 | 7.73 |
| Alloy 14 | 7.73 |
| Alloy 15 | 7.69 |
| Alloy 16 | 7.72 |
| Alloy 17 | 7.66 |
| Alloy 18 | 7.64 |
| Alloy 19 | 7.74 |
| Alloy 20 | 7.74 |
| Alloy 21 | 7.69 |
| Alloy 22 | 7.71 |
| Alloy 23 | 7.67 |
| Alloy 24 | 7.70 |
| Alloy 25 | 7.77 |
| Alloy 26 | 7.70 |
| Alloy 27 | 7.75 |
| Alloy 28 | 7.75 |
| Alloy 29 | 7.73 |
| Alloy 30 | 7.70 |
| Alloy 31 | 7.65 |
| Alloy 32 | 7.73 |
| Alloy 33 | 7.80 |
| Alloy 34 | 7.69 |
| Alloy 35 | 7.69 |
| Alloy 36 | 7.72 |
| Alloy 37 | 7.74 |
| Alloy 38 | 7.78 |
| Alloy 39 | 7.76 |
| Alloy 40 | 7.89 |
| Alloy 41 | 7.83 |
| Alloy 42 | 7.85 |
| Alloy 43 | 7.86 |
| Alloy 44 | 7.79 |
| Alloy 45 | 7.78 |
| Alloy 46 | 7.80 |
| Alloy 47 | 7.85 |
| Alloy 48 | 7.85 |
| Alloy 49 | 7.87 |
| Alloy 50 | 7.69 |
| Alloy 51 | 7.73 |
| Alloy 52 | 7.74 |

TABLE 6-continued

| Density of Alloys (g/cm³) | |
|---|---|
| Density Alloy | Density [g/cm³] |
| Alloy 53 | 7.73 |
| Alloy 54 | 7.75 |
| Alloy 55 | 7.77 |
| Alloy 56 | 7.79 |
| Alloy 57 | 7.73 |
| Alloy 58 | 7.58 |
| Alloy 59 | 7.62 |
| Alloy 60 | 7.80 |
| Alloy 61 | 7.89 |
| Alloy 62 | 7.55 |

All cast plates with initial thickness of 3.3 mm (Alloy 1 through Alloy 59) were hot rolled at a temperature that was generally 50° C. below the solidus temperature within a 25° C. range. During the hot rolling step, Dynamic Nanophase Refinement (Mechanism #0, FIG. 8) would be expected to occur with the targeted chemistries in Table 4. The rolls for the mill were held at a constant spacing for all samples rolled, such that the rolls were touching with minimal force. Samples experienced a hot rolling reduction that varied between 32% and 45% during the process. After hot rolling, the samples were heat treated according to the parameters listed in Table 7. The heat treatment was used since some alloys did not form Structure #2 (Nanomodal Structure) directly from Structure #1a (Homogenized Modal Structure) and in these cases, additional heat treatment activated Mechanism #1 (Static Nanophase Refinement).

TABLE 7

| Heat Treatment Parameters | | | |
|---|---|---|---|
| Heat Treatment | Temperature [° C.] | Time [min] | Cooling |
| HT1 | 850 | 360 | 0.75° C./min to <500° C. then Air |
| HT2 | 950 | 360 | Air |
| HT3 | 1050 | 120 | Air |
| HT4 | 1075 | 120 | Air |
| HT5 | 1100 | 120 | Air |
| HT6 | 1150 | 120 | Air |
| HT7 | 700 | 60 | Air |
| HT8 | 700 | No dwell time | 1° C./min to <500° C. then Air |
| HT9 | 850 | 60 | Air |
| HT10 | 950 | 60 | Air |

The tensile specimens were cut from the hot rolled and heat treated sheets using wire electrical discharge machining (EDM). The tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture. In Table 8, a summary of the tensile test results including, yield stress, ultimate tensile strength, and total elongation are shown for the hot rolled sheets after heat treatment. The mechanical characteristic values depend on alloy chemistry and processing condition as will be discussed herein. As can be seen the ultimate tensile strength values vary from 431 to 1612 MPa. The tensile elongation varies from 2.4 to 64.7%. Yield stress is measured in a range from 212 MPa to 966 MPa. During tensile testing, the samples exhibiting Structure #2 (Nanomodal Structure) undergo Mechanism #2 (Dynamic Nanophase Strengthening), to form Structure #3 (High Strength Nanomodal Structure).

TABLE 8

| Tensile Properties of Alloys after Hot Rolling and Heat Treatment | | | | |
|---|---|---|---|---|
| Alloy | Standard Heat Treatment | Yield Stress (MPa) | Ultimate Tensile Strength (MPa) | Tensile Elongation (%) |
| Alloy 1 | HT1 | 587 | 1129 | 18.00 |
| | | 510 | 1123 | 17.92 |
| | | 492 | 1096 | 16.89 |
| | | 536 | 966 | 13.71 |
| | | 532 | 1052 | 16.76 |
| | | 526 | 994 | 14.87 |
| | | 556 | 921 | 11.15 |
| | | 515 | 977 | 12.67 |
| | | 548 | 935 | 11.15 |
| | HT2 | 515 | 1084 | 18.79 |
| | | 504 | 1155 | 21.85 |
| | | 501 | 1147 | 21.15 |
| | | 474 | 1162 | 25.95 |
| | | 450 | 1166 | 26.41 |
| | | 535 | 1066 | 20.59 |
| | | 511 | 888 | 11.64 |
| | | 492 | 1061 | 20.76 |
| | HT5 | 482 | 1132 | 21.13 |
| | | 457 | 1174 | 25.06 |
| | | 419 | 1169 | 27.67 |
| | | 433 | 1003 | 17.96 |
| | | 423 | 1089 | 21.85 |
| | | 444 | 1059 | 20.57 |
| | | 472 | 1177 | 32.50 |
| | | 457 | 1160 | 31.60 |
| | | 480 | 1176 | 31.46 |
| Alloy 2 | HT1 | 507 | 1082 | 13.63 |
| | | 496 | 1129 | 15.20 |
| | | 483 | 1119 | 14.64 |
| | HT2 | 475 | 1241 | 21.93 |
| | | 483 | 1248 | 25.24 |
| | | 482 | 1230 | 21.00 |
| | HT5 | 395 | 1160 | 28.83 |
| | | 395 | 1122 | 25.70 |
| | | 383 | 1149 | 27.60 |
| Alloy 3 | HT1 | 383 | 1555 | 7.20 |
| | | 356 | 1384 | 8.63 |
| | | 340 | 1161 | 6.24 |
| | | 311 | 1181 | 6.45 |
| | HT2 | 317 | 936 | 4.93 |
| | | 299 | 927 | 4.56 |
| | | 315 | 891 | 4.40 |
| | HT4 | 322 | 1314 | 8.10 |
| | | 333 | 1364 | 8.82 |
| Alloy 4 | HT2 | 268 | 1065 | 4.28 |
| | | 268 | 1040 | 4.43 |
| | HT4 | 351 | 1559 | 8.73 |
| | | 345 | 1456 | 6.23 |
| Alloy 5 | HT1 | 399 | 1298 | 4.45 |
| | | 336 | 1242 | 4.55 |
| | HT2 | 375 | 1247 | 4.44 |
| | | 286 | 1025 | 3.56 |
| | HT4 | 519 | 1386 | 7.99 |
| | | 566 | 1394 | 8.23 |
| Alloy 6 | HT1 | 392 | 1285 | 3.31 |
| | | 441 | 1536 | 5.94 |
| | | 559 | 1575 | 6.83 |
| | HT2 | 312 | 1147 | 3.38 |
| | | 455 | 1290 | 3.74 |
| | HT4 | 456 | 1612 | 6.36 |
| | | 512 | 1575 | 7.37 |
| Alloy 7 | HT1 | 420 | 994 | 8.41 |
| | | 431 | 917 | 6.99 |
| | | 429 | 1131 | 10.29 |
| | HT2 | 370 | 917 | 7.65 |
| | | 408 | 1009 | 8.55 |
| | | 396 | 1120 | 10.73 |

TABLE 8-continued

Tensile Properties of Alloys after Hot Rolling and Heat Treatment

| Alloy | Standard Heat Treatment | Yield Stress (MPa) | Ultimate Tensile Strength (MPa) | Tensile Elongation (%) |
|---|---|---|---|---|
| | HT4 | 416 | 1055 | 9.06 |
| | | 411 | 1160 | 10.80 |
| | | 410 | 1149 | 10.74 |
| Alloy 8 | HT1 | 440 | 987 | 6.62 |
| | | 417 | 1037 | 8.34 |
| | HT2 | 439 | 1248 | 8.81 |
| | | 482 | 1139 | 7.99 |
| | HT4 | 371 | 1314 | 13.69 |
| | | 378 | 1404 | 19.03 |
| Alloy 9 | HT1 | 387 | 1003 | 6.59 |
| | | 381 | 880 | 5.07 |
| | | 380 | 1038 | 7.08 |
| | HT2 | 339 | 1411 | 13.29 |
| | HT4 | 358 | 1138 | 7.97 |
| | | 358 | 1162 | 8.48 |
| Alloy 10 | HT1 | 329 | 1258 | 6.74 |
| | | 287 | 1099 | 5.44 |
| | | 473 | 1361 | 6.67 |
| | HT2 | 327 | 1415 | 14.25 |
| | HT4 | 242 | 714 | 3.04 |
| | | 300 | 1120 | 5.62 |
| | | 352 | 1395 | 12.62 |
| Alloy 11 | HT1 | 455 | 1188 | 13.95 |
| | | 451 | 1245 | 15.14 |
| | | 531 | 1287 | 16.64 |
| | HT2 | 438 | 1220 | 15.54 |
| | | 451 | 1211 | 14.54 |
| | HT5 | 359 | 1213 | 21.94 |
| | | 345 | 1152 | 22.12 |
| | | 344 | 915 | 10.02 |
| | HT4 | 453 | 1164 | 14.08 |
| | | 444 | 1150 | 13.63 |
| | | 442 | 1232 | 16.19 |
| Alloy 12 | HT1 | 435 | 1231 | 12.59 |
| | | 492 | 1203 | 11.33 |
| | HT2 | 427 | 1242 | 12.77 |
| | | 391 | 1196 | 11.95 |
| | | 408 | 1135 | 10.59 |
| | HT4 | 403 | 1256 | 13.78 |
| | | 400 | 1307 | 17.73 |
| | | 392 | 1233 | 14.80 |
| | | 387 | 1246 | 14.73 |
| Alloy 13 | HT1 | 403 | 1218 | 10.31 |
| | | 443 | 1228 | 10.91 |
| | | 438 | 1326 | 13.19 |
| | | 384 | 1251 | 11.50 |
| | | 405 | 1264 | 11.69 |
| | | 406 | 1279 | 12.20 |
| | HT2 | 340 | 1288 | 18.27 |
| | | 345 | 1281 | 17.32 |
| | HT4 | 396 | 1218 | 10.62 |
| | | 396 | 1310 | 12.36 |
| | | 389 | 1317 | 12.63 |
| Alloy 14 | HT1 | 393 | 1413 | 16.19 |
| | | 359 | 1113 | 7.38 |
| | | 374 | 1386 | 12.24 |
| | | 358 | 1175 | 7.86 |
| | | 359 | 1240 | 8.82 |
| | | 383 | 1350 | 11.31 |
| | HT2 | 375 | 1440 | 15.97 |
| | | 353 | 1227 | 8.78 |
| | | 371 | 1383 | 12.20 |
| | HT4 | 359 | 1396 | 11.54 |
| | | 373 | 1442 | 13.60 |
| | | 378 | 1357 | 10.86 |
| Alloy 15 | HT1 | 485 | 1183 | 23.03 |
| | | 497 | 1106 | 19.48 |
| | | 457 | 1128 | 21.01 |
| | HT2 | 440 | 1181 | 24.89 |
| | | 467 | 964 | 15.48 |
| | | 449 | 1182 | 24.86 |
| | HT5 | 394 | 1084 | 29.34 |
| | | 419 | 1093 | 29.56 |
| | | 403 | 1098 | 30.94 |

TABLE 8-continued

Tensile Properties of Alloys after Hot Rolling and Heat Treatment

| Alloy | Standard Heat Treatment | Yield Stress (MPa) | Ultimate Tensile Strength (MPa) | Tensile Elongation (%) |
|---|---|---|---|---|
| Alloy 16 | HT1 | 429 | 1177 | 30.52 |
| | | 429 | 1176 | 32.16 |
| | | 419 | 1173 | 30.55 |
| | HT2 | 441 | 1174 | 36.16 |
| | | 425 | 1196 | 37.96 |
| | HT5 | 387 | 1078 | 27.56 |
| | | 380 | 1082 | 26.75 |
| | | 381 | 1079 | 36.01 |
| Alloy 17 | HT1 | 511 | 1090 | 17.93 |
| | | 490 | 1151 | 20.79 |
| | | 494 | 1082 | 17.81 |
| | HT2 | 497 | 1243 | 28.74 |
| | | 490 | 1196 | 24.40 |
| | | 489 | 1240 | 27.87 |
| | HT5 | 450 | 1191 | 29.40 |
| Alloy 18 | HT1 | 497 | 1234 | 32.33 |
| | | 501 | 1098 | 20.74 |
| | | 514 | 1210 | 28.43 |
| | HT2 | 450 | 1183 | 26.85 |
| | | 446 | 1137 | 24.27 |
| | | 452 | 1237 | 34.93 |
| | HT5 | 420 | 1154 | 31.71 |
| | | 418 | 1134 | 37.00 |
| | | 411 | 1149 | 35.46 |
| Alloy 19 | HT1 | 479 | 1189 | 17.51 |
| | | 485 | 1262 | 21.72 |
| | | 477 | 1244 | 20.86 |
| | HT2 | 422 | 1166 | 17.81 |
| | | 420 | 1095 | 15.43 |
| | | 416 | 1105 | 15.72 |
| | HT4 | 400 | 1147 | 16.08 |
| | | 378 | 1171 | 16.48 |
| | | 401 | 1134 | 15.47 |
| Alloy 20 | HT1 | 494 | 1050 | 14.02 |
| | | 494 | 1104 | 16.67 |
| | | 487 | 1156 | 19.50 |
| | HT2 | 498 | 1145 | 22.27 |
| | HT4 | 479 | 1133 | 18.10 |
| | | 459 | 1108 | 18.33 |
| | | 500 | 1139 | 18.11 |
| Alloy 21 | HT1 | 520 | 1162 | 13.56 |
| | | 500 | 929 | 7.89 |
| | | 512 | 1016 | 10.24 |
| | HT2 | 431 | 1212 | 18.72 |
| | | 418 | 1236 | 25.33 |
| | | 426 | 1256 | 23.06 |
| | HT4 | 497 | 1129 | 12.44 |
| | | 503 | 1183 | 14.58 |
| | | 455 | 1107 | 12.66 |
| Alloy 22 | HT1 | 437 | 1312 | 19.87 |
| | | 433 | 1176 | 14.70 |
| | | 459 | 1276 | 17.98 |
| | HT2 | 379 | 1202 | 25.12 |
| | | 369 | 1193 | 26.43 |
| | HT4 | 403 | 935 | 9.89 |
| | | 414 | 1234 | 19.85 |
| | | 415 | 1167 | 16.15 |
| Alloy 23 | HT1 | 417 | 1190 | 16.81 |
| | | 417 | 1185 | 16.65 |
| | | 416 | 1176 | 17.31 |
| | HT2 | 365 | 863 | 9.27 |
| | | 387 | 1172 | 17.50 |
| | HT4 | 395 | 1174 | 17.12 |
| | | 411 | 1285 | 25.99 |
| | | 412 | 1271 | 23.32 |
| Alloy 24 | HT1 | 452 | 1062 | 12.63 |
| | | 458 | 1290 | 18.88 |
| | | 483 | 1095 | 13.13 |
| | | 470 | 1075 | 12.05 |
| | | 483 | 1132 | 13.49 |
| | HT2 | 399 | 1089 | 13.88 |
| | | 403 | 1170 | 15.47 |
| | | 433 | 1139 | 15.24 |

TABLE 8-continued

Tensile Properties of Alloys after Hot Rolling and Heat Treatment

| Alloy | Standard Heat Treatment | Yield Stress (MPa) | Ultimate Tensile Strength (MPa) | Tensile Elongation (%) |
|---|---|---|---|---|
| | HT4 | 428 | 1319 | 27.92 |
| | | 417 | 1243 | 18.35 |
| | | 438 | 1226 | 17.54 |
| | | 448 | 1189 | 16.14 |
| | | 457 | 1065 | 12.86 |
| Alloy 25 | HT1 | 315 | 1372 | 18.80 |
| | | 329 | 1306 | 11.41 |
| | | 309 | 1368 | 18.74 |
| | HT2 | 292 | 1271 | 18.63 |
| | | 288 | 1262 | 17.52 |
| | HT4 | 294 | 1291 | 20.29 |
| | | 299 | 1289 | 18.02 |
| | | 312 | 1312 | 16.62 |
| Alloy 26 | HT1 | 337 | 1181 | 11.09 |
| | | 343 | 1258 | 13.03 |
| | HT2 | 349 | 1366 | 19.16 |
| | | 308 | 1267 | 20.71 |
| | | 326 | 1307 | 20.63 |
| | HT4 | 316 | 1236 | 19.47 |
| | | 342 | 1315 | 18.72 |
| | | 338 | 1283 | 20.04 |
| Alloy 27 | HT1 | 412 | 1318 | 24.31 |
| | | 396 | 1210 | 17.01 |
| | HT2 | 346 | 1216 | 23.01 |
| | | 365 | 1216 | 23.12 |
| | | 346 | 1213 | 23.60 |
| | HT5 | 324 | 1190 | 22.81 |
| | | 335 | 1188 | 23.56 |
| | | 343 | 1202 | 23.80 |
| Alloy 28 | HT1 | 336 | 1360 | 19.08 |
| | HT2 | 334 | 1323 | 17.21 |
| | HT4 | 308 | 1395 | 19.12 |
| Alloy 29 | HT1 | 318 | 1008 | 3.05 |
| | | 616 | 1423 | 12.33 |
| | | 455 | 1442 | 13.00 |
| | HT2 | 535 | 1432 | 12.35 |
| | | 469 | 1345 | 11.07 |
| | HT4 | 448 | 1444 | 12.49 |
| | | 867 | 1455 | 12.64 |
| | | 424 | 1427 | 11.89 |
| Alloy 30 | HT1 | 536 | 1443 | 9.98 |
| | | 540 | 1427 | 11.27 |
| | HT2 | 550 | 1440 | 11.07 |
| | | 508 | 1378 | 6.57 |
| | | 533 | 1347 | 11.67 |
| | HT4 | 568 | 1298 | 12.42 |
| | | 577 | 1344 | 9.91 |
| | | 514 | 1155 | 2.96 |
| Alloy 31 | HT1 | 514 | 746 | 7.28 |
| | | 517 | 757 | 7.95 |
| | | 496 | 761 | 8.10 |
| | HT2 | 411 | 779 | 9.22 |
| | | 460 | 764 | 8.66 |
| | | 444 | 830 | 9.77 |
| | HT3 | 416 | 978 | 11.70 |
| | | 421 | 1110 | 13.46 |
| | | 419 | 1017 | 11.89 |
| Alloy 32 | HT1 | 292 | 807 | 43.09 |
| | | 285 | 800 | 54.98 |
| | HT2 | 277 | 796 | 61.80 |
| | | 276 | 789 | 52.25 |
| | | 283 | 793 | 59.13 |
| | | 291 | 796 | 55.93 |
| | | 274 | 782 | 44.39 |
| | HT4 | 287 | 785 | 54.25 |
| | | 276 | 775 | 49.61 |
| Alloy 33 | HT1 | 475 | 829 | 6.93 |
| | | 485 | 784 | 4.01 |
| | | 484 | 796 | 5.18 |
| | | 445 | 731 | 2.41 |
| | HT2 | 433 | 811 | 10.03 |
| | | 428 | 837 | 12.61 |

TABLE 8-continued

Tensile Properties of Alloys after Hot Rolling and Heat Treatment

| Alloy | Standard Heat Treatment | Yield Stress (MPa) | Ultimate Tensile Strength (MPa) | Tensile Elongation (%) |
|---|---|---|---|---|
| | HT3 | 411 | 843 | 18.30 |
| | | 421 | 757 | 8.20 |
| | | 417 | 835 | 15.33 |
| Alloy 34 | HT1 | 473 | 960 | 3.70 |
| | | 445 | 977 | 3.37 |
| | | 450 | 1088 | 4.00 |
| | HT2 | 509 | 945 | 10.97 |
| | | 522 | 960 | 11.28 |
| | | 518 | 967 | 11.81 |
| | HT3 | 460 | 939 | 13.08 |
| | | 506 | 942 | 12.62 |
| | | 499 | 950 | 15.10 |
| Alloy 35 | HT1 | 495 | 952 | 7.70 |
| | | 543 | 1041 | 8.99 |
| | | 534 | 1019 | 7.64 |
| | HT2 | 447 | 875 | 8.72 |
| | | 426 | 921 | 11.15 |
| | | 419 | 873 | 9.61 |
| | HT5 | 362 | 977 | 21.74 |
| | | 385 | 886 | 13.47 |
| Alloy 36 | HT1 | 842 | 1178 | 11.66 |
| | | 847 | 1180 | 9.07 |
| | HT2 | 702 | 1147 | 10.33 |
| | | 796 | 1123 | 6.74 |
| | | 766 | 1097 | 9.21 |
| | HT4 | 865 | 1111 | 10.40 |
| | | 831 | 1135 | 10.99 |
| | | 822 | 1094 | 8.80 |
| Alloy 37 | HT1 | 408 | 1235 | 21.77 |
| | HT2 | 376 | 824 | 8.10 |
| | | 400 | 972 | 11.44 |
| | HT4 | 380 | 1166 | 30.86 |
| | | 357 | 859 | 10.53 |
| Alloy 38 | HT1 | 423 | 1198 | 20.93 |
| | HT2 | 398 | 1157 | 26.98 |
| | | 399 | 1169 | 33.59 |
| | | 402 | 1195 | 26.61 |
| | HT4 | 424 | 1186 | 28.79 |
| | | 416 | 975 | 13.69 |
| | | 412 | 1150 | 24.89 |
| Alloy 39 | HT1 | 430 | 1165 | 25.35 |
| | | 432 | 1258 | 29.42 |
| | | 424 | 1212 | 26.30 |
| | HT2 | 434 | 1177 | 23.50 |
| | | 452 | 1210 | 25.87 |
| | HT4 | 428 | 962 | 14.58 |
| | | 446 | 1137 | 23.94 |
| | | 443 | 1125 | 22.41 |
| Alloy 40 | HT1 | 257 | 836 | 54.29 |
| | | 264 | 839 | 55.36 |
| | HT2 | 250 | 812 | 55.82 |
| | | 244 | 786 | 44.32 |
| | HT4 | 212 | 770 | 55.52 |
| Alloy 41 | HT1 | 305 | 687 | 13.87 |
| | | 314 | 756 | 21.43 |
| | | 346 | 767 | 18.89 |
| Alloy 42 | HT1 | 338 | 1008 | 40.53 |
| | | 338 | 1043 | 46.26 |
| | | 347 | 1069 | 57.96 |
| | HT2 | 288 | 895 | 50.99 |
| | HT4 | 287 | 953 | 36.65 |
| | | 294 | 939 | 40.89 |
| Alloy 43 | HT1 | 364 | 1022 | 17.05 |
| | | 393 | 1042 | 17.92 |
| Alloy 44 | HT1 | 326 | 845 | 51.63 |
| | | 327 | 846 | 55.00 |
| | HT4 | 294 | 797 | 40.96 |
| | | 299 | 813 | 41.09 |
| Alloy 45 | HT2 | 351 | 867 | 60.41 |
| | | 362 | 884 | 64.71 |
| | HT4 | 349 | 911 | 41.02 |
| | | 338 | 906 | 44.48 |

TABLE 8-continued

Tensile Properties of Alloys after Hot Rolling and Heat Treatment

| Alloy | Standard Heat Treatment | Yield Stress (MPa) | Ultimate Tensile Strength (MPa) | Tensile Elongation (%) |
|---|---|---|---|---|
| Alloy 46 | HT1 | 573 | 906 | 38.35 |
| | | 275 | 824 | 56.49 |
| | HT2 | 374 | 787 | 54.55 |
| | | 261 | 779 | 61.36 |
| | HT3 | 233 | 794 | 61.56 |
| | | 249 | 800 | 61.35 |
| Alloy 47 | HT1 | 327 | 876 | 35.79 |
| | | 334 | 896 | 51.21 |
| | | 327 | 901 | 52.14 |
| Alloy 48 | HT1 | 324 | 950 | 4.50 |
| | | 352 | 1357 | 8.25 |
| | HT2 | 366 | 1155 | 5.40 |
| | HT5 | 380 | 900 | 8.71 |
| | | 354 | 837 | 7.56 |
| | | 362 | 900 | 7.75 |
| Alloy 49 | HT1 | 354 | 1052 | 45.89 |
| | HT2 | 313 | 1048 | 46.05 |
| | | 320 | 1055 | 48.05 |
| | HT5 | 288 | 848 | 34.01 |
| Alloy 50 | HT1 | 905 | 1443 | 4.35 |
| | | 963 | 1441 | 5.40 |
| | | 902 | 1432 | 4.90 |
| | HT5 | 384 | 1297 | 17.17 |
| | | 560 | 1294 | 8.75 |
| | | 411 | 1267 | 16.47 |
| Alloy 51 | HT1 | 341 | 1414 | 12.24 |
| | | 346 | 1441 | 13.76 |
| | | 331 | 1457 | 14.28 |
| | HT2 | 845 | 1432 | 5.78 |
| | | 864 | 1427 | 4.19 |
| | | 857 | 1432 | 5.28 |
| | HT5 | 376 | 1063 | 17.82 |
| | | 378 | 1212 | 27.99 |
| | | 372 | 1197 | 19.81 |
| Alloy 52 | HT1 | 314 | 1063 | 3.83 |
| | | 339 | 1284 | 5.13 |
| | | 304 | 1392 | 9.57 |
| | HT2 | 428 | 1025 | 15.50 |
| | | 430 | 1043 | 16.73 |
| | | 432 | 874 | 11.38 |
| | HT5 | 372 | 987 | 17.10 |
| | | 385 | 1149 | 21.61 |
| | | 423 | 1024 | 20.19 |
| Alloy 53 | HT1 | 836 | 1498 | 3.88 |
| | | 731 | 1485 | 3.98 |
| | | 803 | 1486 | 4.87 |
| | HT2 | 384 | 1330 | 17.56 |
| | | 368 | 1169 | 11.32 |
| | | 364 | 1141 | 10.76 |
| | HT5 | 359 | 1104 | 27.00 |
| Alloy 54 | HT1 | 462 | 1387 | 9.43 |
| | | 439 | 1383 | 8.17 |
| | | 455 | 1372 | 10.02 |
| | HT2 | 403 | 1358 | 22.43 |
| | | 400 | 1310 | 21.54 |
| | | 408 | 1324 | 21.73 |
| | HT5 | 367 | 1060 | 27.90 |
| | | 363 | 1069 | 22.73 |
| | | 349 | 1098 | 21.71 |
| Alloy 55 | HT1 | 841 | 1385 | 8.16 |
| | | 842 | 1377 | 7.45 |
| | | 837 | 1383 | 7.21 |
| | HT2 | 288 | 1345 | 14.92 |
| | | 299 | 1364 | 14.51 |
| | HT5 | 348 | 918 | 18.74 |
| | | 346 | 1013 | 30.43 |
| | | 349 | 966 | 24.05 |
| Alloy 56 | HT1 | 934 | 1387 | 7.84 |
| | | 943 | 1380 | 7.44 |
| | | 966 | 1380 | 7.43 |
| | HT2 | 717 | 1508 | 9.46 |
| | | 657 | 1490 | 9.68 |

TABLE 8-continued

Tensile Properties of Alloys after Hot Rolling and Heat Treatment

| Alloy | Standard Heat Treatment | Yield Stress (MPa) | Ultimate Tensile Strength (MPa) | Tensile Elongation (%) |
|---|---|---|---|---|
| | HT5 | 618 | 1237 | 8.82 |
| | | 621 | 1272 | 10.61 |
| | | 615 | 1253 | 9.86 |
| Alloy 57 | HT1 | 813 | 1465 | 3.21 |
| | | 800 | 1463 | 4.65 |
| | | 803 | 1460 | 5.27 |
| | HT2 | 374 | 1261 | 17.92 |
| | | 378 | 1312 | 18.61 |
| | | 375 | 1296 | 18.47 |
| | HT5 | 376 | 854 | 18.85 |
| | | 381 | 915 | 27.27 |
| | | 366 | 836 | 17.06 |
| Alloy 58 | HT7 | 389 | 1168 | 20.90 |
| | | 442 | 1174 | 20.68 |
| | | 456 | 1147 | 19.71 |
| | HT8 | 438 | 1096 | 18.20 |
| | | 427 | 1180 | 21.43 |
| | | 451 | 1192 | 22.01 |
| | | 418 | 1152 | 21.06 |
| | HT9 | 408 | 1219 | 22.51 |
| | | 457 | 1197 | 21.22 |
| | | 448 | 1174 | 20.17 |
| Alloy 59 | HT8 | 383 | 1540 | 12.06 |
| | | 347 | 1393 | 9.27 |
| | | 317 | 1554 | 12.95 |
| | | 339 | 1370 | 9.48 |
| | HT10 | 331 | 431 | 4.10 |
| | | 346 | 995 | 8.58 |
| | | 353 | 1232 | 10.14 |
| | | 352 | 933 | 7.81 |
| | | 357 | 879 | 7.51 |
| | | 384 | 1449 | 18.35 |
| | | 362 | 1341 | 13.52 |
| | | 359 | 1440 | 22.96 |
| | | 352 | 1122 | 11.59 |
| | | 314 | 1419 | 14.75 |
| | | 354 | 1439 | 16.54 |

All cast plates with initial thickness of 50 mm (Alloy 60 through 62) were subjected to hot rolling at the temperature of 1075 to 1100° C. depending on alloy solidus temperature. Rolling was done on a Fenn Model 061 single stage rolling mill, employing an in-line Lucifer EHS3GT-B 18 tunnel furnace. Material was held at the hot rolling temperature for an initial dwell time of 40 minutes to ensure homogeneous temperature. After each pass on the rolling mill, the sample was returned to the tunnel furnace with a 4 minute temperature recovery hold to correct for temperature lost during the hot rolling pass. Hot rolling was conducted in two campaigns, with the first campaign achieving approximately 85% total reduction to a thickness of 6 mm. Following the first campaign of hot rolling, a section of sheet between 150 mm and 200 mm long was cut from the center of the hot rolled material. This cut section was then used for a second campaign of hot rolling for a total reduction between both campaigns of between 96% and 97%. A list of specific hot rolling parameters used for all alloys is available in Table 9.

TABLE 9

| Hot Rolling Parameters | | | | | | | |
|---|---|---|---|---|---|---|---|
| Alloy | Temperature (° C.) | Campaign | Number of Passes | Initial Thickness (mm) | Final Thickness (mm) | Campaign Reduction (%) | Cumulative Reduction (%) |
| Alloy 60 | 1075 | 1 | 6 Pass | 49.29 | 7.72 | 84.3 | 84.3 |
| | | 2 | 4 Pass | 7.72 | 1.59 | 79.4 | 96.8 |
| Alloy 61 | 1100 | 1 | 6 Pass | 48.13 | 8.73 | 81.9 | 81.9 |
| | | 2 | 4 Pass | 8.73 | 1.48 | 83.1 | 96.9 |
| Alloy 62 | 1025 | 1 | 6 Pass | 49.16 | 9.63 | 80.4 | 80.4 |
| | | 2 | 4 Pass | 9.63 | 2.01 | 79.1 | 95.9 |

Hot-rolled sheets from each alloy were then subjected to further cold rolling in multiple passes down to thickness of 1.2 mm. Rolling was done on a Fenn Model 061 single stage rolling mill. Examples of specific cold rolling parameters used for the alloys are shown in Table 10.

TABLE 10

| Cold Rolling Parameters | | | | |
|---|---|---|---|---|
| Alloy | Number of Passes | Initial Thickness (mm) | Final Thickness (mm) | Reduction (%) |
| Alloy 60 | 7 | 1.58 | 1.21 | 23.7 |
| Alloy 61 | 2 | 1.43 | 1.19 | 17.1 |
| Alloy 62 | 13 | 2.00 | 1.48 | 25.9 |

After hot and cold rolling, tensile specimens were cut via EDM. Part of the samples from each alloy were tested in tension. Tensile properties of the alloys after hot rolling and subsequent cold rolling are listed in Table 11. The ultimate tensile strength values may vary from 1438 to 1787 MPa with tensile elongation from 1.0 to 20.8%. The yield stress is in a range from 809 to 1642 MPa. This corresponds to Structure 3 in FIG. 8. The mechanical characteristic values in the steel alloys herein will depend on alloy chemistry and processing conditions. Cold rolling reduction influences the amount of austenite transformation leading to different level of strength in the alloys.

TABLE 11

| Tensile Properties of Selected Alloys After Cold Rolling | | | |
|---|---|---|---|
| Alloy | Yield Stress (MPa) | UTS (MPa) | Tensile Elongation (%) |
| Alloy 60 | 1485 | 1489 | 1.0 |
| | 1161 | 1550 | 7.2 |
| | 1222 | 1530 | 6.6 |
| | 1226 | 1532 | 6.9 |
| | 1642 | 1779 | 2.1 |
| | 1642 | 1787 | 2.1 |
| Alloy 61 | 1179 | 1492 | 3.5 |
| | 1133 | 1438 | 2.6 |
| | 1105 | 1469 | 4.3 |
| Alloy 62 | 823 | 1506 | 15.3 |
| | 895 | 1547 | 17.4 |
| | 809 | 1551 | 20.8 |

Part of cold rolled samples were heat treated at the parameters specified in Table 12. Heat treatments were conducted in a Lucifer 7GT-K12 sealed box furnace under an argon gas purge, or in a ThermCraft XSL-3-0-24-1C tube furnace. In the case of air cooling, the specimens were held at the target temperature for a target period of time, removed from the furnace and cooled down in air. In cases of controlled cooling, the furnace temperature was lowered at a specified rate with samples loaded.

TABLE 12

| Heat Treatment Parameters | | | |
|---|---|---|---|
| Heat Treatment | Temperature (° C.) | Time (min) | Cooling |
| HT1 | 850 | 360 | 0.75° C./min to <500° C. then Air |
| HT2 | 950 | 360 | Air |
| HT4 | 1075 | 120 | Air |
| HT5 | 1100 | 120 | Air |
| HT11 | 850 | 5 | Air |
| HT12 | 1125 | 120 | Air |

Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture.

Tensile properties of the selected alloys after hot rolling with subsequent cold rolling and heat treatment at different parameters (Table 12) are listed in Table 13. The ultimate tensile strength values may vary from 813 MPa to 1316 MPa with tensile elongation from 6.6 to 35.9%. The yield stress is in a range from 274 to 815 MPa. This corresponds to Structure 2 in FIG. 8. The mechanical characteristic values in the steel alloys herein will depend on alloy chemistry and processing conditions.

TABLE 13

| Tensile Properties of Selected Alloys After Cold Rolling and Heat Treatment | | | | |
|---|---|---|---|---|
| Alloy | Heat Treatment | Yield Stress (MPa) | Ultimate Strength (MPa) | Tensile Elongation (%) |
| Alloy 60 | HT1 | 502 | 1062 | 19.1 |
| | | 504 | 1078 | 20.4 |
| | | 488 | 1072 | 21.6 |
| | HT2 | 455 | 945 | 17.3 |
| | HT4 | 371 | 959 | 17.0 |
| | | 382 | 967 | 17.9 |
| | | 365 | 967 | 17.9 |
| | HT11 | 477 | 875 | 13.1 |
| | | 477 | 872 | 13.6 |
| | | 469 | 877 | 14.0 |
| Alloy 61 | HT1 | 274 | 1143 | 32.8 |
| | | 280 | 1181 | 29.1 |
| | | 280 | 1169 | 30.8 |
| | HT2 | 288 | 1272 | 29.9 |
| | | 281 | 1187 | 25.5 |
| | | 299 | 1240 | 31.2 |

TABLE 13-continued

| Tensile Properties of Selected Alloys After Cold Rolling and Heat Treatment | | | | |
|---|---|---|---|---|
| Alloy | Heat Treatment | Yield Stress (MPa) | Ultimate Strength (MPa) | Tensile Elongation (%) |
| | HT5 | 274 | 1236 | 30.8 |
| | | 285 | 1255 | 30.5 |
| | | 289 | 1297 | 32.8 |
| | HT11 | 333 | 1316 | 35.0 |
| | | 341 | 1243 | 34.0 |
| | | 341 | 1260 | 35.9 |
| Alloy 62 | HT1 | 675 | 826 | 7.25 |
| | | 656 | 813 | 6.6 |
| | | 669 | 831 | 7.57 |
| | HT2 | 649 | 1012 | 13.78 |
| | | 588 | 1040 | 18.29 |
| | HT11 | 815 | 1144 | 15.25 |
| | | 808 | 1114 | 14.27 |
| | | 784 | 1107 | 13.63 |
| | HT12 | 566 | 1089 | 24.32 |
| | | 584 | 1054 | 21.47 |
| | | 578 | 1076 | 23.36 |

CASE EXAMPLES

Case Example #1

Modeling of 3 Stages of Thin Slab Casting at Laboratory Scale

Plate casting with different thicknesses in a range from 5 to 50 mm using an Indutherm VTC 800 V caster was used to mimic the Stage 1 of the Thin Slab Process (FIG. 2). Using commercial purity feedstock, charges of different masses were weighed out for particular alloys according to the atomic ratios provided in Table 4. The charges were then placed into the crucible of an Indutherm VTC 800 V Tilt Vacuum Caster. The feedstock was melted using RF induction and then poured into a copper die designed for casting plates with dimensions described in Table 14. An example of cast plate from Alloy 2 with thickness of 50 mm is shown in FIG. 9.

TABLE 14

| Cast Plate Parameters | | |
|---|---|---|
| Plate Parameters | Width × Length [mm] | Thickness [mm] |
| 1 | 68.5 × 75 | 5 |
| 2 | 58.5 × 75 | 10 |
| 3 | 50.8 × 75 | 20 |
| 4 | 100 × 75 | 50 |

All cast plates are subjected to hot rolling using a Fenn Model 061 Rolling Mill and a Lucifer 7-R24 Atmosphere Controlled Box Furnace that replicates Stage 2 of the Thin Slab Process with cooling down in air mimicking Stage 3 of the Thin Slab Process (FIG. 2). The plates were placed in a furnace pre-heated to 1140° C. for 60 minutes prior to the start of rolling. The plates were then repeatedly rolled with reduction from 10% to 25% per pass. The plates were placed in the furnace for 1 to 2 min between rolling steps to allow them to return to temperature. If the plates became too long to fit in the furnace they were cooled, cut to a shorter length, then reheated in the furnace for 60 minutes before they were rolled again towards targeted gauge thickness. Hot rolling was applied to mimic Stage 2 of the Thin Slab Process or initial post-processing step of thick slab by hot rolling. Air cooling after hot rolling corresponds to Stage 3 of the Thin Slab Process or cooling conditions for Thick Slab after in-line hot rolling.

Sheet samples produced by multi-pass hot rolling of cast plates were the subject for further treatments (heat treatment, cold rolling, etc.) as described in the Case Examples herein mimicking sheet post-processing after Thin Slab Production depending on property and performance requirements for different applications. Close modeling of the Slab Casting process and post-processing methods allow prediction of structural development in the steel alloys herein at each step of the processing and identifies the mechanisms which will lead to production of sheet steel with advanced property combinations.

Case Example #2

Heat Treatment Effect on Cast Plate Properties

Using commercial purity feedstock, charges of different masses were weighed out for Alloy 1, Alloy 8, and Alloy 16 according to the atomic ratios provided in Table 4. The charges were then placed into the crucible of an Indutherm VTC 800 V Tilt Vacuum Caster. The feedstock was melted using RF induction and then poured into a copper die designed for casting plates with 50 mm thickness which is in a range for the Thin Slab Casting process (typically 20 to 150 mm). Cast plates from each alloy were heat treated at different parameters listed in Table 15.

Tensile specimens were cut from the as-cast and heat treated plates using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. A video extensometer was utilized for strain measurements.

TABLE 15

| Heat Treatment Parameters | | | |
|---|---|---|---|
| Alloy | Temperature (° C.) | Time (min) | Cooling |
| Alloy 1 | 1150 | 120 | Air |
| Alloy 8 | 1100 | 120 | Air |
| Alloy 16 | 1150 | 120 | Air |

Tensile properties of the alloys in the as-cast and heat treated conditions are plotted in FIG. 10. Slight property improvement was observed in heat treated samples for all three alloys as compared to the as-cast state. However, properties are well below the potential represented for each alloy in Table 8. This is expected since the alloys were cast at 50 mm (i.e. greater than 2 mm in thickness and cooled at ≤250 K/s) and a heat treatment only will not refine the structure according to the mechanisms in FIG. 8.

To compare the change in the microstructure caused by heat treatment, samples in as-cast and heat treated states were examined by SEM. To make SEM specimens, the cross-sections of the plate samples were cut and ground by SiC paper and then polished progressively with diamond media paste down to 1 μm grit. The final polishing was done with 0.02 μm grit $SiO_2$ solution. Microstructures of the plate samples from Alloy 1, Alloy 8, and Alloy 16 in the as-cast and heat treated states were examined by scanning electron microscopy (SEM) using an EVO-MA10 scanning electron microscope manufactured by Carl Zeiss SMT Inc.

FIGS. 12 through 14 demonstrate SEM images of the microstructure in all three alloys before and after heat treatment. As it can be seen, Modal Structure (Structure #1) is present in as-cast plates from all three alloys with boride phase located between matrix grains and along the matrix grain boundaries. Although heat treatment may induce grain refinement within the matrix phase through Static Nanophase Refinement (Mechanism #1, FIG. 8), the microstructure appears to remain coarse and additionally only partial spheroidization of the boundary boride phase can be seen after heat treatment with localization along prior dendrite boundaries. Thus, heat treatment of the plates directly after solidification does not provide refinement and structural homogenization necessary to achieve the properties when alloys are cast at large thicknesses, resulting in relatively poor properties.

Thus, Static Nanophase Refinement occurring through elevated temperature heat treatment is found to be relatively ineffective in samples cast at high thickness/reduced cooling rates. The range where Static Nanophase Refinement will not be effective will be dependent on the specific alloy chemistry and size of the dendrites in the Modal Structure but generally occurs at casting thickness greater than or equal to 2.0 mm and cooling rates less than or equal to 250 K/s.

Case Example #3

Effect of HIP Cycle on Properties of the Plates with Different Thickness

Plate casting with different thicknesses in a range from 1.8 mm to 20 mm was done for the Alloy 58 and Alloy 59 listed in Table 4. Thin plates with as-cast thickness of 1.8 mm were cast in a Pressure Vacuum Caster (PVC). Using commercial purity feedstock, charges of 35 g were weighed out according to the atomic ratios provided in Table 4. The feedstock material was then placed into the copper hearth of an arc-melting system. The feedstock was arc-melted into an ingot using high purity argon as a shielding gas. The ingots were flipped several times and re-melted to ensure homogeneity. Individually, the ingots were disc-shaped, with a diameter of ~30 mm and a thickness of ~9.5 mm at the thickest point. The resulting ingots were then placed in a PVC chamber, melted using RF induction and then ejected into a copper die designed for casting 3 by 4 inches plates with thickness of 1.8 mm.

Casting of plates with thickness from 5 to 20 mm was done by using an Indutherm VTC 800 V Tilt Vacuum Caster. Using commercial purity feedstock, charges of different masses were weighed out for particular alloys according to the atomic ratios provided in Table 4. The charges were then placed into the crucible of the caster. The feedstock was melted using RF induction and then poured into a copper die designed for casting plates with dimensions described in Table 16.

TABLE 16

Cast Plate Parameters

| Plate Parameters | Width × Length (mm) | Thickness (mm) |
|---|---|---|
| 1 | 68.5 × 75 | 5 |
| 2 | 58.5 × 75 | 10 |
| 3 | 50.8 × 75 | 20 |

Each plate from each alloy was subjected to Hot Isostatic Pressing (HIP) using an American Isostatic Press Model 645 machine with a molybdenum furnace and with a furnace chamber size of 4 inch diameter by 5 inch height. The plates were heated at 10° C./min until the target temperature was reached and were exposed to gas pressure for the specified time of 1 hour for these studies. Note that the HIP cycle was used as in-situ heat treatment and a method to remove some of the casting defects to mimic hot rolling step at slab casting. HIP cycle parameters are listed in Table 17. After HIP cycle, the plates from both alloys were heat treated in a box furnace at 900° C. for 1 hr.

TABLE 17

HIP Cycle Parameters

| Alloy | HIP Cycle Temperature (° C.) | HIP Cycle Pressure (psi) | HIP Cycle Time (hr) |
|---|---|---|---|
| Alloy 58 | 1150 | 30,000 | 1 |
| Alloy 59 | 1125 | 30,000 | 1 |

The tensile specimens were cut from the plates in as-HIPed state as well as after HIP cycle and heat treatment using wire electrical discharge machining (EDM). The tensile properties were measured on an Instron mechanical testing frame (Model 3369), utilizing Instron's Bluehill control and analysis software. All tests were run at room temperature in displacement control with the bottom fixture held rigid and the top fixture moving with the load cell attached to the top fixture. To compare the microstructure change by HIP cycle and heat treatment, samples in the as-cast, HIPed and heat treated states were examined by SEM using an EVO-MA10 scanning electron microscope manufactured by Carl Zeiss SMT Inc. To make SEM specimens, the cross-sections of the plate samples were cut and ground by SiC paper and then polished progressively with diamond media paste down to 1 μm grit. The final polishing was done with 0.02 μm grit $SiO_2$ solution.

Tensile properties of the plates from both alloys after HIP cycle are shown in FIG. 14 as a function of plate thickness. Significant decrease in properties with increasing as-cast thickness was observed in both alloys. Best properties were achieved when both alloys were cast at 1.8 mm.

Examples of microstructures in the plates for Alloy 59 in the as-cast state and after HIP cycle are shown in FIG. 15 through FIG. 17. Modal Structure (Structure #1) can be observed in the plates in as-cast condition (FIG. 15*a*, FIG. 16*a*, FIG. 17*a*) with increasing dendrite size as a function of cast plate thickness. After HIP cycle, the Modal Structure may have partially transformed into Nanomodal Structure (Structure #2) through Static Nanophase Refinement (Mechanism #1) but the structure appears coarse (note individual grain size beyond SEM resolution). But, as it can be seen in all cases (FIG. 15*b*, FIG. 16*b*, FIG. 17*b*), boride phases are preferably aligned along primary dendrites formed at solidification. Significantly smaller dendrites (in the case of casting at 1.8 mm thickness) results in more homogeneous distribution of borides leading to better properties as compared to that in cast plates with larger thicknesses (FIG. 15*b*). Additional heat treatment after HIP cycle results in property improvement in all plated with more pronounced effect in 1.8 mm thick plates from both alloys (FIG. 18). In the samples cast at greater thickness (i.e. 5 to 20 mm), the improvement in properties are minimal.

This Case Example demonstrates that although HIP cycle at high temperature and additional heat treatment may induce some level of grain refinement within the matrix phase, Static Nanophase Refinement is generally ineffective. Additionally only partial spheroidization of the boundary boride phase can be seen after HIP cycle with complex boride phases localized along the matrix grain boundaries.

Case Example #4

Hot Rolling Effect on Properties of the Plates with Different Thickness

Figure 1:
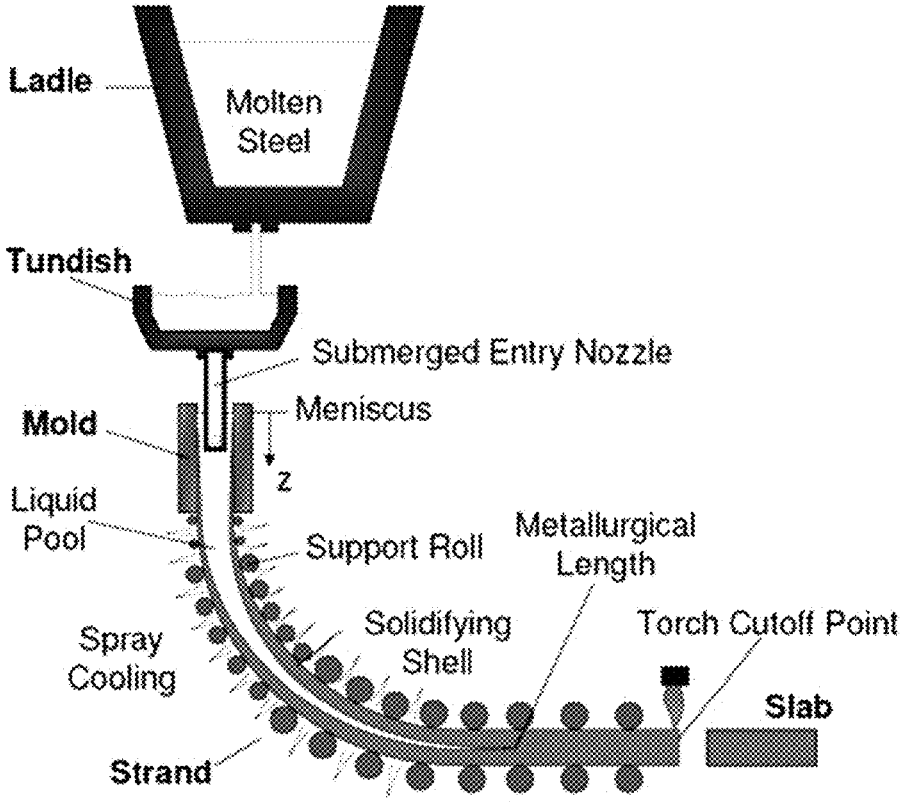
FIG. 1 illustrates a continuous slab casting process flow diagram.

Plates with different thicknesses in a range from 5 mm to 20 mm were cast from Alloy 1 and Alloy 2 using an Indutherm VTC 800 V Tilt Vacuum Caster. Using commercial purity feedstock, charges of different masses were weighed out for particular alloys according to the atomic ratios provided in Table 4. The charges were then placed into the crucible of the caster. The feedstock was melted using RF induction and then poured into a copper die designed for casting plates with dimensions described in Table 15. Each plate from each alloy was subjected to Hot Rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then hot rolled with multiple passes of 10% to 25% reduction mimicking multi-stand hot rolling during Stage 2 at the Thin Slab Process (FIG. 2) or hot rolling process at Thick Slab Casting (FIG. 1). Total hot rolling reduction was from 75 to 88% depending on cast thickness of the plate. An example of hot rolled plate from Alloy 1 is shown in FIG. 19. Hot rolling reduction value for each plate for both Alloys is provided in Table 18.

TABLE 18

| Hot Rolling Reduction (%) | | |
|---|---|---|
| As-Cast Thickness (mm) | Alloy 1 | Alloy 2 |
| 5 | 75.7 | 76.0 |
| 10 | 83.8 | 86.0 |
| 20 | 88.5 | 88.0 |

Tensile specimens were cut from the plates after hot rolling using wire electrical discharge machining (EDM). The tensile properties were measured on an Instron mechanical testing frame (Model 3369), utilizing Instron's Bluehill control and analysis software. All tests were run at room temperature in displacement control with the bottom fixture held rigid and the top fixture moving with the load cell attached to the top fixture. To compare the microstructure in the plates with initial different thicknesses before and after hot rolling, SEM analysis was done on selected samples using an EVO-MA10 scanning electron microscope manufactured by Carl Zeiss SMT Inc. To make SEM specimens, the cross-sections of the plate samples from Alloy 1 were cut and ground by SiC paper and then polished progressively with diamond media paste down to 1 μm grit. The final polishing was done with 0.02 μm grit $SiO_2$ solution.

Tensile properties of the plates from Alloy 1 and Alloy 2 that were cast at different thicknesses and hot-rolled are shown in FIG. 20. As it can be seen, prior to hot rolling, both alloys in the as-cast state demonstrated lower strength and ductility with a higher degree of property variation between samples. After hot rolling, samples from both Alloys at all thicknesses demonstrated a significant improvement in tensile properties and a reduction in the property variation from sample to sample. Plates that were cast at 5 mm thickness have slightly lower properties that can be explained by smaller hot rolling reduction when some in-cast defects still can be present. SEM analysis of the plate samples from Alloy 1 after hot rolling has demonstrated similar structure through hot rolled sheet volume independent from initial cast thickness (FIG. 21 through FIG. 23). In contrast to heat treatment (FIG. 11 through FIG. 13) and HIP cycle (FIG. 15 through 18), hot rolling leads to structural homogenization through Dynamic Nanophase Refinement (Mechanism #0, FIG. 8) with formation of Homogenized Modal Structure (Structure #1a, FIG. 8) at any cast thickness studied herein. Formation of Homogenized Modal Structure results in significant property improvement over the as-cast samples after several hot rolling cycles.

This Case Example demonstrates that formation of Homogenized Modal Structure (Structure #1a, FIG. 8) through Dynamic Nanophase Refinement (Mechanism #0, FIG. 8) when complete results in the transformation into the targeted Nanomodal Structure (Structure #2, FIG. 8) which is a preferred process route to achieve relatively uniform structure and properties in alloys that are cast at large thicknesses.

Case Example #5

Heat Treatment Effect on Hot-Rolled Sheet from Alloy 1 and Alloy 2

Plate casting with 50 mm thickness from Alloy 1 and Alloy 2 was done using an Indutherm VTC 800 V Tilt Vacuum Caster in order to mimic the Stage 1 of the Thin Slab Process (FIG. 2). Using commercial purity feedstock, charges of different masses were weighed out for Alloy 1 and Alloy 2 according to the atomic ratios provided in Table 4. The charges were then placed into the crucible of the caster. The feedstock was melted using RF induction and then poured into a copper die designed for casting plates with 50 mm thickness. The plates from each alloy were subjected to Hot Rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then repeatedly rolled at between 10% and 25% reduction per pass down to 3.5 mm thickness mimicking multi-stand hot rolling at Stage 2 during the Thin Slab Process (FIG. 2) or hot rolling step at Thick Slab Casting (FIG. 1). The plates were placed in the furnace for 1 to 2 min between rolling steps to allow them to partially return to temperature for the next rolling pass. If the plates became too long to fit in the furnace they were cooled, cut to a shorter length, then reheated in the furnace for 60 minutes before they were rolled again towards the targeted gauge thickness. Total reduction of 93% was achieved for both alloys. Hot rolled sheets were heat treatment at different parameters listed in Table 19.

TABLE 19

| Heat Treatment Parameters | | | |
|---|---|---|---|
| Heat Treatment | Temperature (° C.) | Time (min) | Cooling |
| HT1 | 850 | 360 | 0.75° C./min to <500° C. then Air |
| HT2 | 950 | 360 | Air |
| HT3 | 1150 | 120 | Air |

Tensile specimens were cut from the rolled and heat treated sheets from Alloy 1 and Alloy 2 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. A non-contact video extensometer was utilized for strain measurements.

Tensile properties for Alloy 1 and Alloy 2 sheet after hot rolling and heat treatment at different parameters are plotted in FIG. 24. There is a general trend for property improvement with increasing heat treatment temperature.

This Case Example demonstrates that advanced property combinations can be achieved in the alloys herein when cast at 50 mm thickness and undergo Dynamic Nanophase Refinement (Mechanism #0, FIG. 8) at hot rolling leading to formation of Homogenized Modal Structure (Structure #1a, FIG. 8). Subsequent heat treatment leads to partial or full transformation into Nanomodal Structure (Structure #2, FIG. 8) through Static Nanophase Refinement (Mechanism #1, FIG. 8) depending on the alloy chemistry, hot rolling parameters and heat treatment applied.

Case Example #6

Tensile Properties of 50 mm Thick Cast Plates in Different Conditions

Plate casting with 50 mm thickness from Alloy 1 and Alloy 2 was done using an Indutherm VTC 800 V Tilt Vacuum Caster in order to mimic the Stage 1 of the Thin Slab Process (FIG. 2). Using commercial purity feedstock, charges of different masses were weighed out for Alloy 1 and Alloy 2 according to the atomic ratios provided in Table 4. The charges were then placed into the crucible of the caster. The feedstock was melted using RF induction and then poured into a copper die designed for casting plates with 50 mm thickness. The plates from each alloy were subjected to hot rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then repeatedly rolled at between 10% and 25% reduction per pass down to 3.5 mm thickness mimicking multi-stand hot rolling at Stage 2 during the Thin Slab Process (FIG. 2) or hot rolling step at Thick Slab Casting (FIG. 1). The plates were placed in the furnace for 1 to 2 min between rolling steps to allow them to return to temperature. If the plates became too long to fit in the furnace they were cooled, cut to a shorter length, then reheated in the furnace for 60 minutes before they were rolled again towards targeted gauge thickness. Total reduction of 96% was achieved for both alloys.

To evaluate the microstructure in the plates after hot rolling, SEM analysis was done on plate samples from both alloys using an EVO-MA10 scanning electron microscope manufactured by Carl Zeiss SMT Inc. To make SEM specimens, the cross-sections of the plate samples from Alloy 1 were cut and ground by SiC paper and then polished progressively with diamond media paste down to 1 μm grit. The final polishing was done with 0.02 μm grit $SiO_2$ solution. SEM images of the microstructure in Alloy 1 and Alloy 2 plates with as-cast thickness of 50 mm after hot rolling with 96% reduction are shown in FIG. 25 and FIG. 26, respectively. As it can be seen, a homogeneous structure through the plate thickness was observed for both alloys confirming a formation of Homogenized Modal Structure (Structure #1a, FIG. 8) during hot rolling as a result of Dynamic Nanophase Refinement (Mechanism #0, FIG. 8).

To mimic possible post-processing of the sheet produced by Thick Slab or Thin Slab Process, additional cold rolling with 39% reduction was applied with subsequent heat treatment. Rolled sheet from Alloy 1 was heat treated at 950° C. for 6 hrs and rolled sheet from Alloy 2 was heat treated at 1150° C. for 2 hrs. The tensile specimens were cut from the sheets from Alloy 1 and Alloy 2 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. A non-contact video extensometer was utilized for strain measurements.

Tensile properties for Alloy 1 and Alloy 2, in the hot rolled, hot rolled with subsequent cold rolling, and hot rolled with subsequent cold rolling and heat treatment conditions are plotted in FIG. 27. Hot rolled data represents properties of the sheets corresponding to the as-produced state in a case of Thin Slab Production including solidification, hot rolling, and coiling. Cold rolling was applied to hot rolled sheet to reduce sheet thickness to 2 mm leading to significant strengthening of the sheet material through the Dynamic Nanophase Strengthening mechanism. Subsequent heat treatment of the hot rolled and cold rolled sheet provides properties with strength of 1000 to 1200 MPa and ductility in the range from 17 to 24%. Final properties can vary depending on alloy chemistry as well as casting and post-processing parameters.

This Case Example demonstrates that advanced property combinations can be achieved in the alloys herein when cast at 50 mm thickness and undergo Dynamic Nanophase Refinement (Mechanism #0, FIG. 8) at hot rolling leading to formation of Homogenized Modal Structure (Structure #1a, FIG. 8). Partial or full transformation into Nanomodal Structure (Structure #2, FIG. 8) may also occur at hot rolling depending on alloy chemistry and hot rolling parameters. The main difference is whether Structure #1a (Homogenized Modal Structure) transforms directly into Structure #2 (Nanomodal Structure) after a specific number of cycles of Mechanism #0 (Dynamic Nanophase Refinement) or if an additional heat treatment is needed to activate Mechanism #1 (Static Nanophase Refinement) to form Structure #2 (Nanomodal Structure). Subsequent post processing by cold rolling leads to the formation of the High Strength Nanomodal Structure (Structure #3, FIG. 8) through Dynamic Nanophase Strengthening (Mechanism #2, FIG. 8).

Case Example #7

As-Cast Thickness Effect on Sheet Properties from Alloy 1 and Alloy 2

Plates were cast with different thicknesses in a range from 5 to 50 mm using an Indutherm VTC 800 V caster. Using commercial purity feedstock, charges of different masses were weighed out for particular alloys according to the atomic ratios provided in Table 4. The charges for Alloy 1 and Alloy 2 according to the atomic ratios provided in Table 4 were then placed into the crucible of an Indutherm VTC 800 V Tilt Vacuum Caster. The feedstock was melted using RF induction and then poured into a copper die designed for casting plates with dimensions described in Table 13. All plates from each alloy were subjected to hot rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then repeatedly rolled down to 1.2 to 1.4 mm thickness. To mimic possible post-processing of the sheet produced by the Thin Slab Process, additional cold rolling with 39% reduction was applied to hot rolled plates with subsequent heat treatment at 1150° C. for 2 hrs.

The tensile specimens were cut from the rolled and heat treated sheets from Alloy 1 and Alloy 2 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile data for both alloys are plotted in FIG. 28. Consistent properties with similar strength and ductility in the range from 20 to 29% for Alloy 1 and from 19 to 26% for Alloy 2 were measured in post-processed sheets independently from the as-cast thickness.

This Case Example demonstrates that Homogenized Modal Structure (Structure #1a, FIG. 8) forms in the Alloy 1 and Alloy 2 plates during hot rolling through Dynamic Nanophase Refinement (Mechanism #0, FIG. 8) resulting in the consistent properties independently from initial cast thickness. That is, provided one starts with Modal Structure, and undergoes Dynamic Nanophase Refinement to Homogenized Modal Structure, one can then continue with the sequence shown in FIG. 8 to achieve useful mechanical properties, regardless of the thickness of the initial cast thickness present in Structure 1 (i.e. when the thickness of the Modal Structure is greater than or equal to 2.0 mm, such as a thickness of greater than or equal to 2.0 mm to a thickness of 500 mm).

Case Example #8

Heat Treatment Effect on Sheet Microstructure after Hot Rolling

Plates with thicknesses of 20 mm were cast from Alloy 2 using an Indutherm VTC 800 V Tilt Vacuum Caster. Using commercial purity feedstock, charges of different masses were weighed out for particular alloy according to the atomic ratios provided in Table 4. The charges were then placed into the crucible of the caster. The feedstock was melted using RF induction and then poured into a copper die designed for casting plates with thickness of 20 mm. Cast plate was subjected to hot rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then hot rolled with multiple passes of 10% to 25% reduction mimicking multi-stand hot rolling during Stage 2 at the Thin Slab Process (FIG. 2) or hot rolling process at Thick Slab Casting (FIG. 1). Total hot rolling reduction was 88%. After hot rolling, the resultant sheet was heat treated at 950° C. for 6 hrs.

To compare the microstructure change by heat treatment, samples after hot rolling and samples after additional heat treatment were examined by SEM. To make SEM specimens, the cross-sections of the sheet samples were cut and ground by SiC paper and then polished progressively with diamond media paste down to 1 μm grit. The final polishing was done with 0.02 μm grit $SiO_2$ solution. Microstructures of sheet samples from Alloy 2 after hot rolling and heat treatment were examined by scanning electron microscopy (SEM) using an EVO-MA10 scanning electron microscope manufactured by Carl Zeiss SMT Inc.

FIG. 29 shows the microstructure of the sheet after hot rolling with 88% reduction. It can be seen that hot rolling resulted in structural homogenization leading to formation of Homogenized Modal Structure (Structure #1a, FIG. 8) through Dynamic Nanophase Refinement (Mechanism #0, FIG. 8). However, while in the outer layer region, the fine boride phase is relatively uniform in size and homogeneously distributed in matrix, in the central layer region, although the boride phase is effectively broken up by the hot rolling, the distribution of boride phase is less homogeneous as at the outer layer. It can be seen that the boride distribution is not homogeneous. After an additional heat treatment at 950° C. for 6 hrs, as shown in FIG. 30, the boride phase is homogeneously distributed at both the outer layer and the central layer regions. In addition, the boride becomes more uniform in size. Comparison between FIG. 29 and FIG. 30 also suggests that the aspect ratio of the boride phase is smaller after heat treatment, its morphology is close to spherical geometry, and the boride size is more uniform through the sheet volume after heat treatment. The microstructure after the additional heat treatment is typical for the Nanomodal Structure (Structure #2, FIG. 8). With the formation of Nanomodal Structure, the heat treated sheet samples transform into the High Strength Nanomodal Structure during tensile testing resulting in an ultimate tensile strength (UTS) of 1222 MPa and a tensile elongation of 26.2% as compared to the UTS of 1193 MPa, and elongation of 17.9% before the heat treatment, underlining the effectiveness of the heat treatment on structural optimization.

This Case Example demonstrates the importance of Nanomodal Structure formation (Structure #2, FIG. 8) in the alloys herein occurring in the sheet material with Homogenized Modal Structure (Structure #1a, FIG. 8) after hot rolling during heat treatment through Static Nanophase Refinement (Mechanism #1, FIG. 8) leading to the structural optimization required for effectiveness of following Dynamic Nanophase Strengthening (Mechanism #2) during deformation of the sheet.

Case Example #9

Heat Treatment Effect on Alloy 8 Properties after Heat Treatment

Using commercial purity feedstock, charges of different masses were weighed out for Alloy 8 according to the atomic ratios provided in Table 4. The elemental constituents were weighed and charges were cast at 50 mm thickness using a Indutherm VTC 800 V Tilt Vacuum Caster. The feedstock was melted using RF induction and then poured into a water cooled copper die. The cast plates were subjected to hot rolling using a Fenn Model 061 Rolling Mill and a Lucifer 7-R24 Atmosphere Controlled Box Furnace. The samples were hot rolled to approximately 96% reduction in thickness via several rolling passes following a 40 minute soak at 50° C. below each alloy's solidus temperature, mimicking Stage 2 of Thin Slab Production. Between rolling passes, furnace holds of approximately 3 minutes were used to maintain hot rolling temperatures within the slab. Hot rolled sheet was heat treated in inert atmosphere according to the heat treatment schedule in Table 20.

TABLE 20

Heat Treatment Matrix for Alloy 8 Hot Rolled Sheet

| Heat Treatment | Temperature (° C.) | Time (min) | Cooling |
|---|---|---|---|
| HT1 | 850 | 360 | 0.75° C./min to <500° C. then Air |
| HT2 | 950 | 360 | Air |
| HT3 | 1100 | 120 | Air |

Tensile specimens were cut from the rolled and heat treated sheets from Alloy 8 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile data for Alloy 8 after heat treatment at different conditions are plotted in FIG. 31*a*. Tensile properties of Alloy 8 are shown to improve with additional hot rolling and heat treatment. Following 96% thickness reduction by hot rolling, the tensile elongation is >10% with tensile strength of approximately 1300 MPa. Alloy 8 that has been heat treated at the HT3 condition (Table 19) possess tensile elongation of >15% with tensile strength approximately 1300 MPa. FIG. 31*b* illustrates the representative stress-strain curves showing alloy behavior improvement by increasing hot rolling reduction with subsequent heat treatment.

This Case Example demonstrates that better properties in Alloy 8 sheet are achieved after additional hot rolling cycles and heat treatment for longer time (HT1, Table 19) or higher temperature (HT3, Table 19) when more complete transformation into the Nanomodal Structure (Structure #2, FIG. 8) occurs.

Case Example #10

Heat Treatment Effect on Alloy 16 Properties Cast at 50 mm Thickness

Using commercial purity feedstock, charges of different masses were weighed out for Alloy 16 according to the atomic ratios provided in Table 4. The elemental constituents were weighed and charges were cast at 50 mm thickness using an Indutherm VTC 800 V Tilt Vacuum Caster. The feedstock was melted using RF induction and then poured into a water cooled copper die. Slab casting corresponds to Stage 1 of Thin Slab Production. Cast plates were subjected to hot rolling using a Fenn Model 061 Rolling Mill and a Lucifer 7-R24 Atmosphere Controlled Box Furnace. The samples were hot rolled to ~96% reduction in thickness via several rolling passes (10 total) following a 40 minute soak at 50° C. below Alloy 16's solidus temperature, mimicking Stage 2 of Thin Slab Production. Between rolling passes, furnace holds of approximately 3 minutes were used to maintain hot rolling temperatures within the slab. During the hot rolling steps, Dynamic Nanophase Refinement (Mechanism #0) was activated. Hot rolled sheet was heat treated in inert atmosphere according to the heat treatment schedule in Table 21.

TABLE 21

Heat Treatment Matrix for Alloy 16

| Heat Treatment | Temperature (° C.) | Time (min) | Cooling |
|---|---|---|---|
| HT1 | 850 | 360 | 0.75° C./min to <500° C. then Air |
| HT2 | 950 | 360 | Air |
| HT6 | 1150 | 120 | Air |

Tensile specimens were cut from the rolled and heat treated sheets from Alloy 16 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile data for Alloy 16 after heat treatment at different conditions are plotted in FIG. 32. Tensile properties of Alloy 16 are shown to improve with additional hot rolling and heat treatment. Following 96% thickness reduction by hot rolling, the tensile elongation is >25% with tensile strength of ~1100 MPa. Alloy 16 that has been heat treated in the HT6 condition (Table 20) possess tensile elongation of >35% with tensile strength approximately 1050 MPa.

This Case Example demonstrates that better properties can be achieved in Alloy 16 hot rolled sheet after heat treatment at highest temperature (HT6, Table 20) that seems to correspond to most optimal conditions for complete transformation through Static Nanophase Refinement (Mechanism #1, FIG. 8) into Nanomodal Structure (Structure #2, FIG. 8) in this alloy.

Case Example #11

Heat Treatment Effect on Alloy 24 Properties Cast at 50 mm Thickness

Using commercial purity feedstock, charges of different masses were weighed out for Alloy 24 according to the atomic ratios provided in Table 4. The elemental constituents were weighed and charges were cast at 50 mm thickness using a Indutherm VTC 800 V Tilt Vacuum Caster. The feedstock was melted using RF induction and then poured into a water cooled copper die. Slab casting corresponds to Stage 1 of Thin Slab Production. Cast plates were subjected to hot rolling using a Fenn Model 061 Rolling Mill and a Lucifer 7-R24 Atmosphere Controlled Box Furnace. The samples were hot rolled to ~96% reduction in thickness via several rolling passes following a 40 minute soak at 50° C. below the alloy's solidus temperature, mimicking Stage 2 of Thin Slab Production. Between rolling passes, furnace holds of approximately 3 minutes were used to maintain hot rolling temperatures within the slab. Hot rolled sheet was heat treated in inert atmosphere according to the heat treatment schedule in Table 22.

TABLE 22

Heat Treatment Matrix for Alloy 24

| Heat Treatment | Temperature (° C.) | Time (min) | Cooling |
|---|---|---|---|
| HT1 | 850 | 360 | 0.75° C./min to <500° C. then Air |

TABLE 22-continued

| Heat Treatment Matrix for Alloy 24 | | | |
|---|---|---|---|
| Heat Treatment | Temperature (° C.) | Time (min) | Cooling |
| HT2 | 950 | 360 | Air |
| HT5 | 1100 | 120 | Air |

Tensile specimens were cut from the rolled and heat treated sheets from Alloy 24 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile data for Alloy 24 after heat treatment at different conditions are plotted in FIG. 33*a*. Tensile properties of Alloy 24 are shown to improve with additional hot rolling and heat treatment. Following 96% thickness reduction by hot rolling, the tensile elongation is >20% with tensile strength of approximately 1300 MPa. Alloy 24 that has been heat treated in the HT3 condition possess tensile elongation of >21% with tensile strength approximately 1200 MPa. FIG. 33*b* illustrates the representative stress-strain curves showing alloy ductility improvement by increasing temperature of heat treatment after hot rolling with decreasing ductility.

This Case Example demonstrates that heat treatment at all three conditions resulted in strength decrease with increasing ductility suggesting that Nanomodal Structure (Structure #2, FIG. 8) formation may occur in this alloy during hot rolling when both Dynamic Nanophase Refinement (Mechanism #0, FIG. 8) and Static Nanophase Refinement (Mechanism #1, FIG. 8) can be activated. Additional heat treatment may lead to some structural coarsening thereby decreasing the strength.

Case Example #12

Plastic Deformation Effect on Alloy 1 Sheet Microstructure

A 50 mm thick Alloy 1 plate was hot rolled at 1150° C. with a two-step reduction by 85.2% and 73.9% respectively and then heat treated at 950° C. for 6 hrs. Tensile tests were conducted on samples after the heat treatment. Microstructures of samples before and after the uniaxial deformation were studied by transmission electron microscopy (TEM). TEM specimens were cut from the grip section and tensile gage of test specimens, representing the states before and after tensile deformation respectively. TEM specimen preparation procedure includes cutting, thinning, electropolishing. First, samples were cut with electric discharge machine, and then thinned by grinding with pads of reduced grit size every time. Further thinning to 60 to 70 μm thickness is done by polishing with 9 μm, 3 μm and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling usually was done at 4.5 keV, and the inclination angle was reduced from 4° to 2° to open up the thin area.

The TEM studies were done using a JEOL 2100 high-resolution microscope operated at 200 kV. The TEM image of the microstructure in the Alloy 1 plate after hot rolling and heat treatment before deformation is shown in FIG. 34. It can be seen that the Alloy 1 slab sample shows a textured microstructure due to hot rolling. Microstructure refinement is also seen in the sample. Since the sample was heat treated prior to the tensile deformation, the microstructure refinement indicates that Static Nanophase Refinement (Mechanism #1, FIG. 8) occurs during the heat treatment leading to Nanomodal Structure (Structure #2, FIG. 8) formation. The hot rolling prior heat treatment resulted in homogeneous distribution of the boride phase in matrix when Homogenized Modal Structure (Structure #1a, FIG. 8) was formed. The Homogenized Modal Structure in this alloy corresponds to Type 2 (Table 3). As shown in FIG. 34, matrix grains of 200 to 500 nm in size can be found in the sample after heat treatment. Within the matrix grains, stacking faults can also be found, suggesting formation of austenite phase.

FIG. 35 shows the bright-field TEM images of the samples taken from the gage section of tensile specimens. As it can be seen, further structural refinement occurred during deformation through Dynamic Nanophase Strengthening (Mechanism #2, FIG. 8) with formation of High Strength Nanomodal Structure (Structure #3, FIG. 8). Grains of 200 to 300 nm in size are commonly observed in the matrix and very fine precipitates of hexagonal phases can be found. Additionally, the stacking faults shown in the samples before deformation disappeared after the tensile deformation, suggesting the austenite transforms to ferrite, and dislocations are generated in the matrix grains during the tensile deformation.

This Case Example illustrates High Strength Nanomodal Structure formation (Structure #3, FIG. 8) in Alloy 1 initially cast at 50 mm thickness with subsequent hot rolling and heat treatment. Structural development through enabling mechanisms follows the pathway illustrated in FIG. 8.

Case Example #13

Plastic Deformation Effect on Alloy 8 Sheet Microstructure

Samples of 50 mm thick Alloy 8 plate were hot rolled at 1150° C. and heat treated at 950° C. for 6 hrs. Tensile tests were conducted on samples after the heat treatment. Microstructures of samples before and after the tensile deformation were studied by transmission electron microscopy (TEM). TEM specimens were cut from the grip section and tensile gage of test specimens, representing the states before and after tensile deformation respectively. TEM specimen preparation procedure includes cutting, thinning, electropolishing. First, samples were cut with electric discharge machine (EDM), and then thinned by grinding with pads of reduced grit size every time. Further thinning to 60 to 70 μm thickness was done by polishing with 9 μm, 3 μm and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling usually was done at 4.5 keV, and the inclination angle was reduced from 4° to 2° to open up the thin area. The TEM studies were done using a JEOL 2100 high-resolution microscope operated at 200 kV.

The TEM image of the microstructure in the Alloy 8 plate after hot rolling and heat treatment before deformation is shown in FIG. 36*a*. As it can be seen, the Alloy 8 sample before deformation shows a refined microstructure, as grains of several hundred nanometers are found in the sample confirming Homogenized Modal Structure (Structure 1a, FIG. 8) formation followed by Static Nanophase Refinement (Mechanism #1, FIG. 8) activation during heat treatment with formation of Nanomodal Structure (Structure #2, FIG. 8). Furthermore, a modulation of dark and bright contrast is shown in the matrix grains, similar to the lamellar type structure. The presence of the lamellar-like structural features indicates that Homogenized Modal Structure in this alloy is Type 3 (Table 3). The boride phases were effectively broken up during the hot rolling when Homogenized Modal Structure (Structure #1a, FIG. 8) was formed.

After tensile deformation, further microstructure refinement may be seen in the sample, and nano-size precipitate formation in Alloy 8 was found. As shown in FIG. 36*b*, slightly dark contrast showing incipient nano-size precipitates can be barely seen in the matrix prior to deformation. After deformation, the nano-size precipitates seem to develop a stronger contrast, as shown in FIG. 36*b*. The change of nano-size precipitates is better revealed by high magnification images. FIG. 37 shows the matrix structure before and after deformation at a higher magnification. In contrast to the weak contrast shown by the nano-size precipitates before deformation, as it can be seen in FIG. 37, the precipitates are better developed after deformation. A close view of the precipitate regions suggests that they are composed of several smaller precipitates, FIG. 37*b*. Study by high-resolution TEM further reveals the structure of the nano-size precipitates. As shown in FIG. 38, the lattice of nano-size precipitates is distinguished from the matrix, but their geometry is not clearly defined, suggesting that they might be just formed and perhaps in coherence with the matrix. After deformation, the precipitates are well identifiable with a size of generally 5 nm or less.

This Case Example illustrates High Strength Nanomodal Structure formation (Structure #3, FIG. 8) in Alloy 8 initially cast at 50 mm thickness with subsequent hot rolling and heat treatment. Structural development through the mechanisms follows the pathway illustrated in FIG. 8.

Case Example #14

Plastic Deformation Effect on Alloy 16 Sheet Microstructure

Samples of 50 mm thick Alloy 16 plate were hot rolled at 1150° C. and heat treated at 1150° C. for 2 hrs. Tensile tests were conducted on samples after the heat treatment. Microstructures of samples before and after the tensile deformation were studied by transmission electron microscopy (TEM). TEM specimens were cut from the grip section and tensile gage of test specimens, representing the states before and after tensile deformation respectively. TEM specimen preparation procedure includes cutting, thinning, electropolishing. First, samples were cut with electric discharge machine, and then thinned by grinding with pads of reduced grit size every time. Further thinning to 60 to 70 μm thickness is done by polishing with 9 μm, 3 μm and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling usually was done at 4.5 keV, and the inclination angle was reduced from 4° to 2° to open up the thin area. The TEM studies were done using a JEOL 2100 high-resolution microscope operated at 200 kV.

The TEM image of the Alloy 16 slab sample before deformation is shown in FIG. 39*a*. It can be seen that the Alloy 16 slab sample shows a textured microstructure due to hot rolling. The rolling texture is further revealed by dark-field TEM image shown in FIG. 39*b*. However, microstructure refinement is seen in the sample. As shown by both the bright-field and dark-field images, the refined grains of several hundred nanometers can be seen in the sample indicating that Static Nanophase Refinement (Mechanism #1, FIG. 8) occurs during the heat treatment leading to Nanomodal Structure (Structure #2, FIG. 8) formation. As shown in FIG. 39*b*, matrix grains of 200 to 500 nm in size can be found in the sample after heat treatment. Small boride phases are formed in the matrix during the hot rolling due to the breakup of large boride phases and redistribution. After the hot rolling, the boride phase was homogeneously distributed in matrix when Homogenized Modal Structure (Structure #1a) was formed. The Homogenized Modal Structure in this alloy is similar to Alloy 1 and corresponds to Type 2 (Table 3)

After tensile deformation, substantial microstructure refinement is observed in the sample. FIG. 40 shows the bright-field and dark-field TEM images of the samples made from the gage section of tensile specimen. In contrast to the microstructure before deformation, as can be seen in FIG. 40, grains of 200 to 300 nm in size are commonly observed, and very fine precipitates of the new hexagonal phases can be found confirming that Dynamic Nanophase Strengthening (Mechanism #2) with formation of High Strength Nanomodal Structure (Structure #3) occurred during deformation. Additionally, dislocations are generated in the matrix grains during the tensile deformation.

This Case Example illustrates High Strength Nanomodal Structure formation (Structure #3, FIG. 8) in Alloy 16 initially cast at 50 mm thickness with subsequent hot rolling and heat treatment. Structural development through the mechanisms follows the pathway illustrated in FIG. 8.

Case Example #15

Properties in Alloy 32 and Alloy 42

Plates with 50 mm thickness from Alloy 32 and Alloy 42 were cast using a Indutherm VTC 800 V Tilt Vacuum Caster was utilized to mimic the Stage 1 of the Thin Slab Process (FIG. 2). The plates from each alloy were subjected to hot rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then repeatedly rolled at between 10% and 25% reduction per pass down to 2 mm thickness mimicking multi-stand hot rolling at Stage 2 during the Thin Slab Process (FIG. 2). The plates were placed in the furnace for 1 to 2 min between rolling steps to allow then to return to temperature. If the plates became too long to fit in the furnace they were cooled, cut to a shorter length, then reheated in the furnace for 60 minutes before they were rolled again towards targeted gauge thickness. Total reduction at the hot rolling was 96%. Hot rolled sheets from both alloys were heat treated at 850° C. for 6 hr with slow cooling with furnace (0.75° C./min) to 500° C. with subsequent air cooling.

The tensile specimens were cut from the rolled and heat treated sheets from Alloy 32 and Alloy 42 using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. A video extensometer was utilized for strain measurements.

Tensile properties for both alloys are plotted in FIG. 41. Hot rolled data represents properties of the sheets corresponding to as-produced state in a case of Thin Slab Production including solidification, hot rolling and coiling (open symbols in FIG. 41). Both alloys show similar properties in hot rolled state with high ductility in the range from 45 to 48%. Heat treatment of the Alloy 42 sheet has changed the properties slightly while Alloy 32 has demonstrated a significant increase in ductility (up to 66.56%) in the heat treated state (solid symbols in FIG. 41) which may be due to elimination of defects and additional matrix grain coarsening.

This Case Example demonstrated properties in Alloy 32 and Alloy 42 plates cast at 50 mm thickness and undergoing hot rolling. High ductility in these alloys suggests that the Homogenized Modal Structure of Type 1 (Table 3) was formed during hot rolling.

Case Example #16

Structural Evolution in Alloy 24 During Hot Rolling

The structural evolution in Alloy 24 plate initially cast at 50 mm thickness was studied by TEM. The casting was done using a Indutherm VTC 800 V Tilt Vacuum Caster, and then the slab was hot rolled to 2 mm thick sheet at 1100° C. To study the structural evolution, samples from Alloy 24 in the as-cast and hot rolled conditions were studied by TEM.

TEM specimen preparation procedure includes cutting, thinning, and electropolishing. First, samples were cut with electric discharge machine, and then thinned by grinding with pads of reduced grit size every time. Further thinning to 60 to 70 μm thickness was done by polishing with 9 μm, 3 μm and 1 μm diamond suspension solution respectively. Discs of 3 mm in diameter were punched from the foils and the final polishing was fulfilled with electropolishing using a twin-jet polisher. The chemical solution used was a 30% nitric acid mixed in a methanol base. In case of insufficient thin area for TEM observation, the TEM specimens were ion-milled using a Gatan Precision Ion Polishing System (PIPS). The ion-milling was done at 4.5 keV, and the inclination angle was reduced from 4° to 2° to open up the thin area. The TEM studies were done using a JEOL 2100 high-resolution microscope operated at 200 kV.

The microstructure of as-cast plate is shown in FIG. 42 which is the Modal Structure (Structure #1, FIG. 8). As it can be seen in FIG. 42*a*, the boride phase is long and slim, aligned at grain boundaries of matrix. The size of boride phase can range from 1 μm to up to 10 μm, while the size of the matrix in between is typically 5 to 10 μm. In general, it is seen that the boride phase resides at grain boundaries of matrix that fits the basic characteristic of the Modal Structure. Partial transformation into the Nanomodal Structure (Structure #2, FIG. 8) in some areas can also be observed in this alloy as shown in FIG. 42*b* where the matrix grains undergo refinement. Partial transformation might be related to slow cooling rate when alloy cast at large thicknesses resulting in extended time at elevated temperature to allow limited Static Nanophase Refinement (Mechanism #1, FIG. 8) in some areas.

After hot rolling, the boride phase was broken up into small particles and is well scattered in the matrix indicating structural homogenization through Dynamic Nanophase Refinement (Mechanism #0, FIG. 8) leading to Homogenized Modal Structure formation (Structure #1a, FIG. 8). As shown in FIG. 43, the size of boride phase can be somewhere from 1 μm to 5 μm, but the slim geometry is largely reduced to a smaller aspect ratio. The matrix grains, compared to the as-cast state, are significantly refined with the grain size of matrix reduced to 200 to 500 nm. The matrix grains are elongated, aligning along the rolling direction after the rolling.

This Case Example demonstrated structural development in Alloy 24 plate cast at 50 mm thickness and undergoing hot rolling. Microstructural evolution is following a pathway towards desired structure formation illustrated in FIG. 8 with activation of corresponding mechanisms.

Case Example #17

Elastic Modulus in Selected Alloys

Elastic Modulus was measured for selected alloys listed in Table 22. Each alloy used was cast into a plate with thickness of 50 mm. Using a high temperature inert gas furnace the material was brought to the desired temperature, depending on alloy solidus temperature, prior to hot rolling. Initial hot rolling reduced the material thickness by approximately 85%. The oxide layer was removed from the hot rolled material using abrasive media. The center was sectioned from the resulting slab and hot rolled approximately an additional 75%. After removing the final oxide layer ASTM E8 subsize tensile samples were cut from center of the resulting material using wire electrical discharge machining (EDM). Tensile testing was performed on an Instron Model 3369 mechanical testing frame, using the Instron Bluehill control and analysis software. Samples were tested at room temperature under displacement control at a strain rate of 1×10-3 per second. Samples were mounted to a stationary bottom fixture, and a top fixture attached to a moving crosshead. A 50 kN load cell was attached to the top fixture to measure load. Tensile loading was performed to a load less than the yield point previously observed in tensile testing of the material, and this loading curve was used to obtain modulus values. Samples were pre-cycled under a tensile load below that of the predicted yield load to minimize the impact of grip settling on the measurements. Elastic modulus data in Table 23 is reported as an average value of 5 separate measurements. Modulus values vary in a range from 190 to 210 GPa typical for commercial steels and depend on alloy chemistry and thermo-mechanical treatment.

TABLE 23

Elastic Modulus Data for Selected Alloys

| Alloy | Hot Rolling Reduction (%) | Heat Treatment | Elastic Modulus, GPa |
|---|---|---|---|
| Alloy 8 | 96.1 | HT16 | 206 |
| Alloy 16 | 96.1 | None | 200 |
| Alloy 24 | 96.0 | None | 191 |
| Alloy 26 | 95.4 | None | 200 |
| Alloy 32 | 96.4 | None | 210 |
| Alloy 42 | 96.4 | None | 199 |

This Case Example demonstrates that modulus values of the alloy herein vary in a range from 190 to 210 GPa which is typical for commercial steels and depend on alloy chemistry and thermo-mechanical treatment.

Case Example #18

Segregation Analysis in Cast Plates with 50 mm Thickness

Using commercial purity feedstock, charges of different masses were weighed out for selected alloys according to the atomic ratios provided in Table 4. The elemental constituents were weighed on an analytical balance and the charges were cast at 50 mm thickness using a Indutherm VTC 800 V Tilt Vacuum Caster. The feedstock was melted using RF induction and then poured into a water cooled copper die forming a cast plate. Plate casting corresponds to Stage 1 of Thin Slab Production (FIG. 2).

In the center of the cast plate was a shrinkage funnel that was created by the solidification of the last amount of liquid metal. A schematic of the cross section through the center of the plate is shown in FIG. 44, which shows the shrinkage funnel at the top of the figure.

Two thin sections that were ~4 mm thick were cut using wire electrical discharge machining (EDM) one from the top and the other from bottom of the cast plate. Small samples from the center of the bottom thin section (marked "B" in FIG. 44) and from the inside edge of the shrinkage funnel (marked "A" in in FIG. 44) were used for chemical analysis for each selected alloy. Chemical analysis was conducted by Inductively Coupled Plasma (ICP) method which is capable of accurately measuring the concentration of individual elements.

The results of the chemical analysis are shown in FIG. 45. The content of each individual element in wt % is shown for the tested locations at the top (A) and bottom (B) of the cast plate for the four alloys identified. The difference between the top (A) and bottom (B) ranges from 0.00 wt % to 0.19 wt % with no evidence for macrosegregation.

This Case Example demonstrates that in spite of the cast plate thickness of 50 mm, there was no macrosegregation detected in the cast plates from alloys herein.

Case Example #19

Tensile Properties Comparison with Existing Steel Grades

Tensile properties of selected alloys from Table 4 were compared with tensile properties of existing steel grades. The selected alloys and corresponding parameters are listed in Table 24. Tensile stress—strain curves are compared to that of existing Dual Phase (DP) steels (FIG. 46); Complex Phase (CP) steels (FIG. 47); Transformation Induced Plasticity (TRIP) steels (FIG. 48); and Martensitic (MS) steels (FIG. 49). A Dual Phase Steel may be understood as a steel type containing a ferritic matrix containing hard martensitic second phases in the form of islands, a Complex Phase Steel may be understood as a steel type containing a matrix consisting of ferrite and bainite containing small amounts of martensite, retained austenite, and pearlite, a Transformation Induced Plasticity steel may be understood as a steel type which consists of austenite embedded in a ferrite matrix which additionally contains hard bainitic and martensitic second phases and a Martensitic steel may be understood as a steel type consisting of a martensitic matrix which may contain small amounts of ferrite and/or bainite.

TABLE 24

Selected Tensile Curves Labels and Identity

| Curve Label | Alloy | As Cast Thickness (mm) | Hot Rolling Parameters | Heat Treatment Parameters |
|---|---|---|---|---|
| A | Alloy 26 | 50 | 1100° C., 96% | 1100° C., 2 Hr |
| B | Alloy 1 | 50 | 1150° C., 93% | 1150° C., 2 Hr |
| C | Alloy 16 | 50 | 1150° C., 96% | 950° C., 6 Hr |
| D | Alloy 42 | 50 | 1100° C., 96% | 850° C., 0.75° C./min Cool |
| E | Alloy 32 | 50 | 1100° C., 96% | 850° C., 0.75° C./min Cool |

This case Example demonstrates that the alloys disclosed here have relatively superior mechanical properties as compared to existing advanced high strength (AHSS) steel grades with. Ductility of 20% and above demonstrated by selected alloys provides cold formability of the sheet material and make it applicable to many processes such as for example cold stamping of a relatively complex part.

Case Example #20

Tensile Properties of Selected Alloys at Cast Thickness Corresponding to Thin Slab Casting Plate casting with 50 mm thickness from Alloy 1, Alloy 8, Alloy 16, Alloy 24, Alloy 26, Alloy 32, and Alloy 42 was done using an Indutherm VTC 800 V Tilt Vacuum Caster in order to mimic the Stage 1 of the Thin Slab Process (FIG. 2). Using commercial purity feedstock, charges of different masses were weighed out according to the atomic ratios provided in Table 4. The charges were then placed into the crucible of the caster. The feedstock was melted using RF induction and then poured into a copper die designed for casting plates with 50 mm thickness. The plates from each alloy were subjected to hot rolling using a Fenn Model 061 Rolling Mill and a Lucifer 7-R24 Atmosphere Controlled Box Furnace. The plates were placed in a furnace pre-heated to 1140° C. for 60 minutes prior to the start of rolling. The plates were then repeatedly rolled at between 10% and 25% reduction per pass down to 3.5 mm thickness mimicking multi-stand hot rolling at Stage 2 during the Thin Slab Process (FIG. 2) or hot rolling step at Thick Slab Casting (FIG. 1). The plates were placed in the furnace for 1 to 2 min between rolling steps to allow them to return to temperature. If the plates became too long to fit in the furnace they were cooled, cut to a shorter length, then reheated in the furnace for 60 minutes before they were rolled again towards targeted gauge thickness. Total reduction of 96% was achieved for all alloys.

Rolled sheet from each alloy was heat treated at different conditions specified in Table 7. The tensile specimens were cut from the sheets using a Brother HS-3100 wire electrical discharge machining (EDM). The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. A non-contact video extensometer was utilized for strain measurements.

Tensile properties for Alloy 1, Alloy 8, Alloy 16, Alloy 24, Alloy 26, Alloy 32, and Alloy 42 after hot rolling and subsequent heat treatment (Table 25) are plotted in FIG. 50. The properties for the same alloys when cast at 3.3 mm with subsequent hot rolling and heat treatment (Table 8) are also shown for comparison.

TABLE 25

Tensile Properties of Selected Alloys Cast at 50 mm Thickness

| Alloy | Heat Treatment | Yield Stress (MPa) | Ultimate Strength (MPa) | Tensile Elongation (%) |
|---|---|---|---|---|
| Alloy 1 | HT1 | 482 | 1082 | 20.9 |
| | | 478 | 1058 | 20.8 |
| | | 473 | 1052 | 17.6 |
| | | 495 | 1086 | 17.5 |
| | | 490 | 1059 | 16.7 |
| | HT2 | 453 | 1158 | 27.6 |
| | | 449 | 1132 | 27.3 |
| | | 475 | 1198 | 26.5 |
| | | 471 | 1154 | 24.7 |
| | | 447 | 1095 | 24.6 |
| | HT6 | 418 | 1178 | 28.9 |
| | | 484 | 1213 | 27.7 |
| | | 468 | 1156 | 23.3 |
| | | 418 | 1075 | 22.8 |
| | | 417 | 1072 | 21.7 |
| | | 412 | 1037 | 19.8 |
| Alloy 8 | HT1 | 359 | 1307 | 15.4 |
| | | 363 | 1291 | 13.3 |
| | HT2 | 316 | 1224 | 18.7 |
| | | 315 | 1218 | 17.7 |
| | | 308 | 1208 | 16.9 |
| | HT5 | 343 | 1307 | 17.3 |
| | | 337 | 1287 | 16.6 |
| | | 333 | 1298 | 15.6 |
| Alloy 16 | HT1 | 459 | 1132 | 32.5 |
| | | 437 | 1137 | 31.8 |
| | | 434 | 1140 | 31.5 |
| | | 586 | 1228 | 23.7 |
| | | 583 | 1212 | 23.0 |
| | | 591 | 1218 | 22.7 |
| | | 575 | 1224 | 22.2 |
| | | 437 | 1137 | 31.8 |
| | | 459 | 1132 | 32.5 |
| | | 434 | 1140 | 31.5 |
| | HT2 | 443 | 1136 | 36.6 |
| | | 408 | 1146 | 35.8 |
| | | 439 | 1126 | 35.6 |
| | | 489 | 1152 | 30.6 |
| | | 572 | 1171 | 26.1 |
| | | 544 | 1161 | 25.2 |
| | | 443 | 1136 | 36.6 |
| | | 408 | 1146 | 35.8 |
| | | 439 | 1126 | 35.6 |
| | HT6 | 334 | 1095 | 39.7 |
| | | 367 | 1098 | 39.4 |
| | | 354 | 1094 | 38.7 |
| | | 389 | 1051 | 32.2 |
| | | 388 | 1056 | 31.8 |
| | | 382 | 1031 | 31.0 |
| | | 382 | 1044 | 30.7 |
| | | 611 | 1250 | 24.9 |
| | | 574 | 1201 | 23.5 |
| | | 605 | 1190 | 22.4 |
| | | 564 | 1202 | 22.1 |
| | | 367 | 1098 | 39.4 |
| | | 354 | 1094 | 38.7 |
| | | 334 | 1095 | 39.7 |
| Alloy 24 | HT1 | 409 | 1274 | 21.1 |
| | | 400 | 1289 | 20.9 |
| | | 387 | 1270 | 20.6 |
| | HT2 | 373 | 1241 | 23.3 |
| | | 363 | 1231 | 23.1 |
| | | 357 | 1236 | 22.1 |
| | HT5 | 335 | 1196 | 27.5 |
| | | 346 | 1193 | 26.6 |
| Alloy 26 | HT1 | 334 | 1041 | 9.8 |
| | | 323 | 1058 | 9.6 |
| | | 328 | 984 | 8.7 |
| | HT2 | 313 | 1266 | 23.4 |
| | | 313 | 1288 | 22.8 |
| | | 317 | 1264 | 17.1 |
| | HT5 | 319 | 1281 | 23.8 |
| | | 321 | 1309 | 23.7 |
| | | 314 | 1277 | 23.7 |

TABLE 25-continued

Tensile Properties of Selected Alloys Cast at 50 mm Thickness

| Alloy | Heat Treatment | Yield Stress (MPa) | Ultimate Strength (MPa) | Tensile Elongation (%) |
|---|---|---|---|---|
| Alloy 32 | HT1 | 295 | 806 | 66.6 |
| | | 286 | 803 | 61.6 |
| | | 291 | 805 | 61.0 |
| | HT2 | 274 | 772 | 63.7 |
| | HT5 | 243 | 771 | 64.2 |
| | | 239 | 792 | 62.9 |
| | | 254 | 770 | 61.2 |
| Alloy 42 | HT1 | 339 | 1072 | 50.8 |
| | | 337 | 1056 | 50.0 |
| | | 344 | 1067 | 45.1 |
| | | 282 | 1116 | 44.1 |
| | | 276 | 1061 | 30.6 |
| | | 282 | 1032 | 32.5 |
| | HT2 | 299 | 949 | 47.5 |
| | | 293 | 869 | 37.9 |
| | | 304 | 959 | 46.7 |
| | HT5 | 309 | 1022 | 43.5 |
| | | 287 | 981 | 31.6 |
| | | 282 | 1074 | 37.0 |

This Case Example demonstrates that same level of properties achieved in the alloys herein when casting thickness increased from 3.3 mm to 50 mm confirming that mechanisms in alloys herein follows the pathway illustrated in FIG. 8 at thicknesses corresponding to Thin Slab Casting process.

Case Example #21

Boron-Free Alloys

The chemical composition of the boron-free alloys herein (Alloy 63 through Alloy 74) is listed in Table 4 which provides the preferred atomic ratios utilized. These chemistries have been used for material processing through slab casting in an Indutherm VTC800V vacuum tilt casting machine. Alloys of designated compositions were weighed out in 3 kilogram charges using designated quantities of commercially-available ferroadditive powders of known composition and impurity content, and additional alloying elements as needed, according to the atomic ratios provided in Table 4 for each alloy. Weighed out Alloy charges were placed in zirconia coated silica-based crucibles and loaded into the casting machine. Melting took place under vacuum using a 14 kHz RF induction coil. Charges were heated until fully molten, with a period of time between 45 seconds and 60 seconds after the last point at which solid constituents were observed, in order to provide superheat and ensure melt homogeneity. Melts were then poured into a water-cooled copper die to form laboratory cast slabs of approximately 50 mm thick which is in the thickness range for the Thin Slab Casting process and 75 mm×100 mm in size.

Thermal analysis of the alloys herein was performed on the as-solidified cast slab samples on a Netzsch Pegasus 404 Differential Scanning calorimeter (DSC). Measurement profiles consisted of a rapid ramp up to 900° C., followed by a controlled ramp to 1425° C. at a rate of 10° C./minute, a controlled cooling from 1425° C. to 900° C. at a rate of 10° C./min, and a second heating to 1425° C. at a rate of 10° C./min. Measurements of solidus, liquidus, and peak temperatures were taken from the final heating stage, in order to ensure a representative measurement of the material in an equilibrium state with the best possible measurement contact. In the alloys listed in Table 26, melting occurs in one stage except in Alloy 65 with melting in two stages. Initial melting recorded from minimum at ~1278° C. and depends on Alloy chemistry. Maximum final melting temperature recorded at 1450° C.

TABLE 26

Differential Thermal Analysis Data for Melting Behavior

| Alloy | Solidus (° C.) | Liquidus 2 (° C.) | Peak 1 (° C.) | Peak 2 (° C.) | Peak 3 (° C.) | Peak 4 (° C.) |
|---|---|---|---|---|---|---|
| Alloy 63 | 1377 | 1433 | 1426 | — | — | — |
| Alloy 64 | 1365 | 1422 | 1404 | — | — | — |
| Alloy 65 | 1341 | 1408 | 1369 | 1402 | — | — |
| Alloy 66 | 1353 | 1421 | 1413 | — | — | — |
| Alloy 67 | 1353 | 1407 | 1400 | — | — | — |
| Alloy 68 | 1278 | 1389 | 1384 | — | — | |
| Alloy 69 | 1387 | 1449 | 1444 | — | — | — |
| Alloy 70 | 1378 | 1434 | 1429 | — | — | — |
| Alloy 71 | 1395 | 1444 | 1439 | — | — | — |
| Alloy 72 | 1395 | 1450 | 1446 | — | — | — |
| Alloy 73 | 1386 | 1442 | 1437 | — | — | — |
| Alloy 74 | 1392 | 1448 | 1445 | | | |

The 50 mm thick laboratory slab from each alloy was subjected to hot rolling at the temperature of 1250° C. except that from Alloy 68 which was rolled at 1250° C. Rolling was done on a Fenn Model 061 single stage rolling mill, employing an in-line Lucifer EHS3GT-B18 tunnel furnace. Material was held at hot rolling temperature for an initial dwell time of 40 minutes to ensure homogeneous temperature. After each pass on the rolling mill, the sample was returned to the tunnel furnace with a 4 minute temperature recovery hold to correct for temperature lost during the hot rolling pass. Hot rolling was conducted in two campaigns, with the first campaign achieving approximately 80% to 88% total reduction to a thickness of between 6 mm and 9.5 mm. Following the first campaign of hot rolling, a section of sheet between 130 mm and 200 mm long was cut from the center of the hot rolled material. This cut section was then used for a second campaign of hot rolling for a total reduction between both campaigns of between 96% and 97%. A list of specific hot rolling parameters used for all alloys is available in Table 27.

The density of the alloys was measured on-sections of cast material that had been hot rolled to between 6 mm and 9.5 mm. Sections were cut to 25 mm×25 mm dimensions, and then surface ground to remove oxide from the hot rolling process. Measurements of bulk density were taken from these ground samples, using the Archimedes method in a specially constructed balance allowing weighing in both air and distilled water. The density of each Alloy is tabulated in Table 28 and was found to vary from 7.64 to 7.80 g/cm$^3$. Experimental results have revealed that the accuracy of this technique is ±0.01 g/cm$^3$.

TABLE 28

Average Alloy Densities

| Alloy | Density (g/cm$^3$) |
|---|---|
| Alloy 63 | 7.78 |
| Alloy 64 | 7.72 |
| Alloy 65 | 7.66 |
| Alloy 66 | 7.76 |
| Alloy 67 | 7.70 |
| Alloy 68 | 7.64 |
| Alloy 69 | 7.79 |
| Alloy 70 | 7.78 |
| Alloy 71 | 7.80 |
| Alloy 72 | 7.80 |
| Alloy 73 | 7.80 |
| Alloy 74 | 7.79 |

The fully hot-rolled sheet was then subjected to cold rolling in multiple passes. Rolling was done on a Fenn Model 061 single stage rolling mill. A list of specific cold rolling parameters used for the alloys is shown in Table 29.

TABLE 27

Hot Rolling Parameters

| Alloy | Temperature (° C.) | Campaign | # Passes | Initial Thickness (mm) | Final Thickness (mm) | Campaign Reduction (%) | Cumulative Reduction (%) |
|---|---|---|---|---|---|---|---|
| Alloy 63 | 1250 | 1 | 6 | 49.30 | 9.15 | 81.5 | 81.5 |
| | | 2 | 3 | 9.15 | 1.69 | 81.5 | 96.6 |
| Alloy 64 | 1250 | 1 | 6 | 48.82 | 9.19 | 81.2 | 81.2 |
| | | 2 | 3 | 9.19 | 1.83 | 80.1 | 96.3 |
| Alloy 65 | 1250 | 1 | 6 | 49.07 | 8.90 | 81.9 | 81.9 |
| | | 2 | 3 | 8.90 | 1.82 | 79.6 | 96.3 |
| Alloy 66 | 1250 | 1 | 6 | 48.79 | 9.02 | 81.5 | 81.5 |
| | | 2 | 3 | 9.02 | 1.71 | 81.1 | 96.5 |
| Alloy 67 | 1250 | 1 | 6 | 48.86 | 9.22 | 81.1 | 81.1 |
| | | 2 | 3 | 9.22 | 1.75 | 81.0 | 96.4 |
| Alloy 68 | 1200 | 1 | 6 | 48.91 | 9.45 | 80.7 | 80.7 |
| | | 2 | 3 | 9.45 | 1.96 | 79.2 | 96.0 |
| Alloy 69 | 1250 | 1 | 6 | 48.50 | 9.04 | 81.4 | 81.4 |
| | | 2 | 3 | 9.04 | 1.77 | 80.4 | 96.3 |
| Alloy 70 | 1250 | 1 | 6 | 48.60 | 9.27 | 80.9 | 80.9 |
| | | 2 | 3 | 9.27 | 1.73 | 81.4 | 96.5 |
| Alloy 71 | 1250 | 1 | 6 | 48.90 | 9.14 | 81.3 | 81.3 |
| | | 2 | 3 | 9.14 | 1.76 | 80.8 | 96.4 |
| Alloy 72 | 1250 | 1 | 6 | 48.67 | 9.23 | 81.0 | 81.0 |
| | | 2 | 3 | 9.23 | 1.83 | 80.2 | 96.2 |
| Alloy 73 | 1250 | 1 | 6 | 48.90 | 9.23 | 81.1 | 81.1 |
| | | 2 | 3 | 9.23 | 1.87 | 79.8 | 96.2 |
| Alloy 74 | 1250 | 1 | 6 | 48.64 | 9.32 | 80.8 | 80.8 |
| | | 2 | 3 | 9.32 | 1.93 | 79.3 | 96.0 |

TABLE 29

| Cold Rolling Parameters | | | | |
|---|---|---|---|---|
| Alloy | # Passes | Initial Thickness (mm) | Final Thickness (mm) | Reduction (%) |
| Alloy 63 | 4 | 1.76 | 1.18 | 33.1 |
| Alloy 64 | 5 | 1.82 | 1.18 | 35.1 |
| Alloy 65 | 7 | 1.87 | 1.20 | 35.8 |
| Alloy 66 | 4 | 1.71 | 1.15 | 32.7 |
| Alloy 67 | 5 | 1.78 | 1.17 | 33.9 |
| Alloy 68 | 11 | 2.03 | 1.21 | 40.5 |
| Alloy 69 | 5 | 1.78 | 1.20 | 32.3 |
| Alloy 70 | 4 | 1.74 | 1.21 | 30.6 |
| Alloy 71 | 9 | 1.80 | 1.20 | 33.2 |
| Alloy 72 | 10 | 1.84 | 1.20 | 34.7 |
| Alloy 73 | 10 | 1.87 | 1.21 | 35.2 |
| Alloy 74 | 13 | 1.95 | 1.22 | 37.5 |

After hot and cold rolling, tensile specimens were cut via EDM. The resultant samples were heat treated at the parameters specified in Table 30. Hydrogen heat treatments were conducted in a CAMCo G1200-ATM sealed atmosphere furnace. Samples were loaded at room temperature and were heated to the target dwell temperature at 1200° C./hour. Dwells were conducted under atmospheres listed in Table 30. Samples were cooled under furnace control in an argon atmosphere. Hydrogen-free heat treatments were conducted in a Lucifer 7GT-K12 sealed box furnace under an argon gas purge, or in a ThermCraft XSL-3-0-24-1C tube furnace. In the case of air cooling, the specimens were held at the target temperature for a target period of time, removed from the furnace and cooled in air. In cases of controlled cooling, the furnace temperature was lowered at a specified rate with samples loaded.

TABLE 30

| Heat Treatment Parameters | | | | |
|---|---|---|---|---|
| Heat Treatment | Furnace Temperature [° C.] | Dwell Time [min] | Atmosphere | Cooling |
| HT1 | 850 | 360 | Argon Flow | 0.75° C./min to <500° C. then Air |
| HT11 | 850 | 5 | Argon Flow | Air Normalized |
| HT12 | 850 | 360 | 25% H2/75% Ar | 45° C./Hour |
| HT13 | 950 | 360 | 25% H2/75% Ar | Fast Furnace Control |
| HT14 | 1200 | 120 | 25% H2/75% Ar | Fast Furnace Control |

Tensile specimens were tested in the hot rolled, cold rolled, and heat treated conditions. Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture.

Tensile properties of the alloys in the as hot rolled condition are listed in Table 31. The ultimate tensile strength values may vary from 947 to 1329 MPa with tensile elongation from 20.5 to 55.4%. The yield stress is in a range from 267 to 520 MPa. The mechanical characteristic values in the steel alloys herein will depend on alloy chemistry and hot rolling conditions. An example stress-strain curve for Alloy 63 in as hot rolled state is shown in FIG. 52 demonstrating typical Class 2 behavior (FIG. 7).

TABLE 31

| Tensile Properties of Alloys After Hot Rolling | | | |
|---|---|---|---|
| All | Yield Stress (MPa) | UTS (MPa) | Tensile Elongation (%) |
| Alloy 63 | 329 | 1184 | 53.3 |
| | 314 | 1195 | 49.8 |
| | 330 | 1191 | 49.0 |
| Alloy 64 | 314 | 1211 | 52.4 |
| | 344 | 1210 | 55.4 |
| | 353 | 1205 | 54.1 |
| Alloy 65 | 366 | 1228 | 42.8 |
| | 355 | 1235 | 49.1 |
| | 334 | 1207 | 50.4 |
| Alloy 66 | 469 | 981 | 39.5 |
| | 429 | 960 | 35.1 |
| | 465 | 967 | 39.8 |
| Alloy 67 | 414 | 947 | 29.0 |
| | 439 | 970 | 30.6 |
| | 416 | 965 | 30.2 |
| Alloy 68 | 475 | 1107 | 39.3 |
| | 487 | 1114 | 43.8 |
| | 520 | 1099 | 40.9 |
| Alloy 69 | 284 | 1293 | 48.3 |
| | 278 | 1301 | 43.7 |
| | 267 | 1287 | 49.8 |
| Alloy 70 | 307 | 1248 | 53.4 |
| | 294 | 1248 | 51.4 |
| | 310 | 1253 | 49.2 |
| Alloy 71 | 298 | 1297 | 37.5 |
| | 278 | 1320 | 35.3 |
| | 297 | 1310 | 38.5 |
| Alloy 72 | 296 | 1291 | 43.6 |
| | 292 | 1311 | 46.1 |
| | 329 | 1329 | 48.1 |

TABLE 31-continued

| Tensile Properties of Alloys After Hot Rolling | | | |
|---|---|---|---|
| All | Yield Stress (MPa) | UTS (MPa) | Tensile Elongation (%) |
| Alloy 73 | 303 | 1301 | 38.7 |
| | 296 | 1255 | 34.9 |
| | 278 | 1266 | 34.2 |
| Alloy 74 | 281 | 1280 | 43.3 |
| | 273 | 990 | 20.5 |

Tensile properties of selected alloys after hot rolling and subsequent cold rolling are listed in Table 32 which represent Structure #3 or the High Strength Nanomodal Structure. The ultimate tensile strength values may vary from 1402 to 1766 MPa with tensile elongation from 9.7 to 29.1%. The yield stress is in a range from 913 to 1278 MPa. The mechanical characteristic values in the steel alloys herein will depend on alloy chemistry and processing conditions.

TABLE 32

Tensile Properties of Selected Alloys After Cold Rolling

| Alloy | Yield Stress (MPa) | UTS (MPa) | Tensile Elongation (%) |
|---|---|---|---|
| Alloy 63 | 975 | 1587 | 25.3 |
| | 1043 | 1570 | 23.8 |
| | 1044 | 1559 | 22.5 |
| Alloy 64 | 1109 | 1630 | 21.4 |
| | 1085 | 1594 | 18.4 |
| | 1057 | 1604 | 21.3 |
| Alloy 65 | 1135 | 1686 | 22.1 |
| | 1159 | 1681 | 21.9 |
| Alloy 66 | 1048 | 1409 | 26.4 |
| | 1031 | 1402 | 18.5 |
| | 1093 | 1416 | 29.1 |
| Alloy 67 | 1048 | 1541 | 26.7 |
| | 1107 | 1531 | 23.2 |
| | 1119 | 1508 | 16.7 |
| Alloy 68 | 1278 | 1645 | 16.2 |
| | 1204 | 1665 | 17.9 |
| Alloy 70 | 1033 | 1572 | 18.8 |
| | 913 | 1579 | 21.3 |
| Alloy 71 | 954 | 1672 | 18.1 |
| | 967 | 1669 | 19.5 |
| | 1045 | 1647 | 11.7 |
| Alloy 72 | 1128 | 1734 | 11.2 |
| | 1137 | 1751 | 18.5 |
| | 1202 | 1763 | 17.9 |
| Alloy 73 | 1031 | 1718 | 18.1 |
| | 1088 | 1695 | 15.7 |
| | 1070 | 1715 | 19.7 |
| Alloy 69 | 1124 | 1712 | 9.7 |
| | 1115 | 1735 | 11.5 |
| | 1155 | 1766 | 19.4 |
| Alloy 74 | 1140 | 1693 | 13.3 |
| | 1156 | 1712 | 18.4 |
| | 1120 | 1725 | 18.5 |

Tensile properties of the hot rolled sheets after hot rolling with subsequent heat treatment at different parameters (Table 30) are listed in Table 33. The ultimate tensile strength values may vary from 669 to 1352 MPa with tensile elongation from 15.9% to 78.1%. The yield stress is in a range from 217 to 621 MPa. The mechanical characteristic values in the steel alloys herein will depend on alloy chemistry and processing conditions.

TABLE 33

Tensile Properties of Alloys with Hot Rolling and Subsequent Heat Treatment

| Alloy | Heat Treatment 1 | Yield Stress (MPa) | UTS (MPa) | Tensile Elongation (%) |
|---|---|---|---|---|
| Alloy 63 | HT14 | 223 | 1083 | 42.1 |
| | | 217 | 1104 | 47.2 |
| | | 220 | 1100 | 49.5 |
| | HT1 | 393 | 1180 | 53.8 |
| | | 391 | 1186 | 45.9 |
| | | 398 | 1160 | 51.3 |
| | HT12 | 385 | 979 | 27.2 |
| | | 383 | 1091 | 33.0 |
| | | 383 | 1104 | 36.1 |
| | HT13 | 333 | 1169 | 51.9 |
| | | 341 | 1175 | 51.6 |
| | | 342 | 1164 | 51.3 |
| | HT11 | 459 | 1227 | 51.3 |
| | | 470 | 1198 | 58.0 |
| | | 489 | 1220 | 48.5 |

TABLE 33-continued

Tensile Properties of Alloys with Hot Rolling and Subsequent Heat Treatment

| Alloy | Heat Treatment 1 | Yield Stress (MPa) | UTS (MPa) | Tensile Elongation (%) |
|---|---|---|---|---|
| Alloy 64 | HT14 | 217 | 1091 | 46.6 |
| | | 221 | 1107 | 48.1 |
| | | 224 | 1116 | 51.3 |
| | HT1 | 426 | 1227 | 44.7 |
| | | 457 | 1226 | 45.5 |
| | HT12 | 415 | 1150 | 36.7 |
| | | 414 | 1130 | 35.3 |
| | | 418 | 1147 | 35.1 |
| | HT13 | 350 | 1195 | 52.3 |
| | | 361 | 1163 | 56.3 |
| | | 362 | 1174 | 52.3 |
| | HT11 | 489 | 1248 | 54.2 |
| | | 505 | 1251 | 52.7 |
| | | 487 | 1255 | 56.1 |
| Alloy 65 | HT14 | 228 | 1072 | 34.7 |
| | | 226 | 1047 | 32.3 |
| | | 239 | 1135 | 47.8 |
| | HT1 | 459 | 944 | 22.7 |
| | | 453 | 925 | 22.0 |
| | | 456 | 984 | 24.3 |
| | HT12 | 447 | 1097 | 31.2 |
| | | 432 | 1024 | 27.9 |
| | | 448 | 1174 | 40.3 |
| | HT13 | 335 | 1187 | 60.5 |
| | | 348 | 1171 | 56.5 |
| | | 337 | 1187 | 54.2 |
| | HT11 | 502 | 1284 | 54.0 |
| | | 506 | 1247 | 54.3 |
| | | 505 | 1254 | 55.2 |
| Alloy 66 | HT14 | 280 | 823 | 34.3 |
| | | 282 | 838 | 33.2 |
| | | 282 | 850 | 37.8 |
| | HT12 | 413 | 1059 | 47.6 |
| | | 409 | 1042 | 44.3 |
| | | 414 | 989 | 39.8 |
| | HT13 | 366 | 1110 | 78.1 |
| | | 365 | 1112 | 63.5 |
| | | 364 | 1107 | 73.5 |
| | HT11 | 501 | 1104 | 71.0 |
| | | 487 | 1104 | 68.8 |
| | | 469 | 1091 | 75.7 |
| Alloy 67 | HT14 | 294 | 801 | 28.0 |
| | | 298 | 825 | 32.0 |
| | | 294 | 832 | 33.1 |
| | HT12 | 452 | 1051 | 34.6 |
| | | 457 | 1082 | 35.6 |
| | | 466 | 998 | 30.5 |
| | HT13 | 410 | 1230 | 59.3 |
| | | 401 | 1113 | 42.6 |
| | | 402 | 1119 | 42.7 |
| | HT11 | 540 | 1170 | 48.2 |
| | | 524 | 1178 | 59.0 |
| | | 546 | 1216 | 70.3 |
| Alloy 68 | HT14 | 307 | 778 | 27.2 |
| | | 315 | 745 | 28.6 |
| | | 298 | 669 | 22.5 |
| | HT12 | 515 | 904 | 20.3 |
| | | 489 | 1113 | 33.2 |
| | | 497 | 1070 | 28.6 |
| | HT13 | 418 | 1145 | 43.7 |
| | | 431 | 1069 | 38.3 |
| | | 427 | 1089 | 38.8 |
| | HT11 | 617 | 1280 | 53.2 |
| | | 621 | 1287 | 52.4 |
| Alloy 69 | HT12 | 385 | 1166 | 31.5 |
| | | 387 | 1222 | 37.4 |
| | | 374 | 1133 | 27.5 |
| | HT13 | 290 | 1198 | 46.3 |
| | | 307 | 1240 | 44.4 |
| | | 303 | 1215 | 42.7 |
| | HT11 | 458 | 1260 | 53.2 |
| | | 468 | 1327 | 46.9 |
| | | 446 | 1242 | 49.6 |

TABLE 33-continued

Tensile Properties of Alloys with Hot Rolling and Subsequent Heat Treatment

| Alloy | Heat Treatment 1 | Yield Stress (MPa) | UTS (MPa) | Tensile Elongation (%) |
|---|---|---|---|---|
| | HT13 | 330 | 1170 | 43.4 |
| | | 319 | 1189 | 51.8 |
| | | 324 | 1192 | 52.1 |
| | HT11 | 443 | 1212 | 51.1 |
| | | 458 | 1231 | 57.9 |
| | | 422 | 1200 | 51.9 |
| Alloy 71 | HT12 | 361 | 963 | 17.3 |
| | | 367 | 992 | 18.2 |
| | | 357 | 931 | 15.9 |
| | HT13 | 316 | 1228 | 34.7 |
| | | 413 | 1232 | 28.1 |
| | | 328 | 1287 | 40.8 |
| | HT11 | 448 | 1349 | 48.5 |
| | | 444 | 1338 | 48.0 |
| | | 451 | 1348 | 47.3 |
| Alloy 72 | HT12 | 401 | 1073 | 23.6 |
| | | 361 | 1089 | 25.1 |
| | | 368 | 1082 | 25.1 |
| | HT13 | 307 | 1255 | 43.4 |
| | | 320 | 1257 | 51.3 |
| | | 319 | 1234 | 45.3 |
| | HT11 | 491 | 1336 | 50.6 |
| | | 483 | 1312 | 53.7 |
| | | 495 | 1352 | 48.2 |
| Alloy 73 | HT14 | 248 | 1226 | 40.4 |
| | | 246 | 1235 | 42.4 |
| | | 242 | 1190 | 39.8 |
| | HT12 | 369 | 1152 | 25.9 |
| | | 378 | 1120 | 25.4 |
| | | 427 | 1237 | 30.6 |
| | HT13 | 320 | 1281 | 46.5 |
| | | 324 | 1281 | 48.5 |
| | | 329 | 1308 | 45.1 |
| | HT11 | 485 | 1312 | 42.5 |
| | | 485 | 1328 | 42.5 |
| | | 472 | 1346 | 47.1 |
| Alloy 74 | HT12 | 432 | 1153 | 29.8 |
| | | 444 | 1264 | 49.0 |
| | | 430 | 1229 | 35.4 |
| | HT13 | 324 | 1210 | 57.4 |
| | | 329 | 1256 | 46.2 |
| | | 326 | 1204 | 53.9 |
| | HT11 | 523 | 1244 | 40.5 |
| | | 538 | 1288 | 58.5 |
| | | 511 | 1263 | 52.4 |

This Case Example demonstrates that mechanisms in boron-free alloys follow the pathway illustrated in FIG. 8 without boride formation providing high strength with high ductility property combinations.

Case Example 22

Structural Development in Boron-Free Alloy

Plate with 50 mm thickness from Alloy 65 was cast in an Indutherm VTC800V vacuum tilt casting machine. Alloy of designated composition was weighed out in 3 kilogram charges using designated quantities of commercially-available ferroadditive powders of known composition and impurity content, and additional alloying elements as needed, according to the atomic ratios provided in Table 4. Weighed out Alloy charge was placed in zirconia coated silica-based crucibles and loaded into the casting machine. Melting took place under vacuum using a 14 kHz RF induction coil. Alloy charge was heated until fully molten, with a period of time between 45 seconds and 60 seconds after the last point at which solid constituents were observed, in order to provide superheat and ensure melt homogeneity. Melt was then poured into a water-cooled copper die to form laboratory cast slab of approximately 50 mm thick which is in the thickness range for the Thin Slab Casting process and 75 mm×100 mm in size.

The 50 mm thick laboratory slab from the Alloy 65 was subjected to hot rolling at the temperature of 1250° C. with a total reduction of 97%. The fully hot-rolled sheet was then subjected to cold rolling in multiple passes down to thickness of 1.2 mm. Cold rolled sheet was heat treated at 850° C. for 5 minutes that mimic in-line annealing at commercial sheet production. To make SEM specimens, the cross-sections of the sheet sample in as-cast state, after hot rolling, and after cold rolling with subsequent heat treatment were cut and ground by SiC paper and then polished progressively with diamond media paste down to 1 μm grit. The final polishing was done with 0.02 μm grit $SiO_2$ solution. Microstructures of samples from Alloy 65 were examined by scanning electron microscopy (SEM) using an EVO-MA10 scanning electron microscope manufactured by Carl Zeiss SMT Inc.

FIG. 53 shows SEM images of microstructure in Alloy 65 in as-cast state, after hot rolling, and after cold rolling with subsequent heat treatment demonstrating a structural development from Modal Structure in as-cast state (FIG. 53*a*), Nanomodal Structure in the hot rolled state (FIG. 53*b*), and High Strength Nanomodal Structure after cold rolling (FIG. 53*c*).

This Case Example demonstrates structural development in boron-free alloys is similar to that for alloys containing boron (FIG. 8) although matrix grains size can be larger in the absence of boride pinning phases.

What is claimed is:

1. A method comprising:

a. supplying a metal alloy comprising Fe at a level of 61.0 to 88.0 atomic percent, Si at a level of 0.5 to 9.0 atomic percent, Mn at a level of 0.90 to 19.0 atomic percent and optionally B at a level of up to 3.0 atomic percent;

b. melting said alloy and cooling and solidifying and forming an alloy having a thickness of greater than or equal to 20 mm and up to 500 mm and a yield strength of 300 MPa to 600 MPa wherein said solidified alloy has a melting point (Tm) and heating said alloy to a temperature of 700° C. to below said alloy Tm at a strain rate of $10^{-6}$ to $10^{4}$ and reducing said thickness of said alloy and providing a first resulting alloy having a yield strength of 200 MPa to 1000 MPa and stressing said first resulting alloy and providing a second resulting alloy that has a thickness of 0.1 mm to 25.0 mm and indicates a tensile strength of 400 MPa to 1825 MPa and elongation of 2.4% to 78.1%.

2. The method of claim 1 wherein said first resulting alloy has:

a. grains of 50 nm to 500,000 nm b. boride grains, if present, of 20 nm to 10,000 nm c. precipitation grains of 1 nm to 200 nm.

3. The method of claim 1 wherein said second resulting alloy has:

a. grains of 25 nm to 25000 nm b. boride grains, if present, of 20 nm to 10,000 nm c. precipitation grains of 1 nm to 200 nm.

4. The method of claim 1 further including one or more of the following:

Ni at a level of 0.1 to 9.0 atomic percent;

Cr at a level of 0.1 to 19.0 atomic percent;

Cu at a level of 0.1 to 4.0 atomic percent; and

C at a level of 0.1 to 4.0 atomic percent.

5. The method of claim 1 wherein said solidified alloy has a melting point Tm and repeatedly heating said alloy to a temperature of 700° C. to below said alloy Tm at a strain rate of $10^{-6}$ to $10^{4}$ and repeatedly reducing said thickness of said alloy during each of said heat treatments.

6. The method of claim 1 wherein said second resulting alloy is positioned in a vehicle.

7. The method of claim 1 wherein said second resulting alloy is positioned in one of a drill collar, drill pipe, pipe casing, tool joint, wellhead, compressed gas storage tank of liquefied natural gas.

8. The method of claim 1 wherein said alloy is a boron-free alloy.

* * * * *